United States Patent [19]

Morigaki et al.

[11] Patent Number: 5,028,519

[45] Date of Patent: Jul. 2, 1991

[54] SILVER HALIDE COLOR PHOTOSENSITIVE MATERIAL

[75] Inventors: Masakazu Morigaki; Nobuo Seto, both of Kanagawa, Japan

[73] Assignee: Fuji Photo Film Co., Ltd., Minami-ashigara, Japan

[21] Appl. No.: 446,313

[22] Filed: Dec. 5, 1989

[30] Foreign Application Priority Data

Dec. 6, 1988 [JP] Japan ..... 63-308660

[51] Int. Cl.[5] ..... G03C 1/08

[52] U.S. Cl. ..... 430/551; 430/505; 430/512; 430/931; 430/613; 430/614

[58] Field of Search ..... 430/551, 505, 512, 931, 430/613, 614

[56] References Cited

U.S. PATENT DOCUMENTS 4,639,415 1/1987 Kaneko et al. ..... 430/614

FOREIGN PATENT DOCUMENTS 63-205651 2/1987 Japan ..... 430/551

1326889 8/1973 United Kingdom ..... 430/613

*Primary Examiner*—Charles L. Bowers, Jr.

*Assistant Examiner*—Thomas R. Neville

*Attorney, Agent, or Firm*—Burns, Doane, Swecker & Mathis

[57] ABSTRACT

A silver halide color photosensitive material is disclosed. The photosensitive material comprises a support and a photographic layer. According to the present invention, the photographic layer contains a heterocyclic compound. The heterocyclic compound is, for example, represented by the following formula [I]:

[I]

in which n is 1, 2 or 3; and each of Ra and Rb independently is an acyl group, a sulfonyl group, a sulfinyl group, an alkoxycarbonyl group, an aryloxycarbonyl group, a phosphoryl group, a sulfamoyl group or a carbamoyl group. The other heterocyclic compounds represented by the formulas [II], [III], [IV], [V], and [VI] are also disclosed.

18 Claims, No Drawings

SILVER HALIDE COLOR PHOTOSENSITIVE MATERIAL

FIELD OF THE INVENTION

The present invention relates to a silver halide photosensitive material, particularly to a silver halide color photosensitive material which is improved in the stability of the dye image to light or heat, and more particularly to a silver halide color photosensitive material which is protected from a fading of a yellow color image and a cyan color image.

BACKGROUND OF THE INVENTION

It has been well known that a silver halide color photosensitive material forms a dye image by an imagewise exposure of the photosensitive material to light and a color development of the material. The dyes in the obtained image, such as indophenol, indoaniline, indamine, azomethine, phenoxazine and phenazine dyes are formed by a reaction of an oxidized aromatic primary amine color developing agent with a coupler in the color development.

In general, the quality of the obtained photographic image is not perpetual, and is gradually degraded while the photograph is preserved. A color photograph having an image made of an azomethine or indoaniline dye is particularly apt to be degraded. The degradation of the image is caused by a fading or discoloration of the dye image or a discoloration on a white ground (yellow stain), when the photograph is irradiated with light for a long term, or preserved at a high temperature and humidity.

The degradation of the image quality is a serious disadvantage. An improvement is desirable to overcome the disadvantage.

A color photograph generally contains cyan, magenta and yellow dye images. The magenta dye image was particularly investigated to stabilize the photograph, since the magenta dye was less stable than the other dyes. The stability of the magenta dye image has recently been so much improved as the results of the investigation that a fading or discoloration of the yellow or cyan dye image now becomes remarkable.

In order to improve the stability of the yellow dye image and the cyan dye image to light, heat or humidity, various compounds to be used in a photosensitive material have been proposed. For example, 2,2,6,6-tetraalkylpiperidine derivatives, the other piperidine derivatives and phenol derivatives are disclosed in British Patents No. 1,326,889, No. 1,354,313, No. 1,410,846, U.S. Pat. Nos. 3,336,135 and 4,268,593, Japanese Patent Publications No. 48(1973)-31256, No. 51(1976)-1420, No. 52(1977)-6623; and Japanese Patent Provisional Publications No. 58(1983)-114036, No. 59(1984)-5426, No. 59(1984)-124340, No. 60(1985)-222853, No. 60(1985)-222854, No. 62(1987)-262047, No. 63(1988)-113536 and No. 63(1988)-208844.

The present inventors also have proposed various 2,2,6,6-tetraalkylpiperidine derivatives and phenol derivatives in Japanese Patent Provisional Publications No. 61(1986)-2151, No. 61(1986)-4045, No. 61(1986)-6652, No. 61(1986)-167953, No. 62(1987)-115157, No. 63(1988)-9866 and No. 63(1988)-85547.

In order to improve the stability of the dyes to light or heat, the compounds disclosed in the above-mentioned publications have an effect on the dyes to some extent. However, the effect is relatively weak or is accompanied by a bad effect on the quality of the photograph. For example, a change of hue, an occurrence of fog, a precipitation in a coating layer and a change of the gradation of the photosensitive material are observed. Particularly, 2,2,6,6-tetraalkylpiperidines proposed in the above-mentioned publications and tertiary amines are only slightly soluble in a high boiling organic solvent, and they thus tend to degrade the quality of the photograph (e.g., gradation, sensitivity and color formation of the photograph). Further, even if the compounds disclosed in the above-mentioned publications have an effect on the cyan or magenta dye images to improve the stability of the dyes to light or heat, many of the compounds tend to increase an occurrence of a yellow stain on a white ground within the exposed ares when the photograph is irradiated with light or preserved at a high temperature and humidity.

On the other hand, various color image stabilizers have been proposed to improve the stability of the magenta dye image. Most of the color image stabilizers do not have any effect on the yellow and cyan dye images, and have the effect only on the magenta dye image. Moreover, many of the color image stabilizers adversely accelerate the fading of the yellow and cyan dye images.

SUMMARY OF THE INVENTION

An object of the present invention is to provide a silver halide color photosensitive material which is improved in the stability of the yellow dye image or the cyan dye image.

Another object of the invention is to provide a silver halide color photosensitive material in which the occurence of a yellow stain on a white ground within the exposed ares is much reduced.

A further object of the invention is to provide a silver halide color photosensitive material in which the cyan image and the yellow image are stabilized by incorporating into a photographic layer a stabilizer which is readily soluble in a high boiling organic solvent, and does not have a bad influence on the quality of the photograph.

A still further object of the invention is to provide a silver halide color photosensitive material which is improved in the color balance with respect to the fading of the yellow, magenta and cyan colors.

In the course of studies of the present inventors, it is found that the above-mentioned objects are attained by a silver halide color photosensitive material of the present invention, which comprises a support and a photographic layer, wherein the photographic layer contains a heterocyclic compound represented by the following formula [I], [II], [III], [IV], [V] or [VI]:

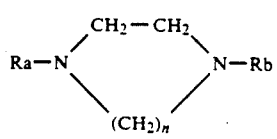

[I]

-continued

[II]

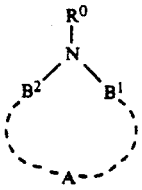

[III]

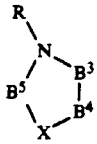

[IV]

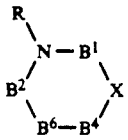

[V]

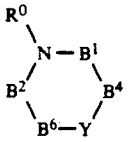

[VI]

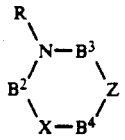

in which n is 1, 2 or 3; each of Ra and Rb independently is an acyl group, a sulfonyl group, a sulfinyl group, an alkoxycarbonyl group, an aryloxycarbonyl group, a phosphoryl group, a sulfamoyl group or a carbamoyl group; $B^1$ is $$\overset{R^1}{\overset{|}{C}}-R^2 \text{ or } C{=}O;\ B^2 \text{ is } \overset{R^3}{\overset{|}{C}}-R^4 \text{ or } C{=}O;\ B^3 \text{ is } \overset{R^5}{\overset{|}{C}}-R^6 \text{ or } C{=}O;$$

$$B^4 \text{ is } \overset{R^7}{\overset{|}{C}}-R^8 \text{ or } C{=}O;\ B^5 \text{ is } \overset{R^9}{\overset{|}{C}}-R^{10};\ B^6 \text{ is } \overset{R^{11}}{\overset{|}{C}}-R^{12} \text{ or } C{=}O;$$

R is hydrogen, an alkyl group, an alkenyl group, an acyl group, a sulfonyl group, a sulfinyl group, an alkoxycarbonyl group, an aryloxycarbonyl group, a phosphoryl group, a sulfamoyl group, a carbamoyl group or a heterocyclic group; $R^0$ is hydrogen, an alkenyl group, an acyl group, a sulfonyl group, a sulfinyl group, an alkoxycarbonyl group, an aryloxycarbonyl group, a phosphoryl group, a sulfamoyl group or a carbamoyl group; each of $R^1$, $R^2$, $R^3$, $R^4$, $R^5$, $R^6$, $R^7$, $R^8$, $R^9$, $R^{10}$, $R^{11}$ and $R^{12}$ independently is hydrogen, an alkyl group, an alkenyl group, an aryl group, a heterocyclic group, a halogen atom, an alkoxy group, an aryloxy group, a monovalent group composed of a heterocyclic group united with oxygen, an alkylthio group, an arylthio group, a monovalent group composed of a heterocyclic group united with sulfur, an amino group which may have one or more substituent groups, hydroxyl, an acyl group, cyano, nitro, sulfo, a sulfonyl group, a sulfinyl group, an alkoxycarbonyl group, an aryloxycarbonyl group, a carbamoyl group, a sulfamoyl group, formyl or carboxyl; A is an atomic group which forms, together with $-B^2-N-B^1-$, a 5- to 8-membered nitrogen-containing heterocyclic ring; each of X, Y and Z independently is —O—, —S—, $-SO_2-$, $$-\overset{R}{\overset{|}{N}}-;$$

any two of $R^1$, $R^2$, $R^3$, $R^4$, $R^5$, $R^6$, $R^7$, $R^8$, $R^9$, $R^{10}$, $R^{11}$ and $R^{12}$ may form a 5- to 8-membered ring other than benzene ring; $R^0$ in the formula [II] is neither phthaloyl, terephthaloyl nor isophthaloyl; each of $R^1$, $R^2$, $R^3$ and $R^4$ in the formula [II] does not represent an alkyl group at the same time; when A in the formula [II] forms piperidine ring, the piperidine ring does not include $$-\overset{O}{\overset{\|}{C}}-$$

as the constituent atom of the ring, no bridge is formed between the 3-position and the 5-position of the piperidine ring, and no spiro ring is formed at the 4-position of the piperidine ring provided that each of $R^1$ and $R^2$ is hydrogen; when each of $B^3$, $B^4$ and $B^5$ in the formula [III] is $-CH_2-$ and X is $$-\overset{R}{\overset{|}{N}}-,$$

R is hydrogen, an alkyl group, an alkenyl group or a heterocyclic group; when Y in the formula [V] is $-SO_2-$, each of $R^1$, $R^2$, $R^3$ and $R^4$ does not represent an alkyl group at the same time; when Y in the formula [V] is —O—, $B^4$ has the same meaning as for $B^5$; when each of $B^1$, $B^2$, $B^4$ and $B^6$ in the formula [V] is $-CH_2-$ *and Y is*

$$-\overset{R}{\overset{|}{N}}-,$$

R is hydrogen, an alkyl group, an alkenyl group and a heterocyclic group, when each of X and Z in the formula [VI] independently is $$-\overset{R}{\overset{|}{N}}-,$$

each of $B^2$, $B^3$ and $B^4$ does not represent C=O at the same time; and when each of $B^2$, $B^3$ and $B^4$ in the formula [VI] is $-CH_2-$ and Z is $$-\overset{R}{\overset{|}{N}}-,$$

X is —S—, $-SO_2-$, —SO— or $$-\overset{R}{\overset{|}{N}}-.$$

The present inventors have found that the effect of the present invention is increased when the heterocyclic compound represented by the formula [I], [II], [III], [IV], [V] or [VI] is contained in droplets of lipophilic medium having a mean particle size in the range of 0.07

μm to 3.0 μm which are dispersed in the photographic layer.

With respect to the heterocyclic compound represented the formula [I], [II], [III], [IV], [V] or [VI], it is preferred that each of Ra, Rb, R, $R^0$, $R^1$, $R^2$, $R^3$, $R^4$, $R^5$, $R^6$, $R^7$, $R^8$, $R^9$, $R^{10}$, $R^{11}$ and $R^{12}$ independently contains not more than 40 carbon atoms, and the number of the total carbon atoms contained in $R^5$ and $R^6$ is not less than 8 (more preferably in the range of 8 to 50).

DETAILED DESCRIPTION OF THE INVENTION

The heterocyclic compound having the following formula [I], [II], [III], [IV], [V] or [VI] is hereinafter described in more detail.

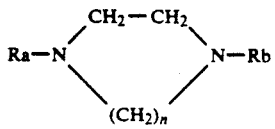
[I]

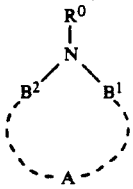
[II]

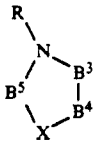
[III]

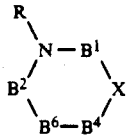
[IV]

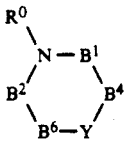
[V]

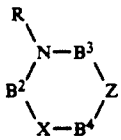
[VI]

In the present specification, an alkyl group (or alkyl moiety) may be a straight chain, a branched chain or a cyclic chain, and may have one or more substituent groups. The definition of an alkenyl group in the present specification is analogous to the above-mentioned definition of the alkyl group. Examples of an aryl group (or aryl moiety) include phenyl, naphthyl and derivatives thereof.

In the formula [I], n is 1, 2 or 3. Each of Ra and Rb independently is an acyl group (e.g., acetyl, benzoyl, and 4-chlorobenzoyl), a sulfonyl group (e.g., methanesulfonyl, decanesulfonyl, benzenesulfonyl and toluenesulfonyl), a sulfinyl group to which an alkyl group or an aryl group may be attached (e.g., methanesulfinyl, benzenesulfinyl and 2-butoxy-5-t-octylphenylsulfinyl), an alkoxycarbonyl group (e.g., methoxycarbonyl, butoxycarbonyl, 2-ethylhexyloxycarbonyl and hexadecyloxycarbonyl), an aryloxycarbonyl group (e.g., phenoxycarbonyl and 2-naphthyloxycarbonyl), a phosphoryl group (e.g., butyloctylphosphoryl, dioctyloxyphosphoryl, diphenyloxyphosphoryl and octyloxyphenylphosphoryl), a sulfamoyl group which may be N-substituted with an alkyl group or an aryl group (e.g., N-butylsulfamoyl, N,N-diethylsulfamoyl and N-phenylsulfamoyl), and a carbamoyl group which may be N-substituted with an alkyl group or an aryl group (e.g., N-methylcarbamoyl, N-octadecylcarbamoyl, N-phenylcarbamoyl and N,N-dibutylcarbamoyl).

In the formulas [II], [III], [IV], [V] and [VI], $B^1$ is

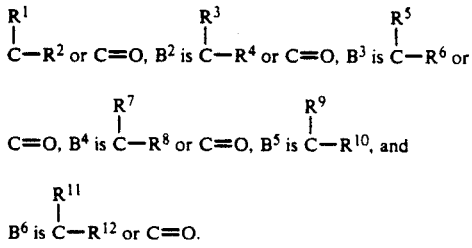

In the formulas [III], [IV] and [VI], R is hydrogen, alkyl group (e.g., methyl, ethyl, butyl, 2-ethylhexyl, octyl, t-octyl, benzyl, cyclopentyl and octadecyl), an alkenyl group (e.g., vinyl and allyl), an acyl group (e.g., acetyl, benzoyl, and 4-chlorobenzoyl), a sulfonyl group (e.g., methanesulfonyl, decanesulfonyl, benzenesulfonyl and toluenesulfonyl), a sulfinyl group to which an alkyl group or an aryl group may be attached (e.g., methanesulfinyl, benzenesulfinyl and 2-butoxy-5-t-octylphenylsulfinyl), an alkoxycarbonyl group (e.g., methoxycarbonyl, butoxycarbonyl, 2-ethylhexyloxycarbonyl and hexadecyloxycarbonyl), an aryloxycarbonyl group (e.g., phenoxycarbonyl and 2-naphthyloxycarbonyl), a phosphoryl group (e.g., butyloctylphosphoryl, dioctyloxyphosphoryl, diphenyloxyphosphoryl and octyloxyphenylphosphoryl, a sulfamoyl group which may be N-substituted with an alkyl group or an aryl group (e.g., N-butylsulfamoyl, N,N-diethylsulfamoyl and N-phenylsulfamoyl), a carbamoyl group which may be N-substituted with an alkyl group or an aryl group (e.g., N-methylcarbamoyl, N-octadecylcarbamoyl, N-phenylcarbamoyl and N,N-dibutylcarbamoyl) or a heterocyclic group which preferably is a 5- to 8-membered ring consisting of atoms selected from carbon, oxygen, sulfur and nitrogen (e.g., 2-pyridyl, 2-furyl, morpholinyl and 2-chromanyl).

In the formulas [III] and [IV], R is hydrogen, an alkenyl group (e.g., vinyl and allyl), an acyl group (e.g., acety, benzoyl, and 4-chlorobenzoyl), a sulfonyl group (e.g., methanesulfonyl, decanesulfonyl, benzenesulfonyl and toluenesulfonyl), a sulfinyl group to which an alkyl group or an aryl group may be attached (e.g., methanesulfinyl, benzenesulfinyl and 2-butoxy-5-t-octylphenylsulfinyl), an alkoxycarbonyl group (e.g., methoxycarbonyl, butoxycarbonyl, 2-ethylhexyloxycarbonyl and hexadecyloxycarbonyl), an aryloxycarbonyl group (e.g., phenoxycarbonyl and 2-naphthyloxycarbonyl), a phosphoryl group (e.g., butyloctylphosphoryl, dioctyloxyphosphoryl, diphenyloxyphosphoryl and octyloxyphenylphosphoryl), a sulfamoyl group which may be N-substituted with an alkyl group or an aryl group (e.g., N-butylsulfamoyl, N,N-diethylsulfamoyl and N-phenylsulfamoyl) or a carbamoyl group which may be N-substituted with an alkyl group or an aryl group (e.g., N-methylcarbamoyl, N-octadecylcarbamoyl, N-phenylcarbamoyl and N,N-dibutylcarbamoyl).

In the formulas [II], [III], [IV], [Vπ and [VI], each of $R^1$, $R^2$, $R^3$, $R^4$, $R^5$, $R^6$, $R^7$, $R^8$, $R^9$, $R^{10}$, $R^{11}$ and $R^{12}$ independently is hydrogen, an alkyl group (e.g., methyl, ethyl, butyl, 2-ethylhexyl, octyl, t-octyl, benzyl, cyclopentyl and octadecyl), an alkenyl group (e.g., vinyl and allyl), an aryl group (e.g., phenyl and naphthyl), a heterocyclic group which preferably is a 5- to 8-membered ring consisting of atoms selected from carbon, oxygen, sulfur and nitrogen (e.g., 2-pyridyl, 2-furyl, morpholinyl and 2-chromanyl), a halogen atom, an alkoxy group (e.g., methoxy, butoxy, 2-ethylhexyloxy, hexadecyloxy), an aryloxy group (phenoxy and 2-naphthyloxy), a monovalent group composed of a heterocyclic group united with oxygen (e.g., 2-pyridyloxy, 2-furyloxy, morpholinyloxy and 2-chromanyloxy), an alkylthio group (e.g., methylthio, butylthio, 2-ethylhexylthio, hexadecylthio), an arylthio group (phenylthio and 2-naphthylthio), a monovalent group composed of a heterocyclic group united with sulfur (e.g., 2-pyridylthio, 2-furylthio, morpholinylthio and 2-chromanylthio), an amino group which may have one or more substituent groups, hydroxyl, an acyl group (e.g., acetyl, benzoyl, and 4-chlorobenzoyl), cyano, nitro, sulfo, a sulfonyl group (e.g., methanesulfonyl, decanesulfonyl, benzenesulfonyl and toluenesulfonyl), a sulfinyl group (e.g., methanesulfinyl, benzenesulfinyl and 2-butoxy-5-t-octylphenylsulfinyl), an alkoxycarbonyl group (e.g., methoxycarbonyl, butoxycarbonyl, 2-ethylhexyloxycarbonyl and hexadecyloxycarbonyl), an aryloxycarbonyl group (e.g., phenoxycarbonyl and 2-naphthyloxycarbonyl), a carbamoyl group (e.g., N-methylcarbamoyl, N-octadecylcarbamoyl, N-phenylcarbamoyl and N,N-dibutylcarbamoyl), a sulfamoyl group (e.g., N-butylsul-famoyl, N,N-diethylsulfamoyl and N-phenylsulfamoyl), formyl or carboxyl.

In the formula [II], A is an atomic group which forms, together with $-B^{2}-\overset{N}{}-\overset{B1}{}$, a 5- to 8-membered nitrogen-containing heterocyclic ring. The atomic group represented by A consists of only carbon atoms as the member atoms of the heterocyclic ring. The heterocyclic ring may be either saturated or unsaturated. The heterocyclic ring may have one or more substituent groups, for example, the groups represented by $R^1$, $R^2$, $R^3$, $R^4$, $R^5$, $R^6$, $R^7$, $R^8$, $R^9$, $R^{10}$, $R^{11}$ and $R^{12}$.

In the formulas [III], [IV], [V] and [VI], each of X, Y and Z independently is —O—, —S—, $-SO_2-$, $$-\overset{R}{\overset{|}{N}}-.$$

In the formulas [II], [III], [IV], [V] and [VI], any two of $R^1$, $R^2$, $R^3$, $R^4$, $R^5$, $R^6$, $R^7$, $R^8$, $R^9$, $R^{10}$, $R^{11}$ and $R^{12}$ may form a 5- to 8-membered ring other than benzene ring.

In the formula [II], $R^0$ is neither phthaloyl, terephthaloyl nor isophthaloyl. Each of $R^1$, $R^2$, $R^3$ and $R^4$ in the formula [II] does not represent an alkyl group at the same time. When A in the formula [II] forms piperidine ring, the piperidine ring does not include $$-\overset{O}{\overset{\|}{C}}-$$

as the constituent atom of the ring, no bridge is formed between the 3-position and the 5-position of the piperidine ring, and no spiro ring is formed at the 4-position of the piperidine ring provided that each of $R^1$ and $R^2$ is hydrogen.

When each of $B^3$, $B^4$ and $B^5$ in the formula [III] is $-CH_2-$ and X is $$-\overset{R}{\overset{|}{N}}-,$$

R is hydrogen, an alkyl group, an alkenyl group or a heterocyclic group.

When Y in the formula [V] is $-SO_2-$, each of $R^1$, $R^2$, $R^3$ and $R^4$ does not represents an alkyl group. When Y in the formula [V] is —O—, $B^4$ has the same meaning as for $B^5$. When each of $B^1$, $B^2$, $B^4$ and $B^6$ in the formula [V] is $-CH_2-$ and Y is $$-\overset{R}{\overset{|}{N}}-,$$

R is hydrogen, an alkyl group, an alkenyl group or a heterocyclic group. When each of X and Z in the formula [VI] independently is $$-\overset{R}{\overset{|}{N}}-.$$

each of $B^2$, $B^3$ and $B^4$ is not C=O. When each of $B^2$, $B^3$ and $B^4$ in the formula [VI] is $-CH_2-$ and Z is $$-\overset{R}{\overset{|}{N}}-,$$

X is —S—, $-SO_2-$, —SO— or $$-\overset{R}{\overset{|}{N}}-.$$

The heterocyclic compound represented by the formula [I] preferably has the following formula [I-A]:

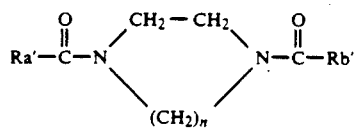

[I-A]

in which n is 1, 2 or 3; and each of Ra' and Rb' independently is an alkyl group, an alkenyl group, an aryl group, a heterocyclic group, an alkoxy group, an alkenyloxy group, an aryloxy group, a monovalent group composed of a heterocyclic group united with oxygen, or an amino group which may have one or more substituent groups.

In the formula [I-A], it is more preferred that each of Ra' and Rb' independently is an alkyl group, an alkenyl group, an aryl group, an alkoxy group, an alkenyloxy group or an aryloxy group. It is more preferred that each of Ra' and Rb' independently is an alkyl group, an alkenyl group or an aryl group. In the formula [I-A], n is preferably is 2.

With respect to the compound represented by the formula [II], [III], [IV], [V] or [VI], it is preferred that each of R and $R^0$ independently is an acyl group, a sulfonyl group, a sulfinyl group, an alkoxycarbonyl group, an aryloxycarbonyl group, a phosphoryl group, a sulfamoyl group or a carbamoyl group. It is also preferred that each of X, Y and Z independently is

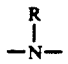

and R is an acyl group, a sulfonyl group, a sulfinyl group, an alkoxycarbonyl group, an aryloxycarbonyl group, a phosphoryl group, a sulfamoyl group or a carbamoyl group. It is further preferred that at least one of $R^1$, $R^2$, $R^3$, $R^4$, $R^5$, $R^6$, $R^7$, $R^8$, $R^9$, $R^{10}$, $R^{11}$ and $R^{12}$ is an amino group which may have one or more substituent groups, a carbamoyl group or a sulfamoyl group.

The compound represented by the formula [II] or [V] is preferred.

Examples of the compound having the formula [I], [II], [III], [IV], [V] or [VI] are described hereinafter without limiting the invention.

(A-1)

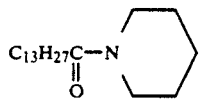

(A-2)

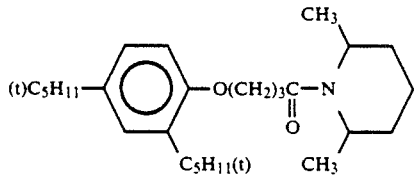

(A-3)

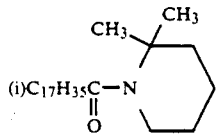

(A-4)

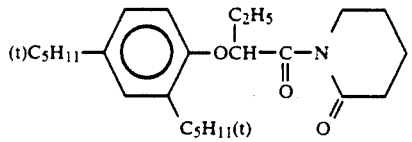

(A-5)

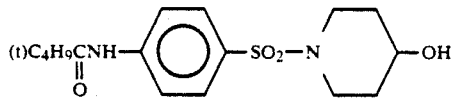

(A-6)

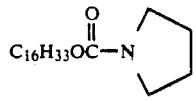

(A-7)

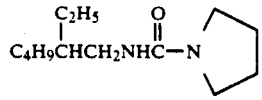

(A-8)

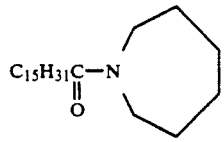

(A-9)

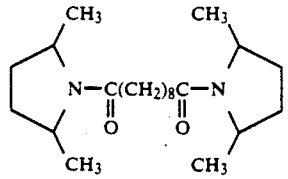

-continued
(A-10)
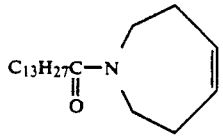
(A-11)
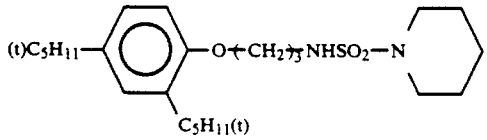
(A-12)
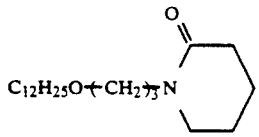
(A-13)
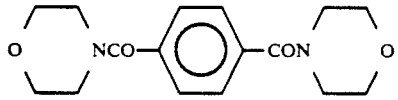
(A-14)
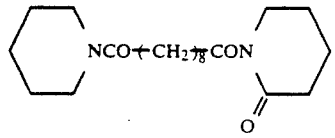
(A-15)
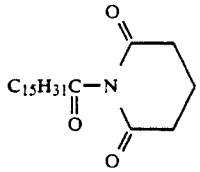
(A-16)
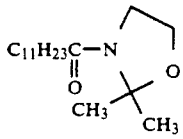
(A-17)
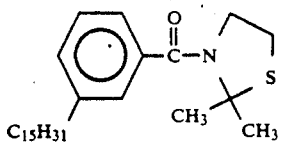
(A-18)
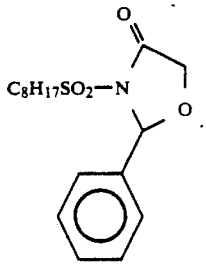
(A-19)
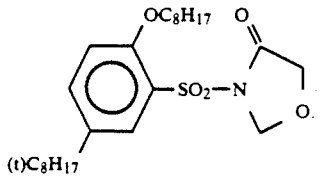

-continued
(A-20)
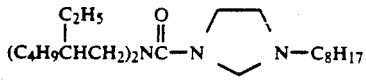
(A-21)
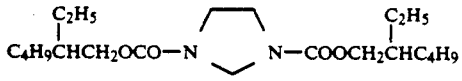
(A-22)
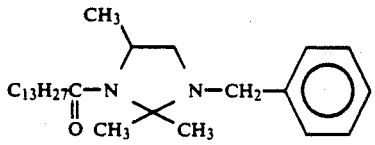
(A-23)
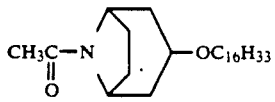
(A-24)
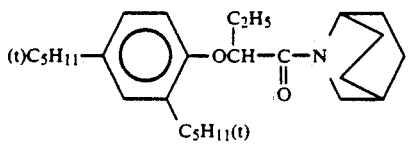
(A-25)
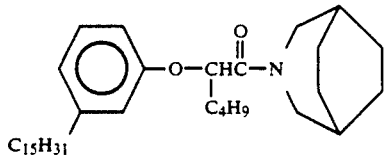
(A-26)
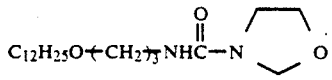
(A-27)
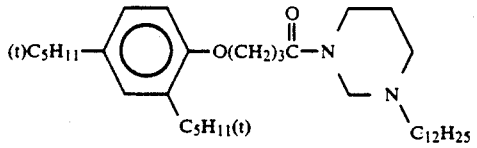
(A-28)
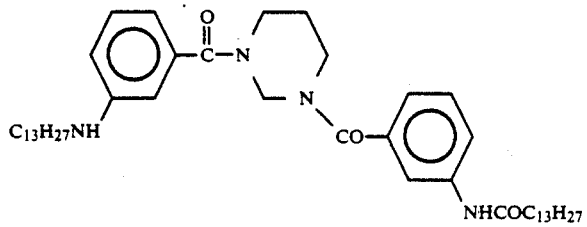
(A-29)
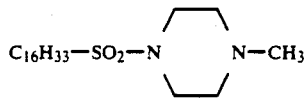
(A-30)
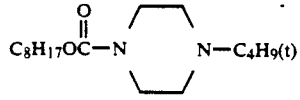

-continued
(A-31)
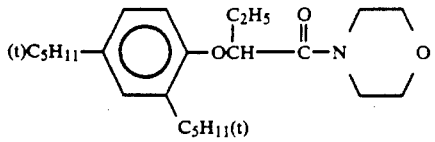
(A-32)
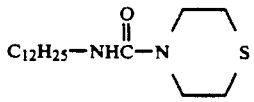
(A-33)
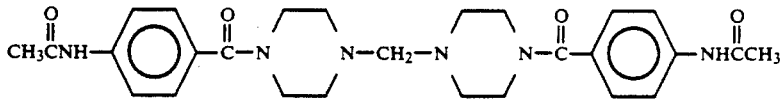
(A-34)
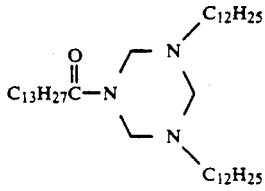
(A-35)
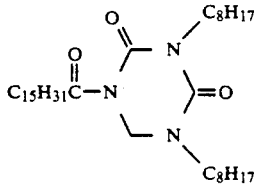
(A-36)
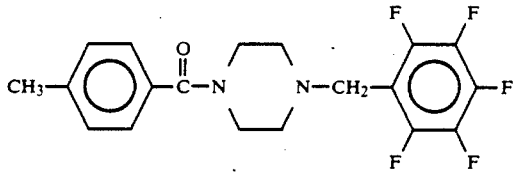
(A-37)
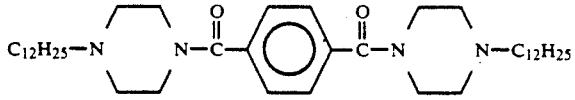
(A-38)
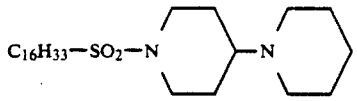
(A-39)
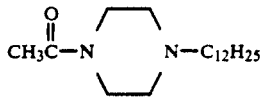
(A-40)
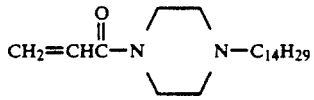
(A-41)
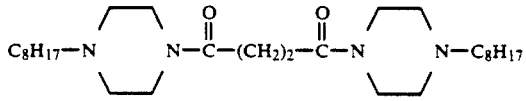
(A-42)
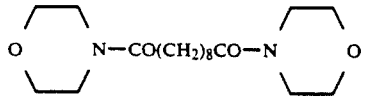

-continued
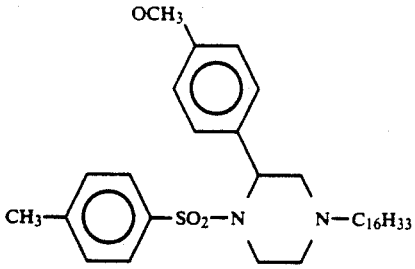
(A-43)
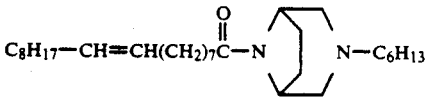
(A-44)
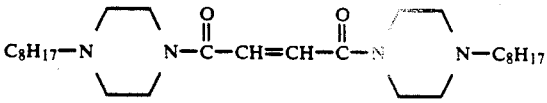
(A-45)
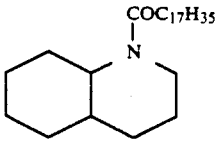
(A-46)
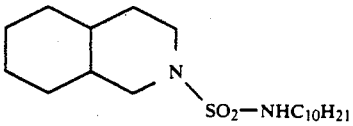
(A-47)
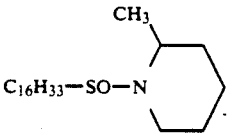
(A-48)
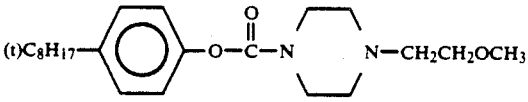
(A-49)
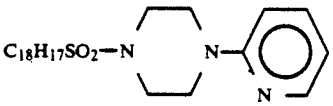
(A-50)
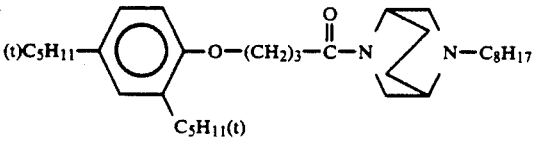
(A-51)
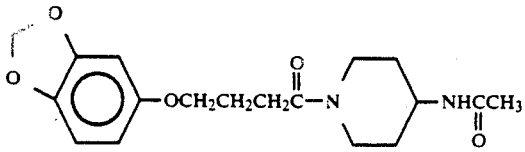
(A-52)
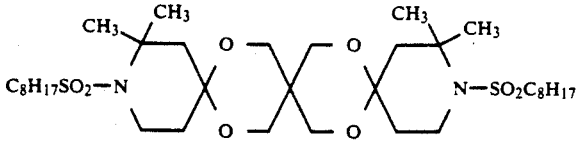
(A-53)

-continued
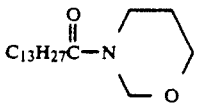
(A-54)
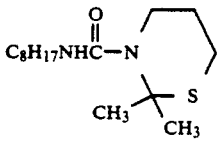
(A-55)
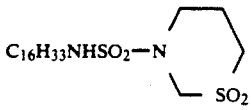
(A-56)
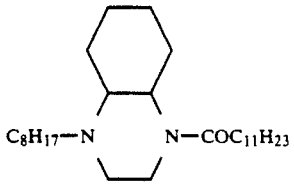
(A-57)
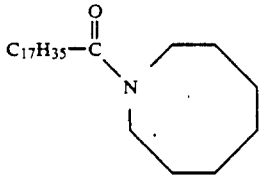
(A-58)
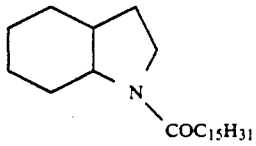
(A-59)
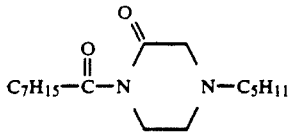
(A-60)
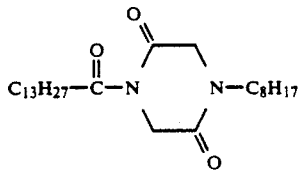
(A-61)
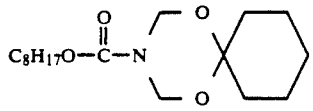
(A-62)
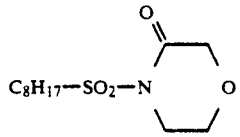
(A-63)

-continued
(A-64)
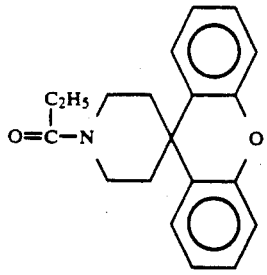
(A-65)
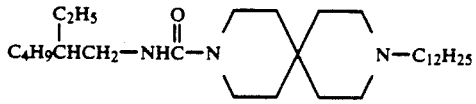
(A-66)
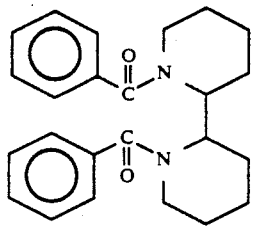
(A-67)
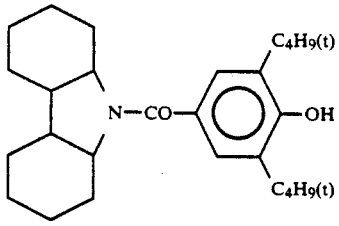
(A-68)
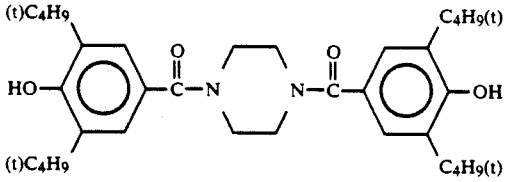
(A-69)
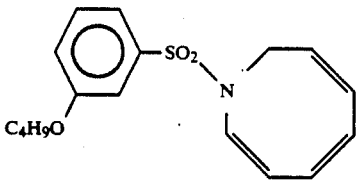
(A-70)
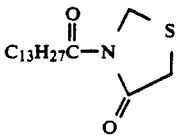
(A-71)
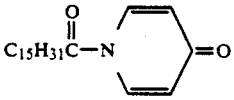
(A-72)
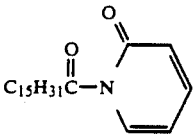

-continued
(A-73)
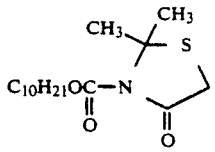
(A-74)
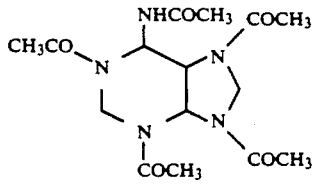
(A-75)
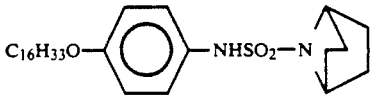
(A-76)
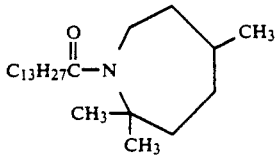
(A-77)
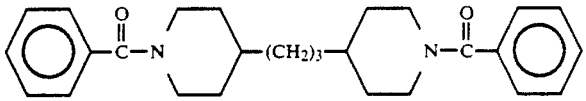
(A-78)
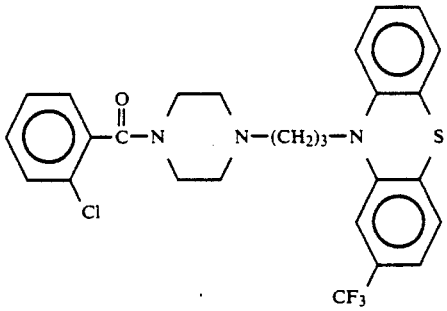
(A-79)
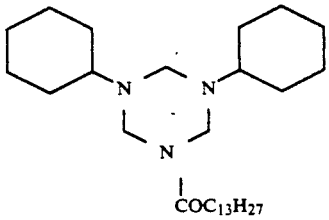
(A-80)
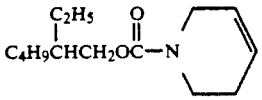
(A-81)
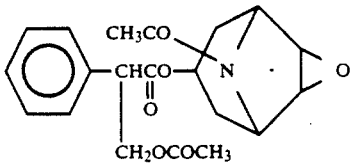

-continued
(A-82)
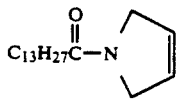
(A-83)
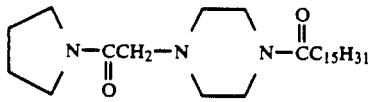
(A-84)
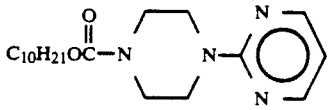
(A-85)
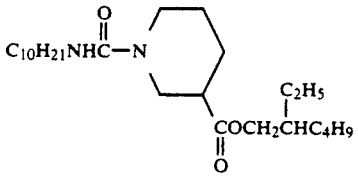
(A-86)
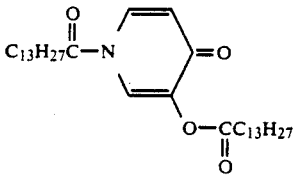
(A-87)
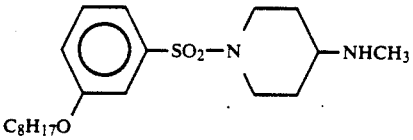
(A-88)
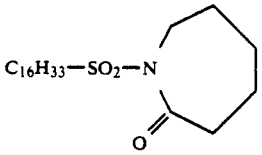
(A-89)
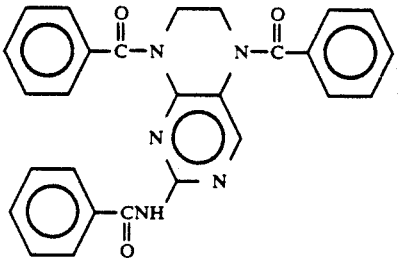
(A-90)
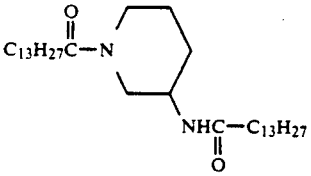

-continued
(A-91)
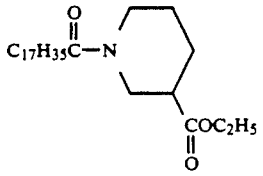
(A-92)
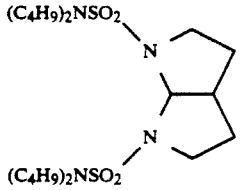
(A-93)
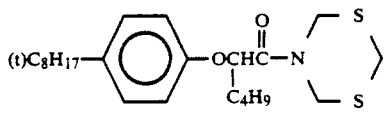
(A-94)
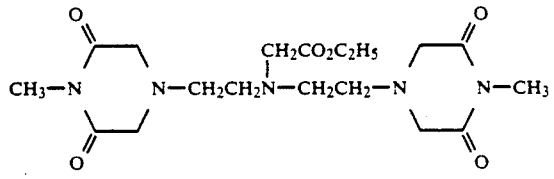
(A-95)
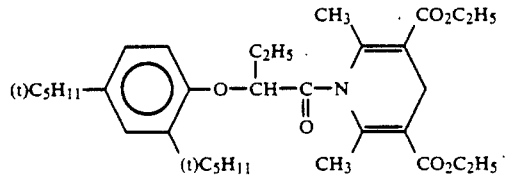
(A-96)
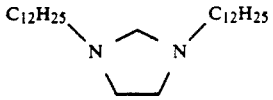
(A-97)
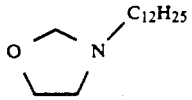
(A-98)
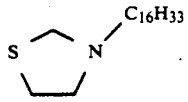
(A-99)
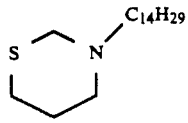
(A-100)
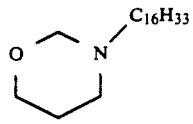
(A-101)
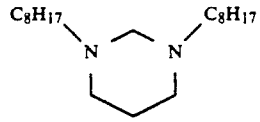

-continued
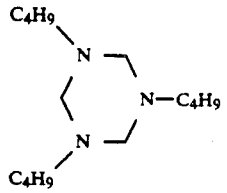
(A-102)
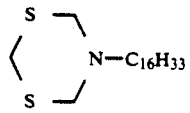
(A-103)
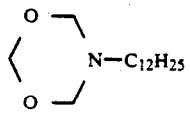
(A-104)
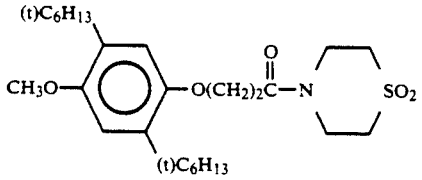
(A-105)
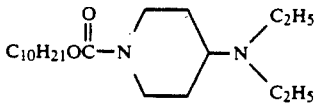
(A-106)
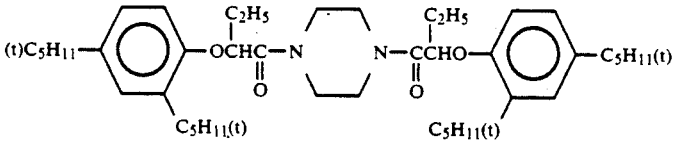
(A-107)
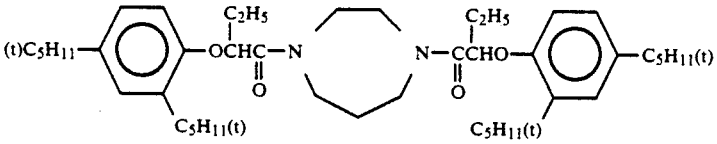
(A-108)
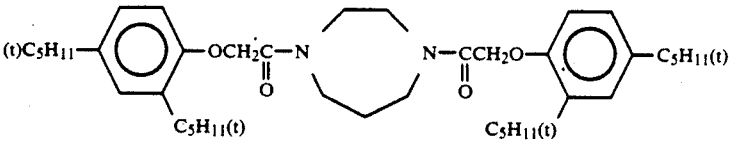
(A-109)
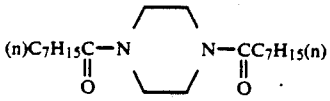
(A-110)
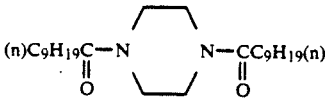
(A-111)
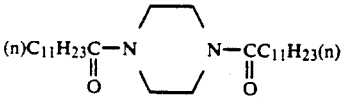
(A-112)

-continued
(A-113)
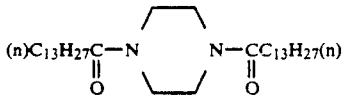
(A-114)
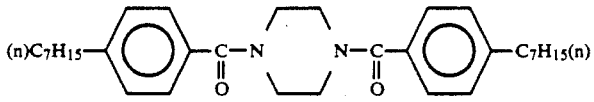
(A-115)
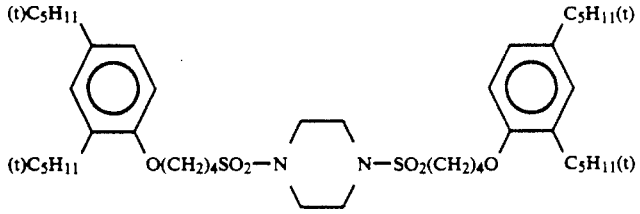
(A-116)
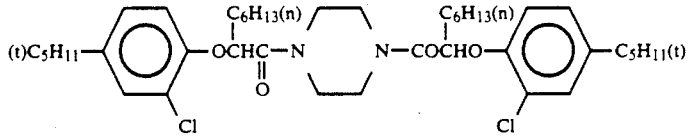
(A-117)
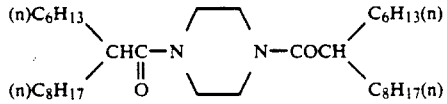
(A-118)
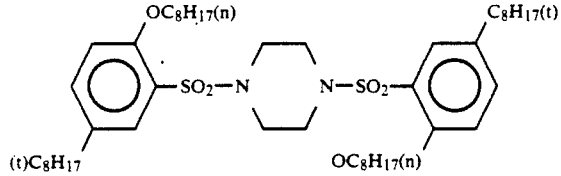
(A-119)
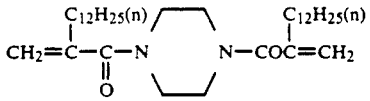
(A-120)
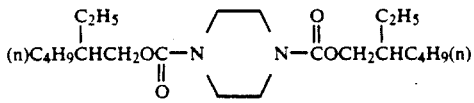
(A-121)
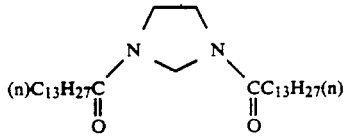
(A-122)
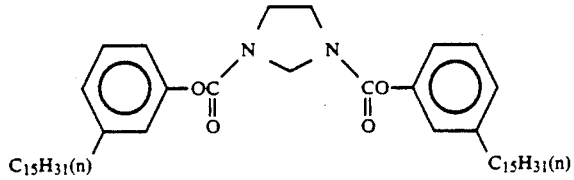
(A-123)
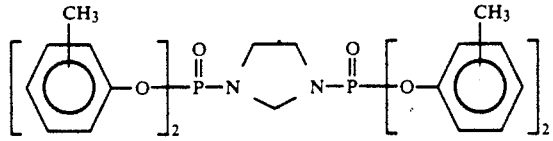

-continued
(A-124)
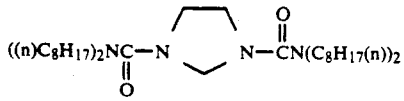
(A-125)
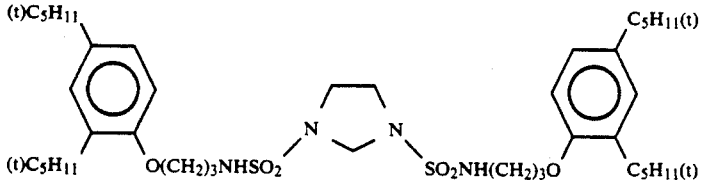
(A-126)
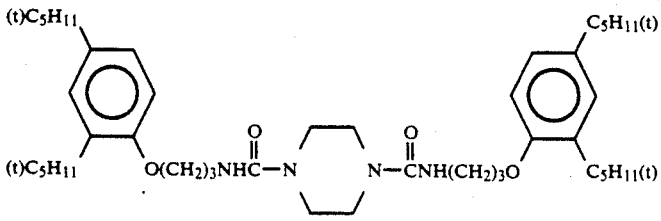
(A-127)
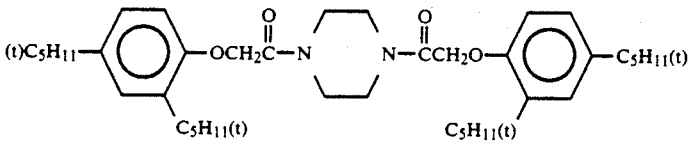
(A-128)
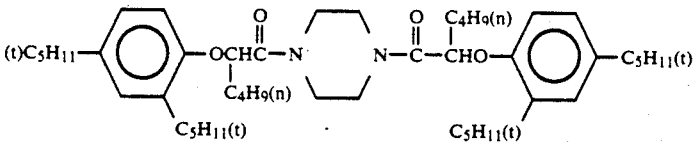
(A-129)
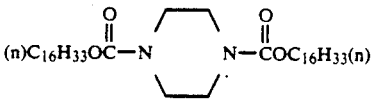
(A-130)
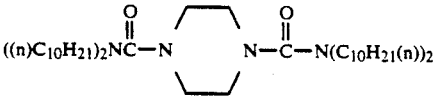
(A-131)
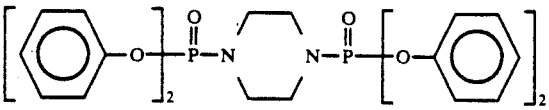
(A-132)
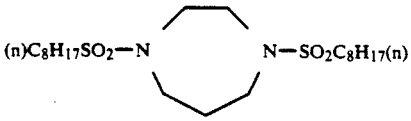
(A-133)
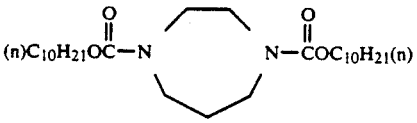
(A-134)
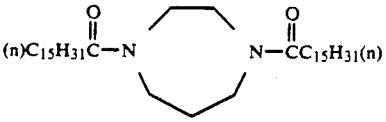

-continued
(A-135)
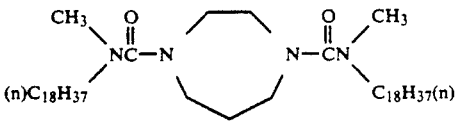
(A-136)
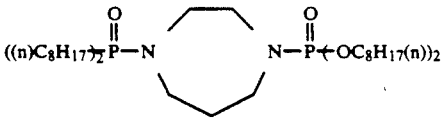
(A-137)
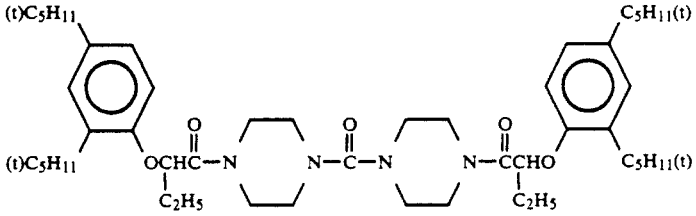
(A-138)
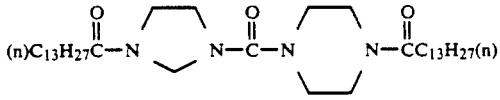
(A-139)
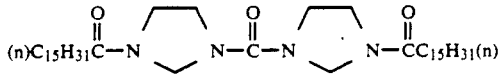
(A-140)
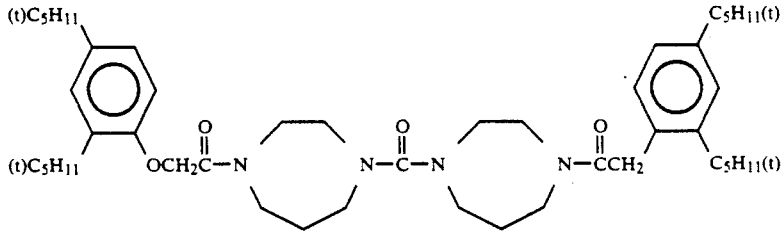
(A-141)
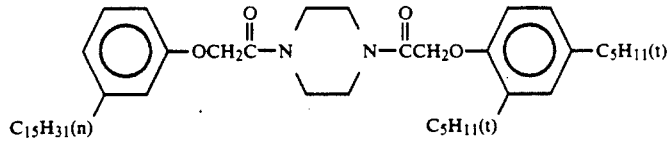
(A-142)
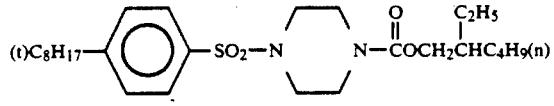
(A-143)
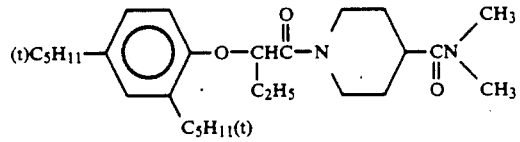
(A-144)
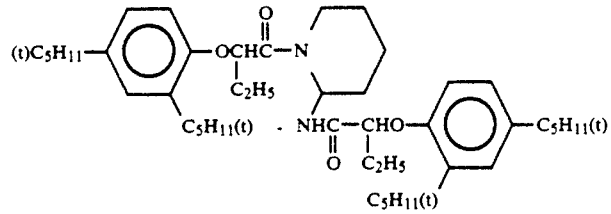

-continued (A-145)

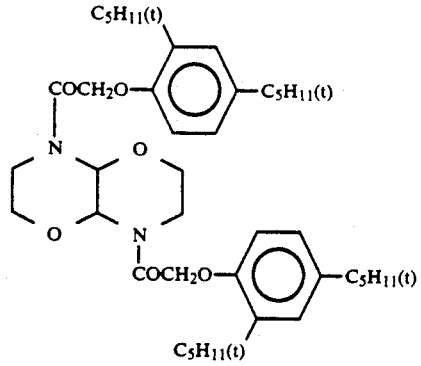

(A-146)

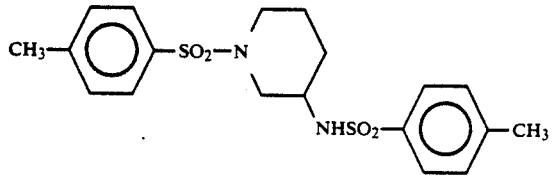

(A-147)

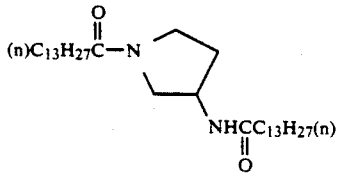

(A-148)

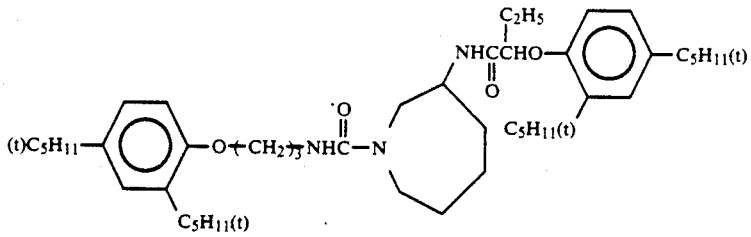

(A-149)

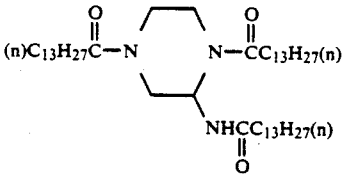

(A-150)

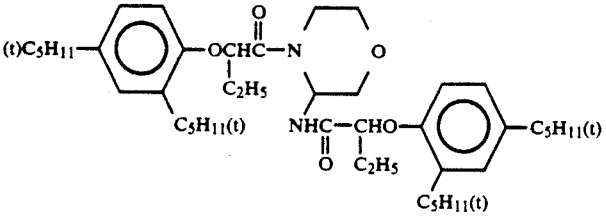

The heterocyclic compound having the formula [I , [II], [III], [IV], [V] or [VI] can be synthesized by an acylation or a sulfonylation of a cyclic amine. Methods of synthesis of the cyclic amine are described in Japanese Patent Provisional Publications No. 61(1986)-73152, No. 61(1986)-72246, No. 61(1986)-189539, No. 62(1987)-24255, No. 62(1987-278550, No. 62(1987)-297847, No. 62(1987)-297848 and 63(1988)-43145.

The amount of the heterocyclic compound having the formula [I], ]II], [III], [IV], [V] or [VI] is in the range of $1\times10^{-2}$ to 10 mole based on 1 mole of the coupler, preferably in the range of $1\times10^{-1}$ to 5 mole, and more preferably in the range of $1\times10^{-1}$ to 1 mole. The compound having the formula [I], [II], [III], [IV], [V] or [VI] can also be used as a high boiling solvent for couplers.

In preparation of the photosensitive material of the present invention, the above-mentioned compound having the formula [I], [II], [III], [IV], [V] or [VI] is dissolved in a solvent, and the obtained solution is emulsified in a hydrophilic colloidal aqueous solution such as gelatin solution. The solvent may be a high boiling solvent (oil) having a boiling point of not lower than 170 ° C. (at atmospheric pressure), a low boiling solvent or a mixture thereof. The mean size of the oily droplets of the solution in the emulsion is preferably adjusted in the range of 0.07 to 3.0 μm.

The high boiling solvent preferably is a compound having the following formula [A], [B], [C], [D] or [E].

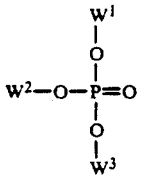

[A]

$W^1-COO-W^2$ [B]

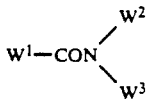

[C]

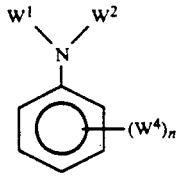

[D]

$W^1-O-W^2$ [E]

in which each of $W^1$, $W^2$ and $W^3$ independently is an alkyl group, a cycloalkyl group, an alkenyl group, a aryl group or a heterocyclic group, each of which may have one or more substituent groups; $W^4$ is $-W^1$, $-O-W^1$ or $-S-W^1$; n is 1, 2, 3, 4 or 5; when n is two or more, the groups represented by $W^4$ may be different from each other; and $W^1$ and $W^2$ in the formula (E) may form a ring.

The other examples of the high boiling solvent (oil) include alkyl phthalates (e.g., dibutyl phthalate, dioctyl phthalate, diisodecyl phthalate and dimethoxyethyl phthalate), phosphates (e.g., diphenyl phosphate, triphenyl phosphate, tricresidyl phosphate, dioctyl butyl phosphate and monophenyl-p-t-butylphenyl phosphate), citrates (e.g., tributyl acetylcitrate), benzoates (e.g., octyl benzoate), alkylamides (e.g., diethyl laurylamide and dibutyl lauryl amide), esters of fatty acids (e.g., dibutoxyethyl succinate, diethyl azelate and dioctyl cebacate), trimesates (e.g., tributyl trimesate), compounds having an epoxy ring (e.g., compounds described in U.S. Pat. No. 4,540,657), phenols (e.g.,

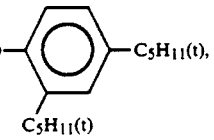

-continued

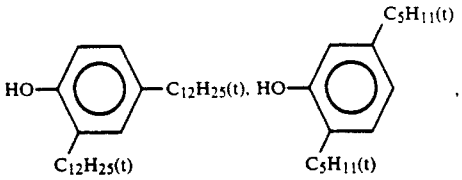

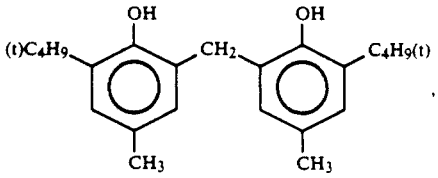

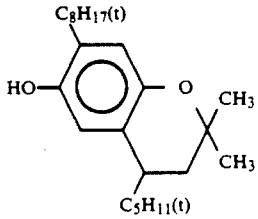

and

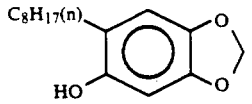

), ethers (e.g., phenoxyethanol and monophenylether of diethylene glycol).

The low boiling solvent (which is preferably used as an assistant solvent) preferably has a boiling point in the range of 30° to 150° C. (at atmospheric pressure). Examples of the low boiling solvent include lower alkyl acetates (e.g., ethyl acetate, isopropyl acetate and butyl acetate), ethyl propionate, methanol, ethanol, secondary butyl alcohol, cyclohexanol, fluoroalcohol, methyl isobutyl ketone, β-ethoxyethyl acetate, methyl cellosolve acetate acetone, methylacetone, acetonitrile, dioxane, dimethylformamide, dimethylsulfoxide, chloroform and cyclohexane.

In place of the high boiling organic solvent, the other oily solvents (which include solid oils at room temperature such as waxes) of additives and latex polymers may be as solvent. Further, the additives such as a coupler, color stain inhibitors and ultraviolet absorbents themselves may be the oily solvent.

Examples of the latex polymer are homopolymers and copolymers composed of various monomers, such as acrylic acid, methacrylic acid and esters thereof (e.g., methyl acrylate, ethyl acrylate and butyl acrylate), acrylamide, t-butylacrylamide, methacrylamide, vinyl esters (e.g., vinyl acetate and vinyl propionate), acrylonitrile, styrene, divinylbenzene, vinylalkyl ethers (vinyl ethyl ether), maleates (e.g., methyl maleate), N-vinyl-2-pyrrolidone), N-vinylpyridine and 2- or 4-vinylpyridine.

When the solution of the compound having the formula [I], [II], [III], [IV], [V] or [VI] (in which a coupler also may be dissolved) is emulsified in a hydrophilic protective colloidal aqueous solution, various surface active agent, such as saponin, sodium alkylsulfosuccinates and sodium alkylbenzenesulfonates can be employed.

Preferred surface active agent is an anionic surface active agent, for example the compounds having the following formula.

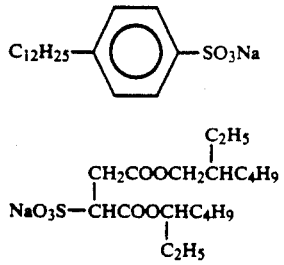

The mean size of the oily droplets of the high boiling organic solvent containing the compound having the formula [I], [II], [III], [IV], [V] or [VI] can be adjusted by selecting the kind or amount of the surface active agent, the high boiling organic solvent or an assistant solvent, or by selecting the kind of the emulsifying apparatus. The mean droplet size can be measured by a dynamic light scattering method. An example of the apparatus for measuring the mean size is Nanosizer produced by British Colter Co.

The compounds having the formula [I], [II], [III], [IV], [V] or [VI] can be used singly or in combination of two or more compounds.

The compound having the formula [I], [II], [III], [IV], [V] or [VI] is preferably dissolved in the oily droplets of the high boiling organic solvent which are dispersed in a photographic layer. It is more preferred that couplers such as yellow coupler and cyan coupler are contained in the droplets together with the compound of the present invention. The weight ratio of the oil (organic solvent) to the coupler preferably is not more than 2.0.

There is no specific limitation with respect to the yellow coupler contained in the silver halide color photosensitive material of the present invention. The preferred yellow coupler is a compound having the following formula [Y-I].

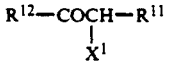

[Y-I]

in which $R^1$ is N-phenylcarbamoyl, which may have one or more substituent groups; $R^{12}$ is an alkyl group containing 1–20 carbon atoms or phenyl, each of which may have one or more substituent groups; $X^1$ is hydrogen or a group which may be eliminated in the coupling reaction with an oxidation product of a developing agent; and two or more compounds having the formula [Y-I] may be combined with each other at the position of $R^{11}$, $R^{12}$ or $X^1$ to form a polymer.

The compound having the formula [Y-I] is hereinafter described in more detail.

The substituent groups of $R^{11}$ (i.e., N-phenylcarbamoyl) are the known substituent groups of a yellow coupler, such as an alkyl group, an alkenyl group, an alkoxy group, an alkoxycarbonyl group, a halogen atom, an alkoxycarbonyl group, an aliphatic amido group, an alkylsulfamoyl group, an alkylsulfonamido group, an alkylureido group, an alkylsuccinimido group, an aryloxy group, an aryloxycarbonyl group, an arylcarbamoyl group, an arylamido group, an arylsulfamoyl group, an arylsulfonamido group, an arylureido group, carboxyl, sulfo, nitro, cyano, thiocyano and $-SO_2NHCO-R^{31}$, wherein $R^{31}$ is an alkyl group. $R^{11}$ may have two or more substituent groups, which may be different from each other.

Examples of the alkyl group (including the substituted alkyl group) containing 1–20 carbon atoms represented by $R^{12}$ include methyl, t-butyl, t-amyl, t-octyl, 1,1-diethylpropyl, 1,1-dimethylhexyl, 1,1,5,5-tetramethylhexyl, 1-methylcyclohexyl and adamantyl. Examples of the substituent groups of phenyl represented by $R^{12}$ are the same as the examples of the substituent groups of $R^{11}$.

It is preferred that $X^1$ is an elimination coupling group which forms a two equivalent yellow coupler rather than hydrogen. Examples of the elimination coupling group are shown in the following formulas [Y-II], [Y-III], [Y-IV] and [Y-V].

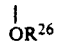

[Y-II]

in which $R^{26}$ is an aryl group or a heterocyclic group, each of which may have one or more substituent groups.

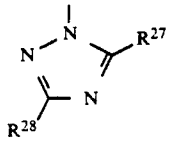

[Y-III]

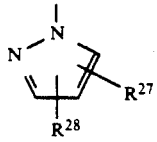

[Y-IV]

in which each of $R^{27}$ and $R^{28}$ independently is hydrogen, a halogen atom, an acyloxy group, amino, an alkyl group, an alkylthio group, an alkoxy group, an alkylsulfonyl group, an alkylsulfinyl group, carboxyl, sulfo, phenyl which may have one or more substituent groups or a heterocyclic group; an aliphatic group, an aromatic group or a heterocyclic group; and $R^{27}$ and $R^{28}$ may be different from each other.

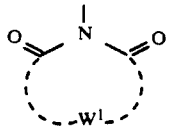

[Y-V]

in which $W^1$ is a non-metallic atomic group which forms, together with

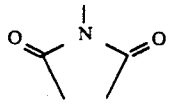

in the formula, a 4-, 5- or 6-membered heterocyclic ring.

The more preferred yellow coupler used in the present invention has the following formula [Y-VI].

[Y-VI]

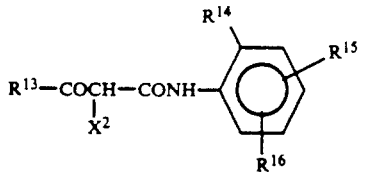

in which $R^{13}$ is an tertiary alkyl group containing 4–12 carbon atoms, phenyl or a phenyl group substituted with a halogen atom, an alkyl group or an alkoxy group; $R^{14}$ is a halogen atom or a alkoxy group; $R^{15}$ is hydrogen, a halogen atom or an alkoxy group which may have one or more substituent groups; and $R^{16}$ is an acylamino group, an alkoxycarbonyl group, an alkylsulfamoyl group, an arylsulfamoyl group, a alkylsulfonamido group, an arylsulfonamido group, an alkylureido group, a succinimido group, an alkoxy group or an aryloxy group, each of which may have one ore more substituent groups; and $X^2$ is a group having the following formula [Y-VII], [Y-VIII], [Y-IX]or [Y-X].

[Y-VII]

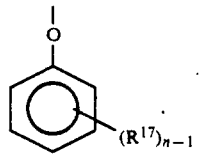

in which $R^{17}$ is an alkylsulfonyl group, an arylsulfonyl group, an acyl group, hydroxyl or the groups represented by $R^{11}$ in the formula [Y-I], each of which may have one or more substituent groups; n is 2, 3, 4 or 5; and when n is 3 or more, the groups represented by $R^{17}$ may be different from each other.

[Y-VIII]

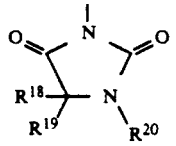

[Y-IX]

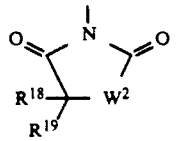

[Y-X]

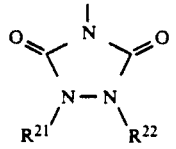

in which each of $R^{18}$ and $R^{19}$ independently is hydrogen, an alkyl group, an aryl group, an alkoxy group, an aryloxy group or hydroxyl; each of $R^{20}$, $R^{21}$ and $R^{22}$ independently is hydrogen, an alkyl group, an aryl group, an aralkyl group or an acyl group; $W^2$ is oxygen or sulfur. Further,

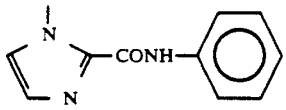

is a preferred elimination group.

The most preferred yellow coupler used in the present invention has the following formula [X-I].

[Y-XI]

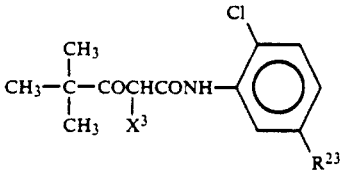

in which $R^{23}$ is an acylamino group, an alkoxycarbonyl group, an alkylsulfamoyl group or an alkylsulfonamido group, each of which may have one or more substituent groups; $X^3$ is a group having the following formula [Y-XII] or the above-mentioned formula [Y-VIII], [Y-IX]or [Y-X].

[Y-XII]

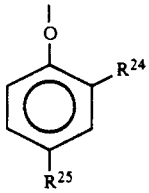

in which $R^{24}$ is hydrogen, a halogen atom, cyano, an acyl amino group, an alkylsulfamoyl group, an arylsulfamoyl group, an alkylsulfonyl group or an arylsulfonyl group, each of which may have one or more substituent groups; $R^{25}$ is hydrogen, cyano, an alkylsulfonyl group, an arylsulfonyl group, an alkylsulfamoyl group, an arylsulfamoyl group, an alkylsulfonamido group, an arylsulfonamido group, an acyl group, an alkoxycarbonyl group, an aryloxycarbonyl group or carboxyl, each of which may have one or more substituent groups; and at least one of $R^{24}$ and $R^{25}$ is an alkylsulfonyl group, an arylsulfonyl group, an alkylsulfamoyl group, an arylsulfamoyl group, an alkylsulfonamido group, an arylsulfonamido group, an alkoxycarbonyl group, an aryloxycarbonyl group or carboxyl, each of which may have one or more substituent groups.

Examples of the yellow coupler having the formula [Y-I] used in the present invention are described hereinafter without limiting the invention.

(Y-1)
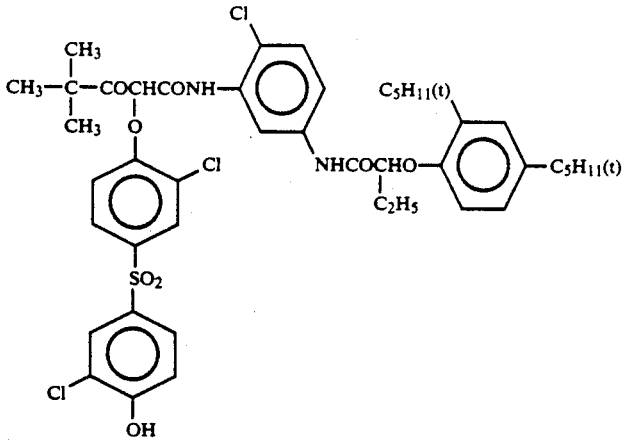
(Y-2)
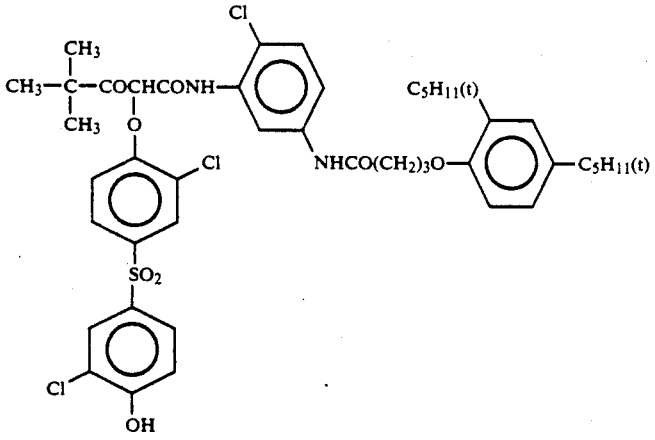
(Y-3)
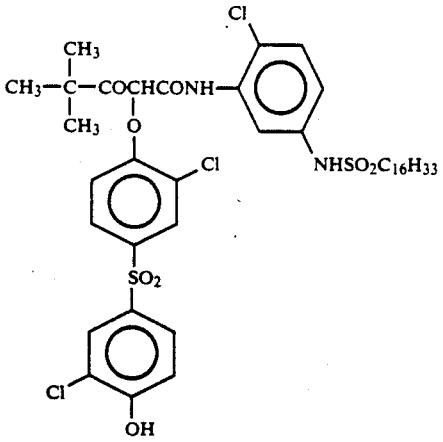
(Y-4)
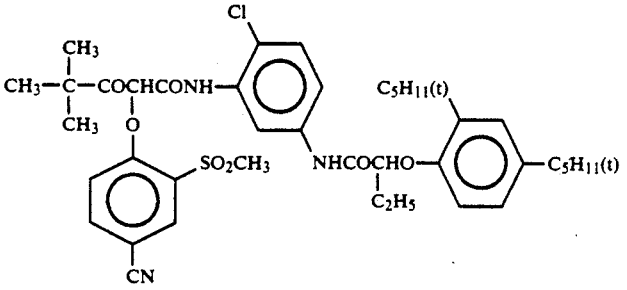

-continued
(Y-5)
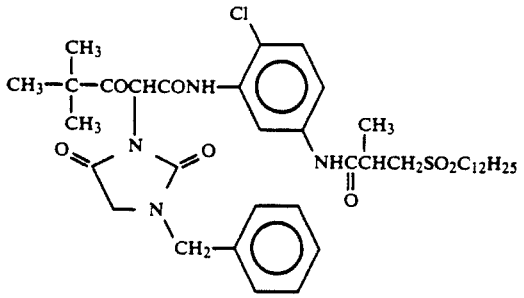
(Y-6)
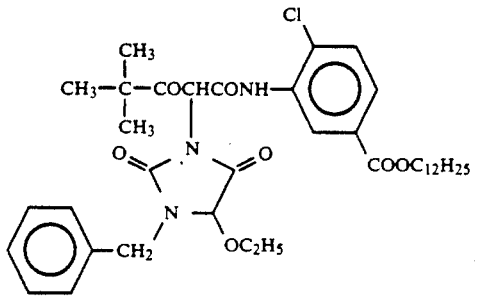
(Y-7)
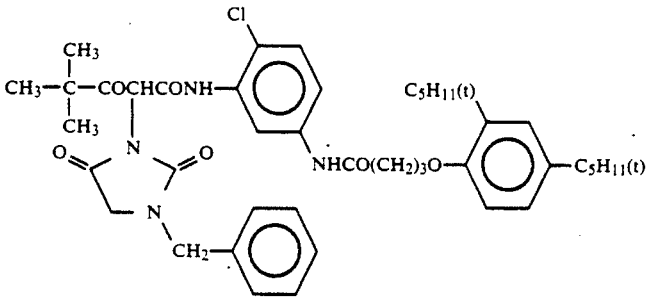
(Y-8)
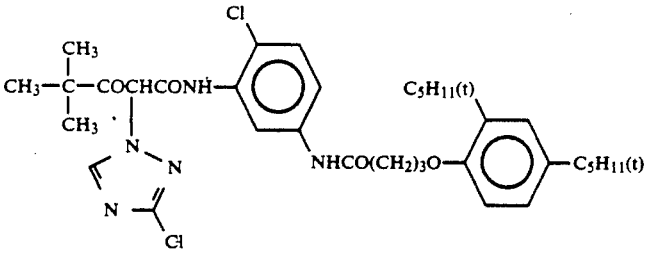
(Y-9)
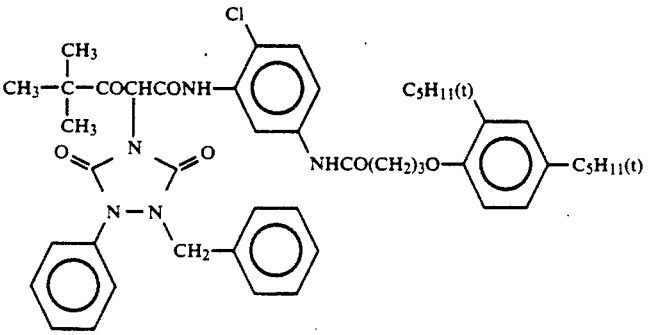

-continued
(Y-10)
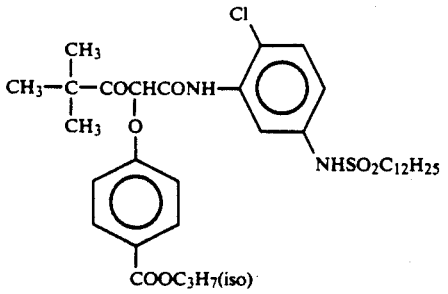
(Y-11)
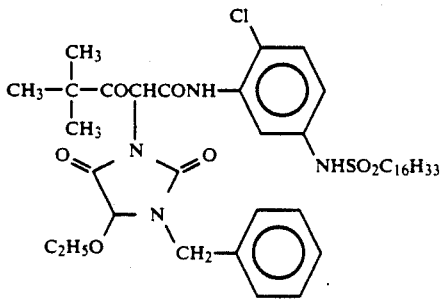
(Y-12)
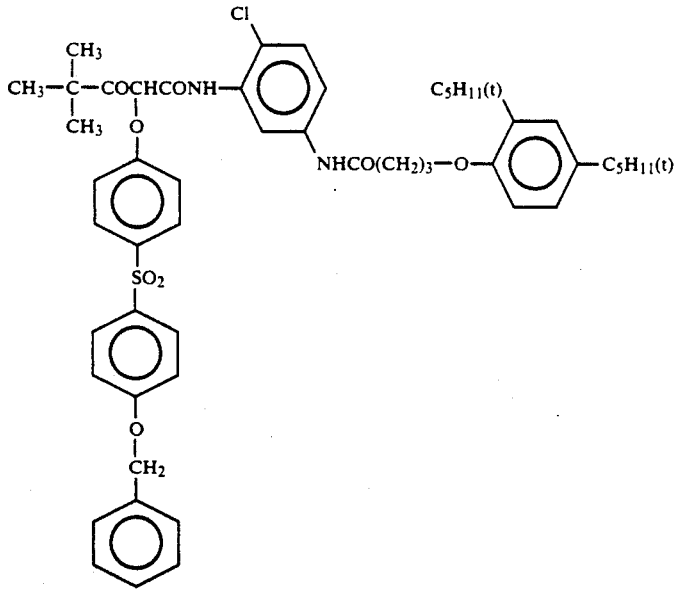
(Y-13)
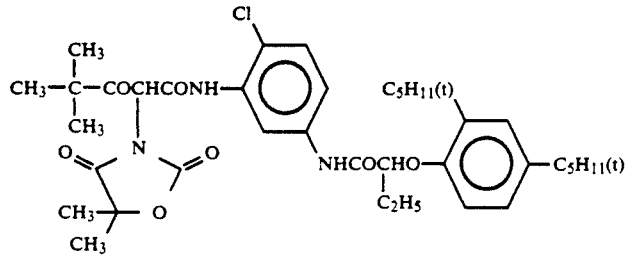

-continued
(Y-14)
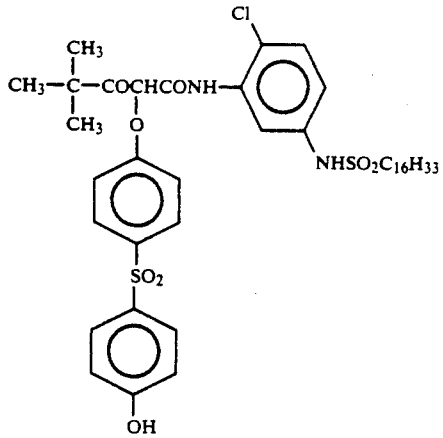
(Y-15)
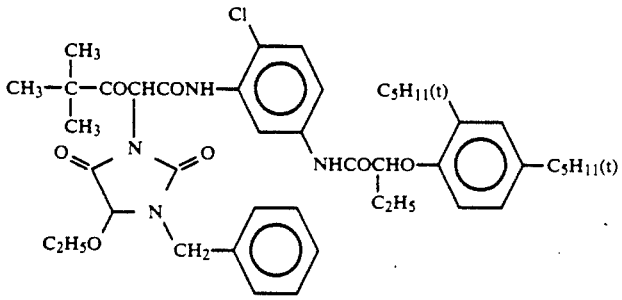
(Y-16)
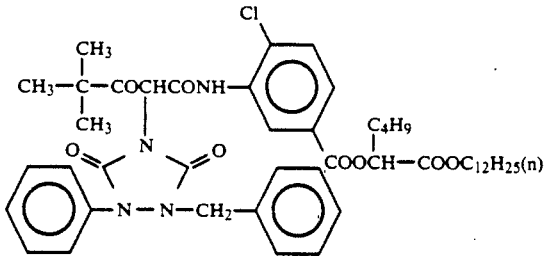
(Y-17)
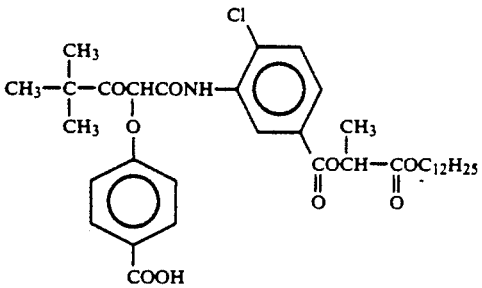
(Y-18)
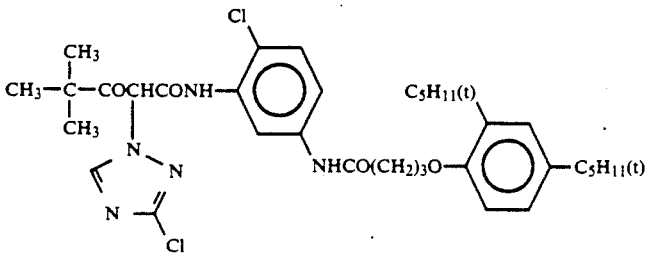

-continued
(Y-19)
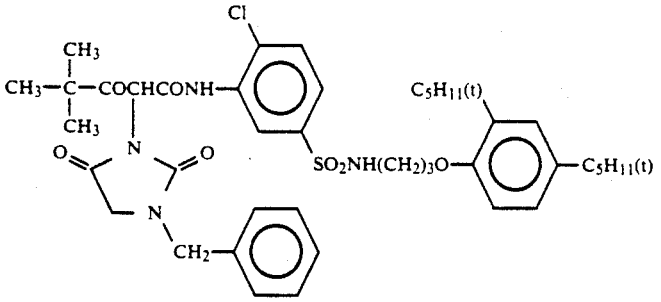
(Y-20)
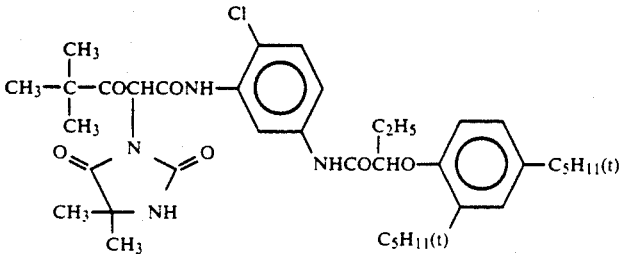
(Y-21)
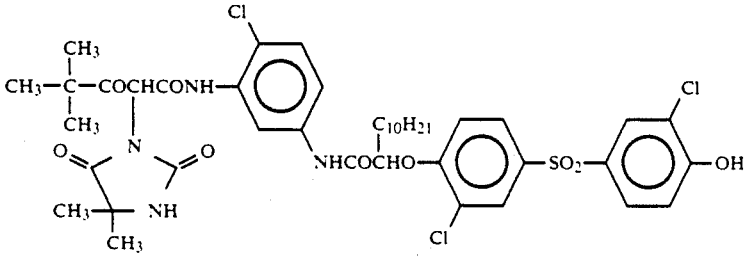
(Y-22)
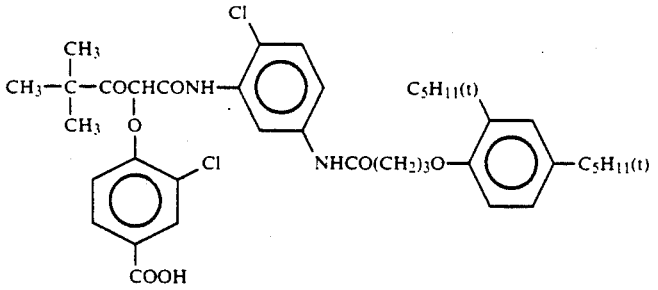
(Y-23)
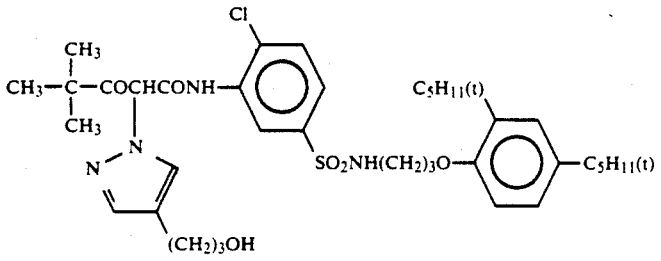
(Y-24)
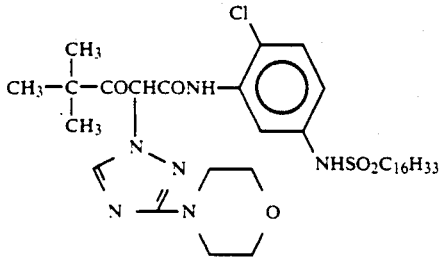

-continued
(Y-25)
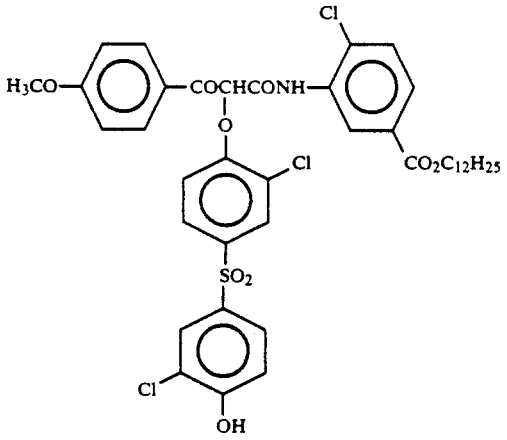
(Y-26)
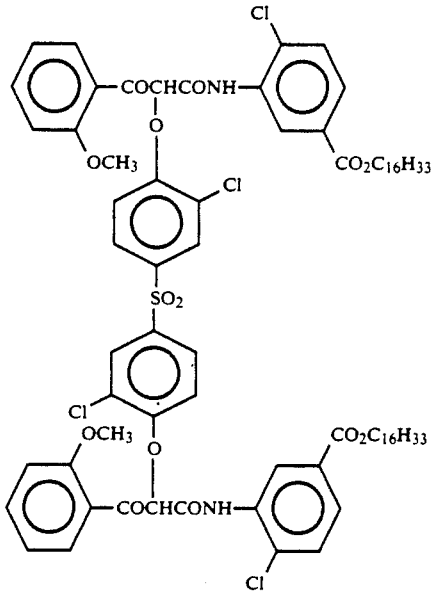
(Y-27)
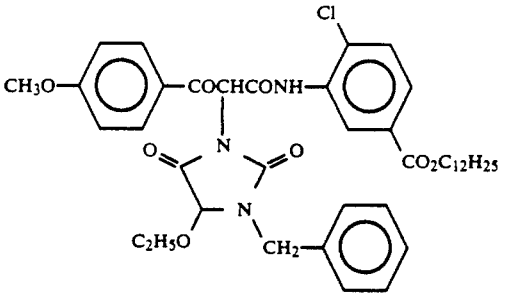
(Y-28)
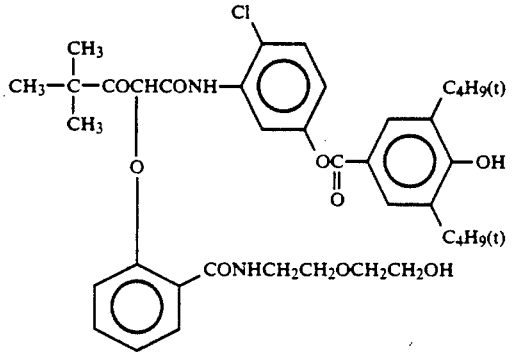

-continued
(Y-29)
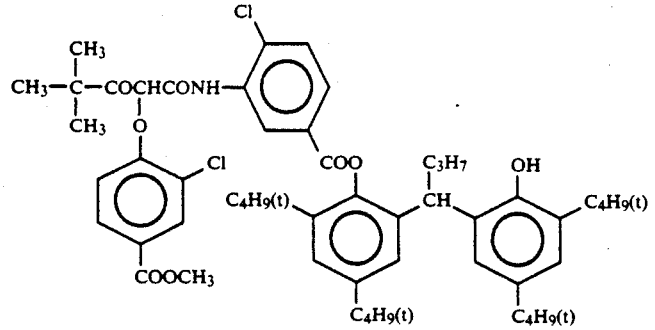
(Y-30)
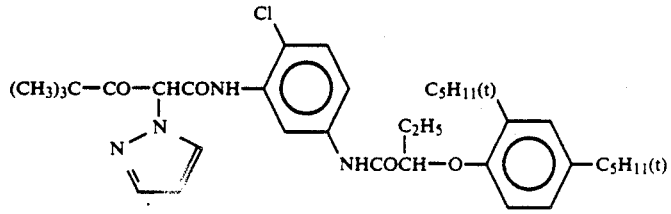
(Y-31)
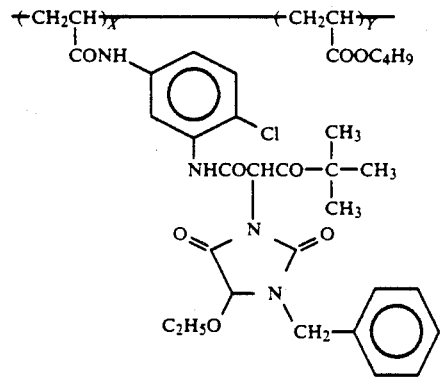
X/Y = 50/50 (as weight ratio)
(Y-32)
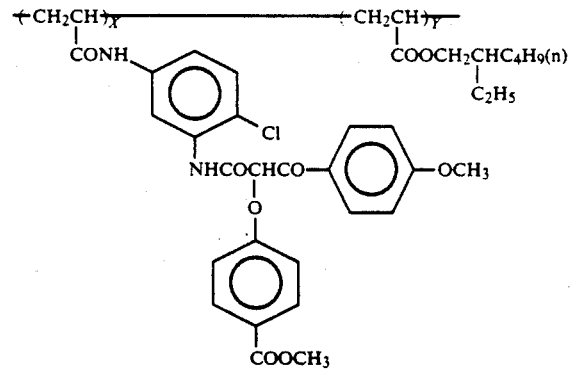
X/Y = 45/55 (as weight ratio)
(Y-33)
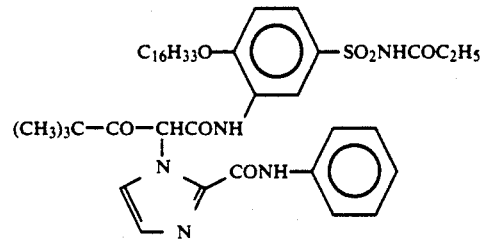
The synthesis of the above-mentioned yellow coupler is analogous to the method described in Japanese Patent Publications No. 51(1976)-10786, No. 51(1976)-33410 and No. 52(1977)-25733, Japanese Patent Provisional Publications No. 47(1972)-26133, No. 48(1973)-73147, No. 51(1976)-102636, No. 50(1975)-130442, No. 50(1975)-6341, No. 50(1975)-123342, No.

51(1976)-21827, No. 50(1975)-87650, No. 52(1977)-82424 and No. 52(1987)-115219, British Patent No. 1425020, German Patent No. 1547868, German Patent Provisional Publications No. 2219917, No. 2261361 and No. 2414006, European Patents No. 272041 and No. 249473, and Japanese Patent Provisional Publication No. 63(1988)-43144.

According to the present invention, a yellow coupler is used in an amount of $2\times10^{-3}$ mole to $5\times10^{-1}$ mole based on 1 mole of silver contained in an emulsion layer, and preferably in an amount of $1\times10^{-3}$ mole to $5\times10^{-1}$ mole.

The above-mentioned yellow couplers can be used singly or in combination of two or more compounds.

The preferred cyan coupler contained in the silver halide color photosensitive material of the present invention is a compound having the following formula [C-I], [C-II], [C-III] or [C-IV].

[C-I]

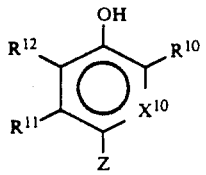

[C-II]

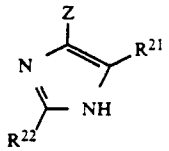

[C-III]

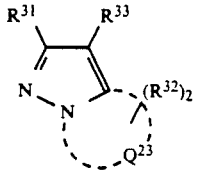

[C-IV]

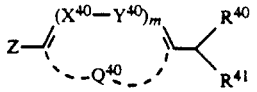

in which Z is hydrogen or or a group which may be eliminated in the coupling reaction with an oxidation product of a developing agent; $R^{10}$ is $$-NHC(=O)R^{13},$$

$$-NHSO_2-R^{14},$$

$$-C(=O)-R^{15}$$

or $-SO_2-R^{16}$, wherein each of $R^{13}$, $R^{14}$, $R^{15}$ and $R^{16}$ independently is an aliphatic group, an aromatic group, a heterocyclic group or an amino group which may have one or more substituent groups; $R^{11}$ is hydrogen, an aliphatic group or a group defined as $R^{10}$; $X^{10}$ is $=CH-$ or $=N-$; $R^{11}$ and $R^{12}$ may form a 5- to 7-membered ring; each of $R^{21}$ and $R^{22}$ independently is an aromatic group, a heterocyclic group or an electron attractive group; $Q^{30}$ is a nonmetallic atomic group which forms a nitrogen-containing heterocyclic ring; each of $R^{31}$, $R^{32}$ and $R^{33}$ independently is hydrogen or a substituent group; at least one of $R^{31}$ and $R^{32}$ is a group represented by Z; n is 1 or 2; when n is 2, the two groups represented by $R^{32}$ may be different from each other; at least one of $R^{31}$, $R^{32}$ and $R^{33}$ is an electron attractive group; $Q^{40}$ is a non-metallic atomic group which forms, together with

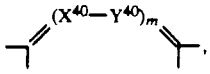

an aromatic ring or a heterocyclic ring; $X^{40}$ and $Y^{40}$ is nitrogen or a methine group which may have one or more substituent groups; m is 1 or 2; $R^{40}$ and $R^{41}$ is a substituent group; at least one of $R^{40}$ and $R^{41}$ is an electron attractive group; and when m is 2, the two groups represented by $X^{40}$ and the two groups represented by $Y^{40}$ may be different from each other.

In the present invention, an aliphatic group may be a straight chain, a branched chain or a cyclic chain, and may be either saturated or unsaturated. The aliphatic groups include an alkyl group, an alkenyl group and an alkynyl group, each of which may have one or more substituent groups. In the present invention, an aromatic group is a cyclic group consisting of carbon atoms. The aromatic group may be condensed with another aromatic ring, a heterocyclic ring or an aliphatic ring, and may have one or more substituent groups. In the present invention, a heterocyclic group has a 5- to 7-membered ring containing at least one hetero atom such as oxygen, nitrogen and sulfur. The heterocyclic ring may consist of only hetero atoms. The heterocyclic ring may be either saturated or unsaturate, and may have one or more substituent groups.

In the present invention, examples of the substituent group in the formulas [C-III] and [C-IV] include an aliphatic group, an aromatic group, a heterocyclic group, a monovalent group composed of an aliphatic group united with oxygen, a monovalent group composed of an aromatic group united with oxygen, a monovalent group composed of a heterocyclic group united with oxygen, a monovalent group composed of an aliphatic group united with sulfur, a monovalent group composed of an aromatic group united with sulfur, a monovalent group composed of a heterocyclic group united with sulfur, a halogen atom, an acyl group, an ester group, a carbamoyl group, a sulfamoyl group, a sulfonyl group, hydroxyl, cyano, carboxyl, nitro, sulfo, an acyloxy group, a silyloxy group, a sulfonyloxy group, a carbamoyloxy group, an amino group which may have one or more substituent groups (e.g., amino, an alkyl amino group, an amido group, a sulfonamido group, an urethane group, an ureido group, an anilino group and an imido group).

The cyan coupler having the formula [C-I], [C-II], [C-III]or [C-IV] is hereinafter described in more detail.

In the formula [C-I], [C-II], [C-III] and [C-IV], Z is hydrogen or or a group which may be eliminated in the coupling reaction with an oxidation product of a developing agent. Examples of the elimination group include a halogen atom (e.g., fluorine, chlorine and bromine), an alkoxy group (e.g., ethoxy, dodecyloxy, methoxyethylcarbamoylmethoxy, carboxypropyloxy and methylsulfonylethoxy), an aryloxy group (e.g., 4-chlorophenoxy, 1-methoxyphenoxy and 4-carboxyphenoxy), an acyloxy group (e.g., acetoxy, tetradecanoyloxy and benzoyloxy), a sulfonyloxy group (e.g., methanesulfonyloxy and toluenesulfonyloxy), an amido group (e.g., dichloroacetylamino, heptafluorobutylylamino, methanesulfonylamino and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), a monovalent group composed of an aliphatic or aromatic group united with sulfur (e.g., ethylthio, phenylthio and tetrazolylthio), an imido group (e.g., succinimido and hydantoinyl), an aromatic azo group (e.g., phenylazo). The above-mentioned elimination groups may contain a photographic functional group.

In the formula [C-III] and [C-IV], the electron attractive group is a substituent group having a Hammett's constant ($\sigma p$) of more than 0.

The cyan coupler represented by the formula [C-I] preferably is a compound having the following formula [C-Ia], [C-Ib]or [C-Ic].

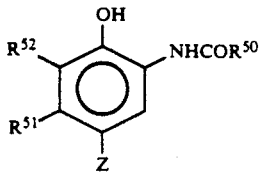
[C-Ia]

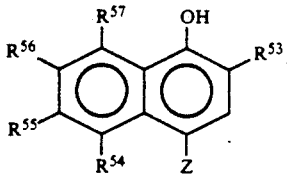
[C-Ib]

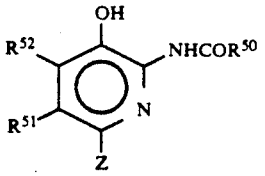
[C-Ic]

in which $R^{50}$ is is an aliphatic group, an aromatic group, a heterocyclic group or an amino group which may have one or more substituent groups; $R^{51}$ is an alkyl group or an acylamino group; $R^{52}$ is hydrogen, a halogen atom, an aliphatic group or alkoxy group, $R^{51}$ and $R^{52}$ may form a 5- to 7-membered ring; Z has the same meanings as in the formula [C-I]; $R^{53}$ has the same meanings as for $R^{10}$ in the formula [C-I]; and each of $R^{54}$, $R^{55}$, $R^{56}$ and $R^{57}$ independently is hydrogen or a substituent group.

The cyan coupler represented by the formula [C-III] preferably is a compound having the following formula [C-IIa], [C-IIIb], [C-IIIc], [C-IIId], [C-IIIe] or [C-IIIf].

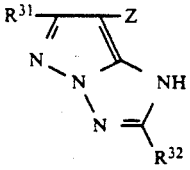
[C-IIIa]

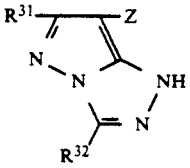
[C-IIIb]

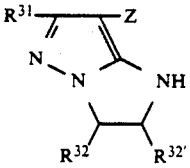
[C-IIIc]

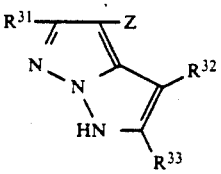
[C-IIId]

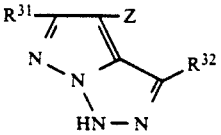
[C-IIIe]

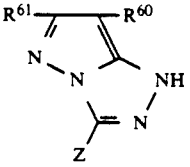
[C-IIIf]

in which $R^{31}$, $R^{32}$ and Z have the same meanings in the formula [C-III]; $R^{32'}$ has the same meanings as for $R^{32}$; each of $R^{60}$ and $R^{61}$ independently is hydrogen or a substituent group; and one of $R^{60}$ and $R^{61}$ is an electron attractive group.

With respect to the cyan coupler represented by the formula [C-IIIa], [C-IIIb], [C-IIIc], [C-IIID] or [C-IIIe], it is preferred that $R^{31}$ is an electron attractive group. With respect to the cyan coupler represented by the formula [C-IIIf], it is preferred that $R^{60}$ is an electron attractive group.

With respect to the cyan coupler represented by the formula [C-IV], it is preferred that m is 1 and $Q^{40}$ is —O—, —S— or vinylene.

The cyan coupler represented by the formula [C-I] is particularly preferred. The cyan coupler represented by the formula [C-Ia] or [C-Ib] is more particularly preferred.

Examples of the cyan coupler are described hereinafter without limiting the invention.

(C-1)
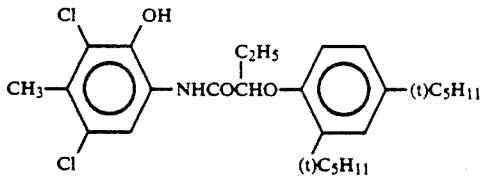
(C-2)
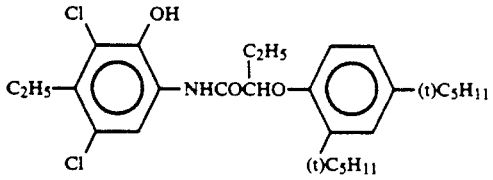
(C-3)
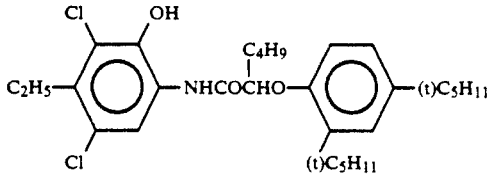
(C-4)
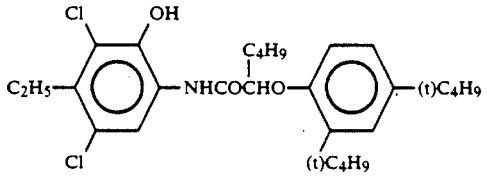
(C-5)
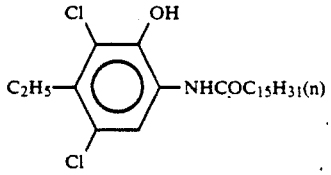
(C-6)
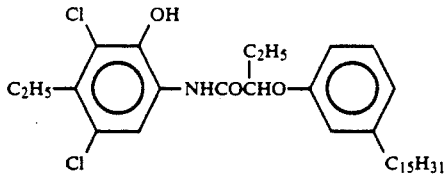
(C-7)
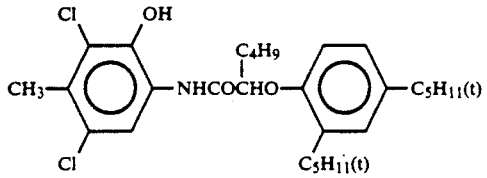
(C-8)
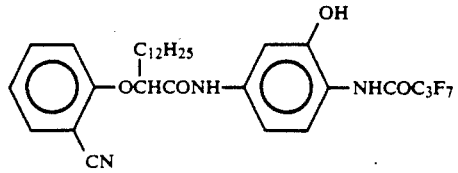

-continued
(C-9)
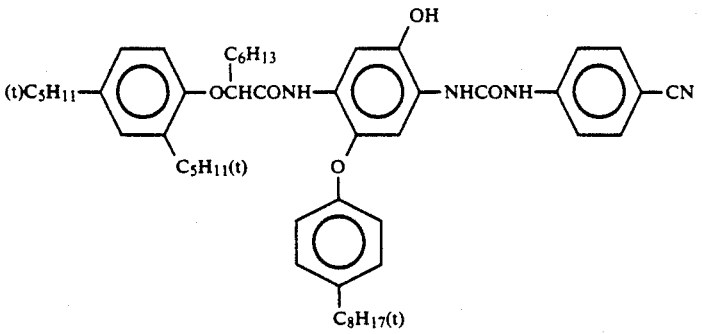
(C-10)
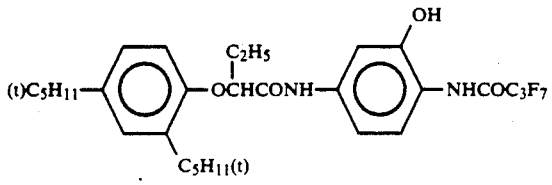
(C-11)
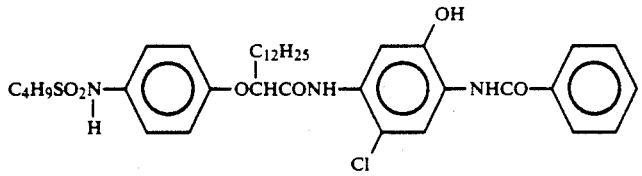
(C-12)
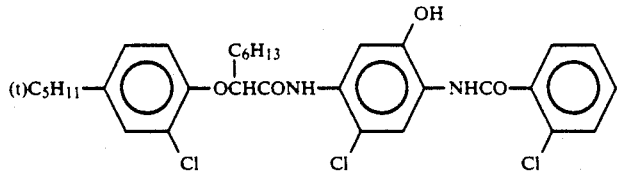
(C-13)
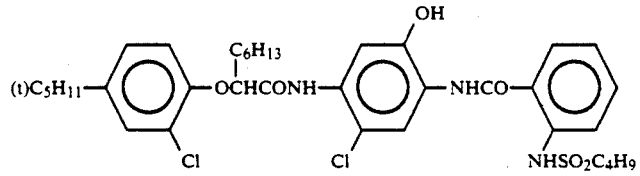
(C-14)
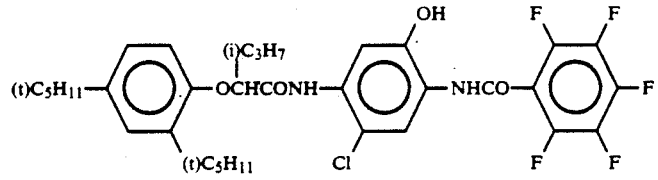
(C-15)
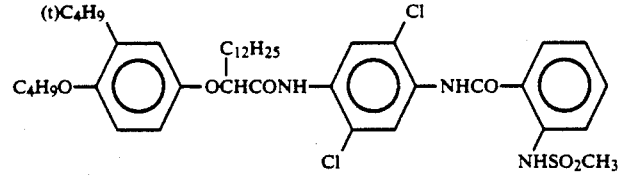
(C-16)
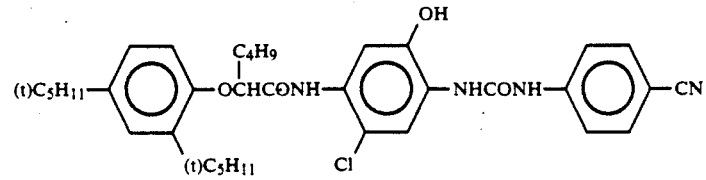

-continued
(C-17)
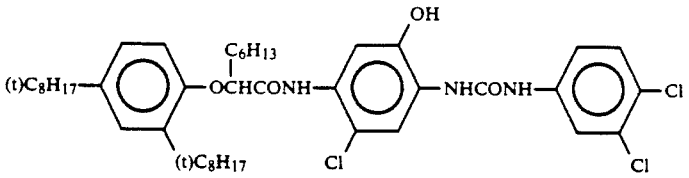
(C-18)
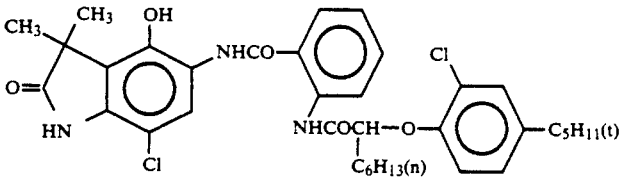
(C-19)
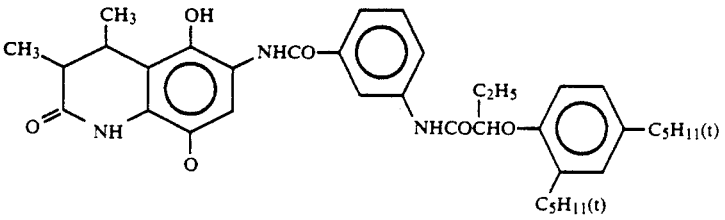
(C-20)
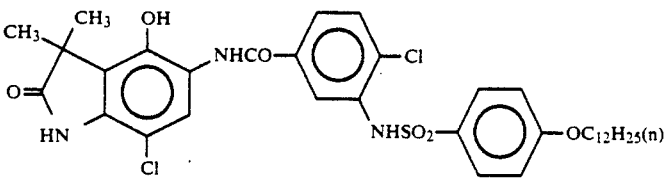
(C-21)
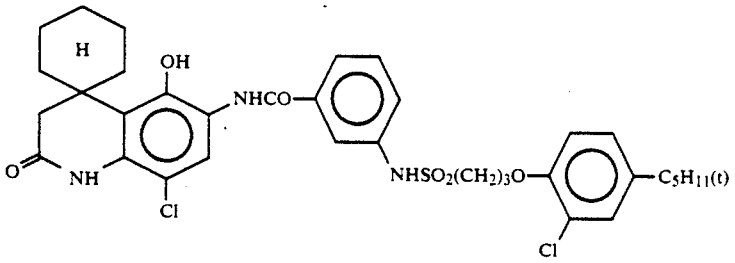
(C-22)
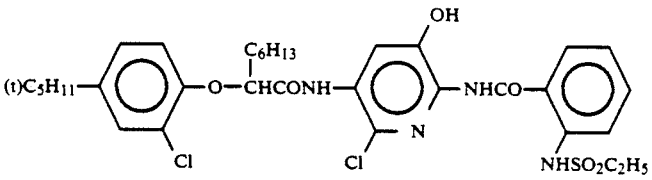
(C-23)
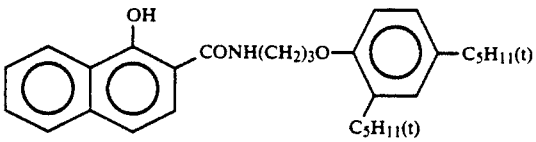
(C-24)
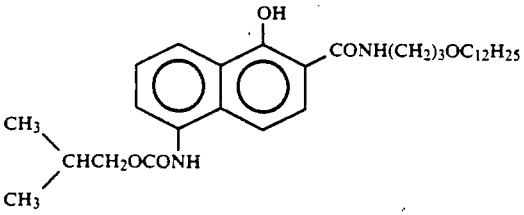

-continued
(C-25)
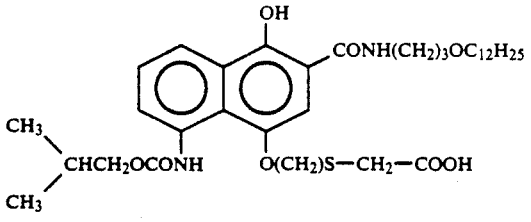
(C-26)
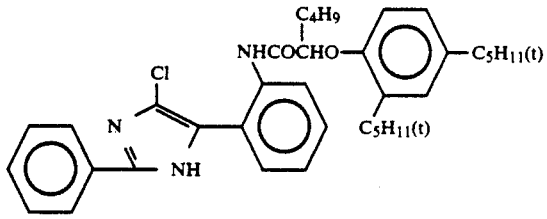
(C-27)
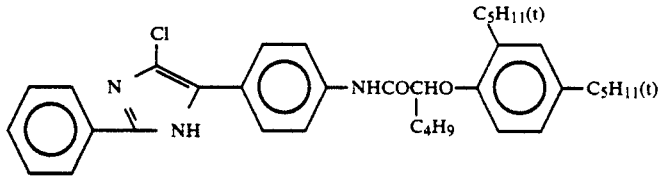
(C-28)
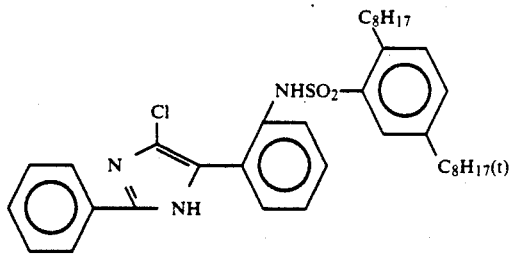
(C-29)
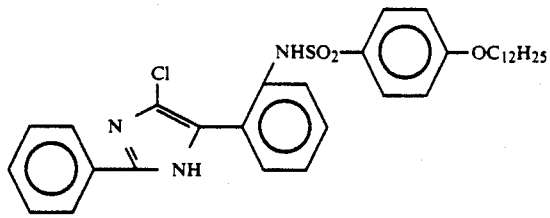
(C-30)
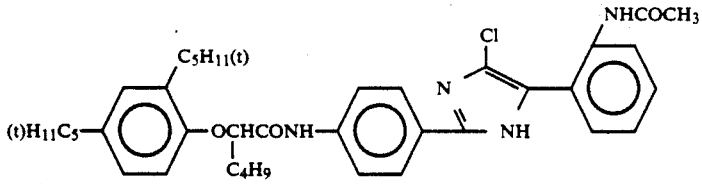
(C-31)
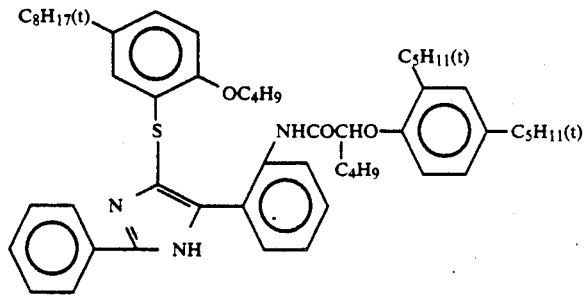

-continued

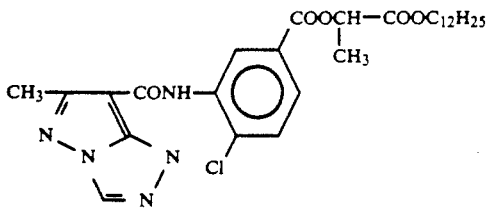

(C-32)

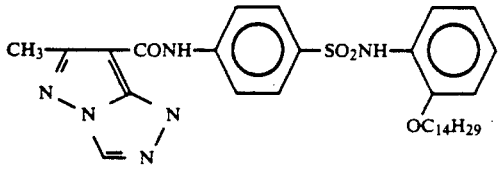

(C-33)

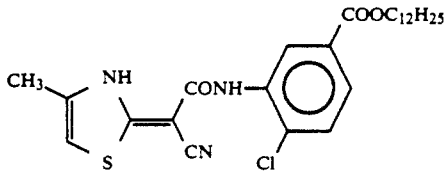

(C-34)

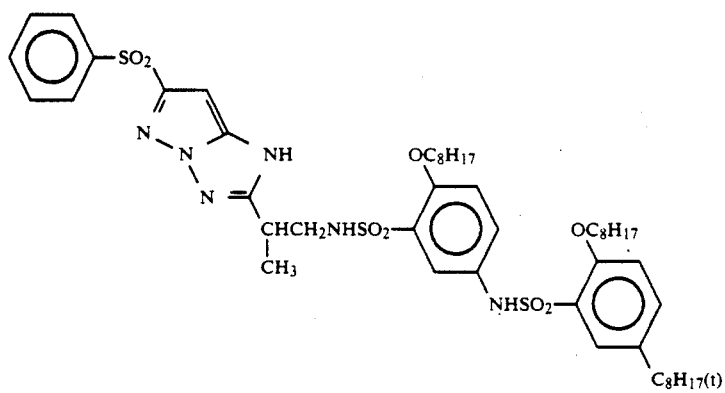

(C-35)

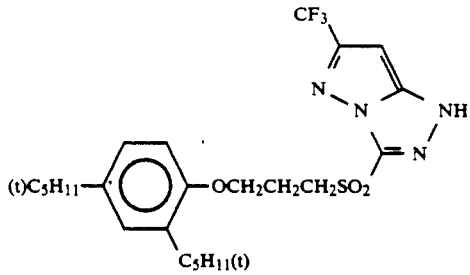

(C-36)

The synthesis of the above-mentioned cyan coupler is analogous to the method described in U.S. Pat. Nos. 2,369,929, 4,511,647, 2,772,162, 4,500,653 and 4,464,586, European Patent Provisional Publication No. 249,453A2, and Japanese Patent Provisional Publications No. 61(1986)-390441, No. 61(1986)-153640 and No. 62(1987-257158.

The cyan coupler having the formula [C-I], [C-II], [C-III] or [C-IV] is used in an amount of $2\times10^{-3}$ mole to $5\times10^{-1}$ mole based on 1 mole of silver contained in an emulsion layer, and preferably in an amount of $1\times10^{-2}$ mole to $5\times10^{-1}$ mole.

The above-mentioned cyan couplers can be used singly or in combination of two or more compounds.

These couplers can be contained in droplets of the above-mentioned high boiling organic solvent which are dispersed in an emulsion layer. The high boiling organic solvent preferably is a compound represented by the above-mentioned formula [A], [B], [C], [D] or [E].

The couplers can be emulsified or dispersed in a hydrophilic colloidal solution by immersing a loadable latex polymer in the couplers (cf., U.S. Pat. No. 4,203,716), or dissolving the coupler in a water-insoluble and organic solvent-soluble polymer. In these cases, the high boiling organic solvent can be used together with the couplers.

Preferred examples of the polymers are homopolymers and copolymers described at pages 12-30 in International Provisional Publication No. W088/00723. Acrylamide polymers are particularly preferred, since they improve the stability of the color image.

Examples of the magenta coupler used in the present invention include oil protected couplers, such as indazolone couplers, cyanoacetyl couplers 5-pyrazolone couplers and pyrazoloazole couplers. The 5-pyrazolone couplers and the pyrazoloazole couplers (e.g., pyrazolotriazoles) are preferred. The 5-pyrazolone couplers are preferably substituted with an arylamino group or an acylamino group at 3-position from the viewpoint of the hue of the developed dye and the density of the color. Examples of the substituted 5-pyrazolone couplers are described in U.S. Pat. Nos. 2,311,082, 2,343,703, 2,600,788, 2,908,573, 3,062,653, 3,152,896 and 3,936,015. The elimination group of a two equivalent 5-pyrazolone coupler preferably is the nitrogen eliminating group described in U.S. Pat. No. 4,351,987 or an arylthio group described in International Provisional Publication No. W088.04795. The 5-pyrazolone coupler having a ballast group described in European Patent No. 73,636 gives a high color density.

Preferred examples of the pyrazoloazole couplers include pyrazolobenzimidazoles described in U.S. Pat. No. 2,369,879, pyrazolo[5,1-c][1,2,4]triazoles described in U.S. Pat. No. 3,725,067, pyrazolotetrazoles described in Research Disclosure 24220 (June, 1984) and pyrazolopyrzoles described in Research Disclosure 24230 (June, 1984). The above-mentioned couplers may be in the form of a polymer coupler.

In more detail, the magenta couplers preferably are the compounds having the following formula [M-I], [M-II] or [M-III].

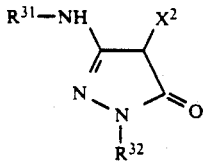

[M-I]

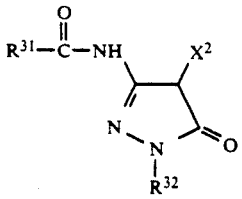

[M-II]

-continued

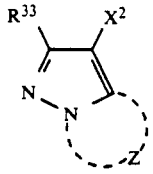

[M-III]

in which $R^{31}$ is a ballast group containing 8–32 carbon atoms; $R^{32}$ is phenyl or a substituted phenyl group; $R^{33}$ is hydrogen or another substituent group; Z is a non-metallic atomic group which form a 5-membered azole ring containing 2, 3 or 4 nitrogen atoms; the azole ring may have one or more substituent groups, and may be condensed with another ring; and $X^2$ is hydrogen or an elimination group.

Examples of the substituent groups represented by $R^{33}$ and the substituent groups attached to the azole ring are described at column 2, line 41 to column 8, line 27 in U.S. Pat. No. 4,540,654.

It is preferred that the unwanted absorption of the magenta coupler within the yellow range is small and the formed dye is stable to light. From these view points, imidazo[1,2-b]pyrazoles described in U.S. Pat. No. 4,500,630 are preferred, and pyrazolo[1,5-b][1,2,4]triazoles described in U.S. Pat. No. 4,540,654 are particularly preferred.

The other available magenta couplers includes pyrazolotriazole couplers in which a branched alkyl group is attached to the pyrazolotriazole ring at 2- , 3- or 6- position (cf., Japanese Patent Provisional Publication No. 1(1986)-65245); pyrazoloazole couplers containing sulfonamido group in its molecule (cf., Japanese Patent Provisional Publication No. 61(1986)-65246); pyrazoloazole couplers having an alkoxyphenylsulfonamido group as a ballast group (cf., Japanese Patent Provisional Publication No. 61(1986)-147254); and pyrazolotriazole couplers having an alkoxy group or an aryloxy group at 6-position (cf., European Patent Provisional Publication No. 226,849).

Examples of the magenta couplers are described hereinafter.

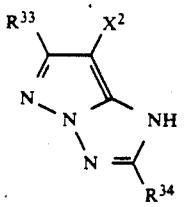

| (Compound) ($R^{33}$—) | (—$R^{34}$) | (—$X^2$) |
|---|---|---|
| (M-1) $CH_3$— | 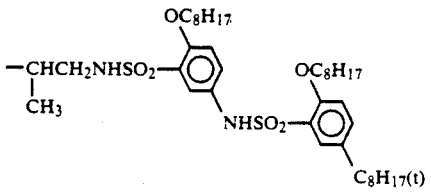 | —Cl |

-continued

| | | |
|---|---|---|
| (M-2) $CH_3$— | $OCH_2CH_2OC_6H_{13}(n)$ <br> —$CHCH_2NHSO_2$— <br> $CH_3$ <br> $C_8H_{17}(t)$ | —Cl |
| (M-3) $CH_3$— | $OC_8H_{17}$ <br> —$CHCH_2NHSO_2$— <br> $CH_3$ <br> $C_8H_{17}$ | —O— $CH_3$ |
| (M-4) $OCH_3$ <br> —O— | $OC_8H_{17}$ <br> $NHSO_2$ <br> $C_8H_{17}(t)$ | $OC_4H_9$ <br> —O— <br> $C_8H_{17}(t)$ |
| (M-5) $CH_3$— | $OC_2H_4OC_2H_5$ <br> —$CHCH_2NHSO_2$— <br> $CH_3$ <br> $OC_8H_{17}$ <br> $NHSO_2$ <br> $C_8H_{17}(t)$ | —Cl |
| (M-6) $CH_3$— | $CH_3$ <br> —$CCH_2NHSO_2$— <br> $CH_3$ <br> $OC_8H_{17}$ <br> $OC_8H_{17}$ <br> $NHSO_2$ <br> $C_8H_{17}(t)$ | —Cl |
| (M-7) $CH_3$— | $OCH_2CH_2OC_6H_{13}(n)$ <br> —$CHCH_2NHSO_2$— <br> $CH_3$ <br> $C_8H_{17}(t)$ | —Cl |
| (M-8) <br> —$OCH_2CH_2O$— | O <br> —$CHCH_2NHSO_2$— <br> $CH_3$ <br> $OC_8H_{17}$ <br> $NHSO_2$ <br> $C_8H_{17}(t)$ | $OC_4H_9$ <br> —S— <br> $C_8H_{17}(t)$ |
| (M-9) $CH_3CH_2O$— | O <br> —$CHCH_2NHSO_2$— <br> $CH_3$ <br> $OC_8H_{17}$ <br> $NHSO_2$ <br> $C_8H_{17}(t)$ | $OC_4H_9$ <br> —S— <br> $C_8H_{17}(t)$ |
| (M-10) $OC_8H_{17}$ <br> $SO_2NH$— <br> —$O(CH_2)_2O$— <br> $C_8H_{17}(t)$ | Cl <br> Cl | $OC_4H_9$ <br> —S— <br> $C_8H_{17}(t)$ |

-continued

| | | |
|---|---|---|
| (M-11) 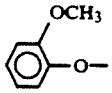 | 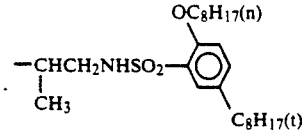 | —Cl |

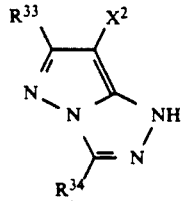

| (Compound) ($R^{33}$—) | (—$R^{34}$) | (—$X^2$) |
|---|---|---|
| (M-12) $CH_3$— | 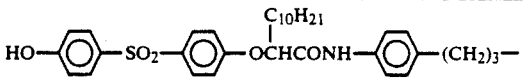 | —Cl |
| (M-13) $CH_3$— | 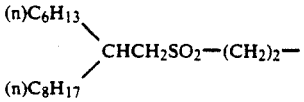 | —Cl |
| (M-14) 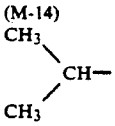 | 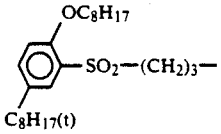 | —Cl |
| (M-15) 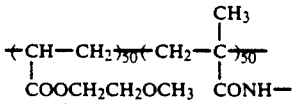 | 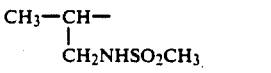 | —Cl |
| (M-16) 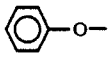 | 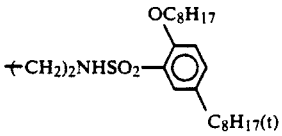 | —Cl |
| (M-17) 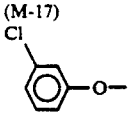 | 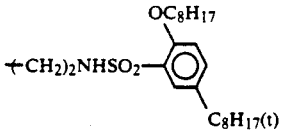 | 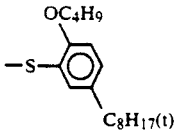 |

There is no specific limitation with respect to the color photosensitive material of the present invention containing the above-mentioned compound having the formula [I], [II], [III], [IV], [V] or [VI]. The photosensitive material of the invention can be used as a color print paper, a color negative film including a motion picture film, a color reversal film for slide or television, a color positive film or a color reversal paper. The photosensitive material of the present invention can be used as a black and white photosensitive material employing a mixture of the three color couplers, which is described in Research Disclosure 17123 (July, 1978).

The color photosensitive material of the present invention preferably comprises a blue sensitive silver halide emulsion layer, a green sensitive silver halide emulsion layer and a red sensitive silver halide emulsion layer on a support in the order. This order can be changed.

Examples of the silver halide used in the present invention include silver chloride, silver bromide, silver iodide, silver chloro(iodo)bromide and silver iodobromide. Silver chloride and silver chloro(iodo)bromide are particularly preferred. With respect to the halogen composition, the silver halide grains contained in an emulsion layer preferably are silver chlorobromide which substantially does not contain silver iodide and contains silver chloride in an amount of not less than 90 mole % based on the total amount of the silver halide. The term "substantially does not contain silver iodide" means that the iodide content is not more than 1.0 mole %. It is more preferred that the silver halide grains contained in an emulsion layer preferably are silver chlorobromide which substantially does not contain silver iodide and contains silver chloride in an amount of not less than 95 mole % based on the total amount of the silver halide.

The silver halide grains preferably have a phase where silver bromide is localized in an amount of 10 mole % to 70 mole %. The silver bromide localized phase may be arranged in the inside, surface or subsurface of the silver halide grains. The localized phase may be also divided into the inside, surface or subsurface. Further, the localized phase may have a layered structure surrounding the silver halide grain or have a discontinuous structure in the inside or surface of the grain. A preferred example of the arrangement of the silver bromide localized phase is that the localized phase containing silver bromide in an amount of not less than 10 mole % (more preferably not less than 20 mole %) is epitaxially formed in the surface of (particularly an edge of) the silver halide grain.

It is more preferred that the localized phase contains silver bromide in an amount of not less than 20 mole %. If the content of silver bromide is relatively high, the localized phase sometimes affects the quality of the photosensitive material. In more detail, if the silver bromide content is high, the sensitivity of the photosensitive material tends to be lowered when pressure is applied to the material, and the sensitivity or gradation of the photosensitive material may be markedly changed according to the change of the composition of a processing solution. Accordingly, the silver bromide content in the localized phase more preferably is in the range of 20 to 60 mole %, and most preferably in in the range of 30 to 60 mole %. The silver halide other than the localized phase preferably is silver chloride. The silver bromide content in the localized phase can be analyzed by X-ray analysis or XPS (X-ray photoelectron spectroscopy). The localized phase preferably has a silver content in the range of 0.1 to 20 % (more preferably 0.5 to 7 %) based on the total silver content.

The interface between the silver bromide localized phase and the other phase may be either a clear boundary or a transition area where the halogen composition is gradually changed. The position of the the silver bromide localized phase can be observed by an electron microscope or a method described in European Patent Provisional Publication No. 273430A2.

The above-mentioned silver bromide localized phase can be formed by various methods. For example, the localized phase can be formed by a reaction of a soluble silver salt with a soluble halogen salt in a single jet process or a double jet process. The localized phase can also be formed by a conversion method which includes a process of converting the formed silver halide into another silver halide having a smaller solubility product. Further, the localized phase can be formed by recrystallization of silver bromide micrograins on the surface of silver chloride grains. These methods are described in various publications, such as European Patent Provisional Publication No. 273430A2.

In the present invention, a metal ion other than silver ion (e.g., the metal ions of the VIII group in periodic table, the transition metal ions of the II group, lead ion and thallium ion) is preferably added to the localized phase or the base of the phase (i.e., the portion other than the localized phase) in the silver halide grain to improve the effect of the invention.

Iridium ion, rhodium ion or iron ion is preferably added to the localized phase. Osmium ion, iridium ion, rhodium ion, platinum ion, ruthenium ion, palladium ion, cobalt ion, nickel ion, iron ion or a complex ion thereof is preferably added to the base of the phase. The phase may be different from the base in the nature and amount of the metal ion.

The metal ion can be contained in the localized phase and/or the base in the silver halide grain by adding the metal ion into a silver halide emulsion in preparation before or after the grain formation or at the stage of physical ripening. For example, the metal ion can be added to a gelatin solution, a halogen salt solution, a silver salt solution or the other solutions to form silver halide grains.

Further, the metal ion can be introduced into the silver halide grain by adding silver halide micrograins which contain a metal ion to a silver halide emulsion, and dissolving the silver halide micrograins. This method is advantageous to the preparation of the silver halide grain in which the silver bromide localized phase is arranged on the surface of the grain. The method of adding the metal ion can be selected depending on the position where the metal ion is localized.

At least 50% of iridium ion based on the total amount of the ion contained in the silver halide grain is preferably deposited together with the localized phase.

The iridium ion can be deposited together with the localized phase by adding an iridium compound either before, simultaneously with or after the addition of silver and/or halogen.

The silver halide grain used in the present invention preferably has a hundred and/or a hundred and eleven sides on the surface. The grain may have sides of a higher order.

The shape of the silver halide grain may be either in the form of a regular crystal (e.g., cube, tetradecahedron and octahedron) or in the form of an irregular crystal (e.g., globular and tabular shapes). Further, the shape of the grain may be complex of two or more crystals. Two or more silver halide grains differing in the shape can be employed. At least 50% of the silver halide grains preferably (more preferably at least 70%, and most preferably at least 90%) are in the form of a regular crystal. A tabular silver halide grain having an aspect ratio (length/thickness) of not less than 5 (more preferably not less than 8) can be also employed in an amount of at least 50% based on the total projected area of the silver halide grains.

The silver halide grains used in the present invention have a mean grain size in the conventional range, and preferably in the range of 0.1 to 1.5 μm. There is no specific limitation on the grain size distribution of silver halide grains. Silver halide grains having an almost uniform grain size distribution are preferably employed. In more detail, the silver halide grains preferably have such a grain size distribution that the coefficient of variation (S/d) is not more than 20 %, wherein "S" means a standard deviation of the grain size as a circular approximation of the projected area and "d" means the average grain size. The coefficient of the variation more preferably is not more than 15%.

A mixture of a silver halide emulsion containing tabular silver halide grains and an emulsion having an almost uniform grain size distribution can be employed. The latter emulsion preferably has the above-defined coefficient of the variation. It is more preferred that the mixture also has the coefficient of the variation.

The portion other than the localized phase (i.e., the base) may be either heterogeneous from the inside to the surface of the grain or homogeneous.

The silver halide emulsion used in the present invention is usually physically and chemically ripened and spectrally sensitized. Preferred examples of the chemical sensitizer used for the chemical ripening are described at pages 18 to 22 in Japanese Patent Provisional Publication No. 62(1987)-215272. Preferred examples of the spectral sensitizer are described at pages 22 to 38 in Japanese Patent Provisional Publication No. 62(1987)-215272.

Further, preferred examples of the antifogging agent and the stabilizer which are used in the preparation or preservation of the silver halide emulsion are described at pages 39 to 72 in Japanese Patent Provisional Publication No. 62(1987)-215272.

In the present invention, the below described compounds (F) and (G) are preferably used in combination with the above-mentioned couplers. The compounds (F) and (G) are more preferably used in combination with a pyrazoloazole coupler.

The compound (F) has a function of forming an inert and colorless compound when the compound (F) reacts with a remaining aromatic amine developing agent after a color developing process. The compound (G) has a function of forming an inert and colorless compound when the compound (G) reacts with a remaining oxidation product of an aromatic amine developing agent after a color developing process. The compound (F) and/or the compound (G) are preferably used to prevent an adverse effect, such as an occurence of a stain of a dye formed by a reaction of a coupler with a developing agent or an oxidation product of the agent which remains in a layer after the development process.

The compound (F) preferably has a rate constant (k2) of second-order reaction with p-anisidine (in trioctyl phosphate at 80° C.) in the range of 1.0 l /mol.sec to $1\times10^{-5}$ l/mol.sec. The rate constant of second-order reaction can be measured according to the method described in Japanese Patent Provisional Publication No. 63(1988)-158545.

When k2 is larger than the above-mentioned range, the compound (F) itself is no stable and tends to be decomposed by reacting with water or gelatin. On the other hand, when k2 is smaller than the range, the rate of the reaction with the remaining aromatic amine developing agent is low, and thus the compound (F) does not show a sufficient function of preventing an adverse effect of the remaining aromatic amine developing agent.

The compound (F) is preferably represented by the following formula [F-I] or [F-II].

$$R^1-(A)_n-X \qquad \text{[F-I]}$$

$$R^2-\underset{\underset{B}{|}}{C}=Y \qquad \text{[F-II]}$$

in which each of $R^1$ and $R^2$ independently is an aliphatic group, an aromatic group or a heterocyclic group; n is 1 or 0; A is a group having a function of reacting with an aromatic amine developing agent and binding the agent; X is which may be eliminated in the reaction with the aromatic amine developing agent; B is hydrogen, an aliphatic group, an aromatic group, a heterocyclic group, an acyl group or a sulfonyl group; Y is a group having a function of accelerating the addition reaction of the aromatic amine developing agent with the compound having the formula [F II]; $R^1$ and X may form a ring; and Y and $R^2$ or B may form.

The reaction of the aromatic amine developing agent with the compound (F) preferably is an addition reaction or a replacement reaction.

Examples of the compound having the formula [F-I] or F-II] are described in Japanese Patent Provisional Publications No. 63(1988)-158545 and 62(1987)-283338, and Japanese Patent Applications No. 62(1987)-158342 and No. 3(1988)-18439.

The compound (G) has the function of forming an inert and colorless compound when the compound reacts with a remaining oxidation product of an aromatic amine developing agent after a color developing process. The compound (G) is preferably represented by the following formula [G-I].

$$R-Z \qquad \text{[G-I]}$$

in which R is an aliphatic group, an aromatic group or a heterocyclic group; Z is a nucleophilic group or a group having a function of releasing a nucleophilic radical when it is decomposed in a photosensitive material.

With respect to the compound having the formula [G-I], it is preferred that Z is a group having a nucleophilic value ($^nCH_3I$) of not less than 5 (cf., R. G. Pearson et al., J. Am. Chem. Soc., 90, 319 (1968)), or is a group described from such nucleophilic group.

Examples of the compound represented by the formula [G-I] are described in European Patent Provisional Publication No. 255722, Japanese Patent Provisional Publications No. 62(1987)-143048 and No. 62(1987)-229145, and Japanese Patent Applications No. 63(1988)-18439, No. 63(1988)-136724, No. 62(1987)-214681 and No. 62(1987)-158342.

The compounds (G) and (F) are also described in detail in Japanese Patent Application No. 63(1988) -18439.

The photosensitive material of the present invention can contain hydroquinone derivatives, aminophenol derivatives, gallic acid derivatives and ascorbic acid derivatives as anticolorfogging agents.

The photosensitive material of the present invention can contain various color image stabilizers. Examples of the organic color image stabilizers for a cyan, magenta or yellow image include hindered phenols (such as hydroquinones, 6-hydroxychromans, 5-hydroxycounarans, spiro coumarans, p-alkoxyphenols and bisphenols), gallic acid derivatives, methylenedioxybenzenes, aminophenols, hindered amines, cyclic or acyclic amines which may have one or substituent groups, anilines, and ether or ester derivatives formed by silylation or alkylation of a phenolic hydroxyl group of these compound. Further, nickel complexes of bissalicylaldoxymate phosphate esters and nickel complexes of bis-N,N-dialkyldithiocarbamate are also available.

Examples of the hydroquinones are described in U.S. Pat. Nos. 2,360,290, 2,418,613, 2,700,453, 2,701,197, 2,728,659, 2,732,300, 2,735,765, 3,982,944, 4,430,425, British Patent No. 1,363,921, and U.S. Pat. Nos. 2,710,801, 2,816,028. Examples of the 6-hydroxychromans, 5-hydroxycoumarans and spirocoumarans are described in U.S. Pat. No. 3,432,300, 3,573,050, 3,574,627, 3,698,909 and 3,764,337, and Japanese Patent Provisional Publication No. 52(1977)-52225. Examples of the spiroindanes are described in U.S. Pat. No. 4,360,589. Examples of the p alkoxyphenols are described in U.S. Pat. No. 2,735,765, British Patent No. 2,066,975, Japanese Patent Provisional Publication No.

59(1984)-10539, and Japanese Patent Publication No. 57(1982)-19765. Examples of the hindered phenols are described in U.S. Pat. No. 3,700,455, Japanese Patent Provisional Publication No. 52(1977)-72224, U.S. Pat. No. 4,228,235, and Japanese Patent Publication No. 52(1977)-6623. Examples of the gallic acid derivatives, methylenedioxybenzenes and aminophenols are described in U.S. Pat. Nos. 3,457,079 and 4,332,886, and Japanese Patent Publication No. 56(1981)-21144. Examples of the hindered amines are described in U.S. Pat. Nos. 3,336,135 and 4,268,593, British Patents Nos. 1,326,889, 1,354,313 and No. 1,410,846, Japanese Patent Publication No. 51(1976)-1420, and Japanese Patent Provisional Publications No. 58(1983)-114036, No. 59(1984)-53846 and No. 59(1984)-78344. Examples of the metal complexes are described in U.S. Pat. Nos. 4,245,018, 4,684,603, 4,050,938 and 4,241,155, and British Patent No. 2,027,731(A).

These compounds are usually used in an amount of 5 to 100 weight % based on the amount of the coupler. The compounds and the coupler are preferably together contained in droplets of a medium which are dispersed in a photographic layer to stabilize a color image. In order to prevent a cyan dye image from fading to heat or light, an ultraviolet absorbent is preferably contained in the adjacent layers of a cyan color forming layer.

The photosensitive material of the invention can contain an ultraviolet absorbent. Examples of the absorbent include benzotriazoles substituted with an aryl group (cf., U.S. Pat. No. 3,533,794); 4-thiazolidones (cf., U.S. Pat. Nos. 3,314,794 and No. 3,352,681); benzophenones (cf., Japanese Patent Provisional Publication No. 46(1971)-2784); cinamic esters (cf., U.S. Pat. Nos. 3,705,805 and 3,707,375); butadienes (cf., U.S. Pat. No. 4,045,229); and benzoxydoles (cf., U.S. Pat. No. 3,700,455). A coupler having a function of absorbing an ultraviolet ray (e.g., α-naphthol cyan coupler) and a polymer having the absorbing function are also available. A particular layer can be dyed with the ultraviolet absorbent.

Preferred ultraviolet absorbent is disclosed in VIIIC in Research Disclosure No. 17643. More preferred ultraviolet absorbent has the following formula [UV].

[UV]

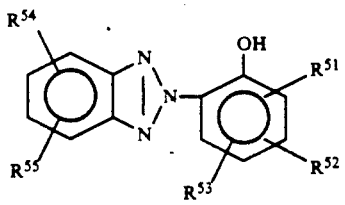

in which $R^{51}$, $R^{52}$, $R^{53}$, $R^{54}$ and $R^{55}$ independently is hydrogen, an alkoxy group, an alkyl group, a halogen atom or an alkoxycarbonyl group.

Examples of the compound having the formula [UV] are described below.

(UV-1)

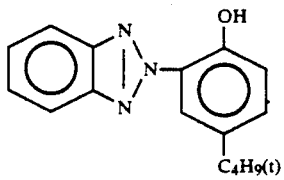

-continued (UV-2)

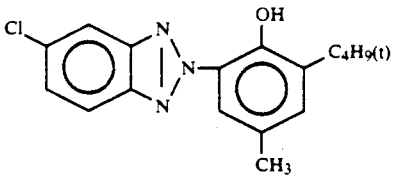

(UV-3)

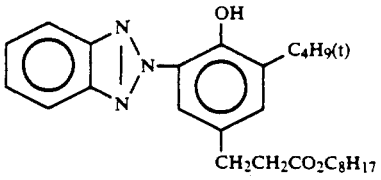

(UV-4)

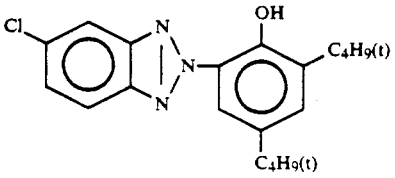

(UV-5)

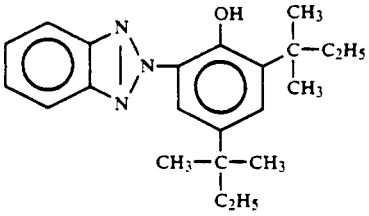

(UV-6)

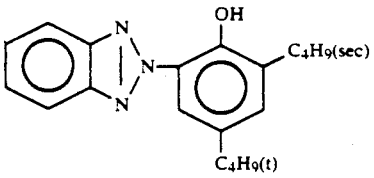

(UV-7)

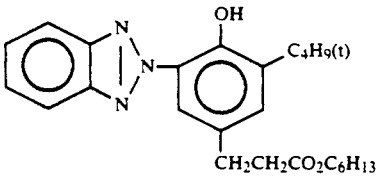

(UV-8)

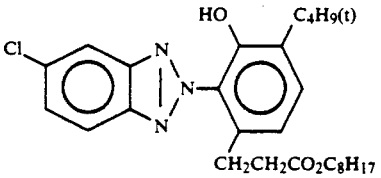

The photosensitive material of the present invention can further contain a water-soluble dye in a hydrophilic colloidal layer as a filter dye or an antiirradiation dye. Examples of the dye include oxonol dyes, hemioxonol dyes, styryl dyes, merocyanine dyes, cyanine dyes and azo dyes. Oxonol dyes, hemioxonol dyes and merocyanine dyes are particularly preferred.

Gelatin is preferably used as a binder or a protective colloid for the emulsion layer of the photosensitive material of the invention. The other hydrophilic polymers can be used singly or in combination with gelatin.

In the present invention, limed gelatin and acid-processed gelatin are available. The process for preparation of gelatin is described in Arther Vice, "The Macromolecular Chemistry of Gelatin" (Academic Press, 1964).

As the support for the photosensitive material of the present invention, a transparent film, such as cellulose nitrate film and polyethylene terephthalate film, and a reflective support are available. The reflective support is preferably used in the present invention.

In the present invention, the reflective support has a function of making clear a dye image formed on the silver halide emulsion layer by the reflection. The reflective support can be prepared by coating a base sheet with a hydrophobic resin which contains reflective substances, such as titanium dioxide, zinc oxide, calcium carbonate, calcium sulfate. The hydrophobic resin in which the reflective substances are dispersed is itself also available as the reflective support. Further, a baryta paper, a paper coated with polyethylene and a polypropylene synthetic paper are available. Examples of the base sheet to be coated with the reflective substances include various transparent materials, such as grass board, polyester film (e.g., polyethylene terephthalate film, cellulose triacetate film and cellulose nitrate film), polyamide film, polycarbonate film, polystyrene film and vinyl chloride film. The support is selected from the above-mentioned materials according to use of the photosensitive material.

It is preferred that the reflective substances, such as white pigments are finely dispersed on the support by mixing the substances and hydrophobic resin with a surface active agent. The surface of the pigments is preferably treated with a di-, tri- or tetrahydric alcohol.

The ratio of the area occupied by the white pigments (%) is determined by measuring the ratio (%) ($R_i$) of the area projected from the particles of the white pigments to a unit area. The observed area has been divided by the unit area (6 $\mu$m × 6 $\mu$m). The coefficient of the variation with respect to the ratio of the occupied area is $s/\overline{R}$ in which "s" means a standard deviation of $R_i$, and "$\overline{R}$" means the average value of $R_i$. The number of the unit areas to be measured is preferably not less than 6. The coefficient of the variation ($s/\overline{R}$) is calculated from the following formula.

$$\sqrt{\frac{\sum_{i=1}^{n}(R_i - R)^2}{n-1}} \Big/ \frac{\sum_{i=1}^{n} R_i}{n}$$

In the present invention, the coefficient of the variation with respect to the ratio of the area occupied by the pigment is preferably not more than 0.15, and more preferably not more than 0.12. When the coefficient is not more than 0.08, the particles are substantially "uniformly" dispersed.

The color photosensitive material of the present invention is preferably processed by color development, bleach-fix and washing (or stabilization). The bleach and the fix can be separately conducted.

In continuous processing, the amount of the replenishing developing solution is preferably as small as possible for saving resources and preventing pollution.

The replenishing amount of the color developing solution is preferably not more than 200 ml per 1 $m^2$ of the photosensitive material, more preferably not more than 120 ml, and most preferably not more than 100 ml. The abovedefined replenishing amount only relates to the amount of the replenishing color developing solution, and does not include the additives which adjust the developing solution to change of the quality and concentration of the solution. Examples of the additives include water which dilutes the condensed solution, preservatives which tend to be degraded, and alkali which keeps the pH value high.

The color developing solution used in the present invention preferably is an alkaline solution which mainly contains an aromatic primary amine color developing agent. Aminophenols and p-phenylenediamines are available as the color developing agent. P-phenylenediamines are particularly preferred. Examples of the developing agent include 3-methyl-4-amino-N,N-diethylaniline, 3-methyl-4-amino-N-ethyl-N-$\beta$-hydroxyethylaniline, 3-methyl-4-amino-N-ethyl-N-methanesulfonamidoethylaniline and 3-ethyl-4-amino-N-ethyl-N-$\beta$-methoxyethylaniline. Sulfate, hydrochloride and p-toluenesulfonate of these compounds are also available. Two or more compounds can be used in combination. The color developing solution generally contains a pH buffer (e.g., carbonate, borate or phosphate of alkali metal) and a development inhibitor or an antifogging agent (e.g., bromide salts, iodide salts, benzimidazoles, benzothiazoles and mercapto compounds). The developing solution can further contain various preservatives (e.g., hydroxyamines, diethylhydroxyamines, hydrazines sulfites, phenylsemicarbazides, triethanolamine, catechol sulfates, triethylenediamine and 1,4-diazabicyclo[2,2,2]octane); organic solvents (e.g., ethylene glycol and diethylene glycol); development accelerators (e.g., benzyl alcohol, polyethylene glycol and tertiary ammonium salts); fogging agents (e.g., dye-forming couplers, competitive couplers and sodium boron hydride); complementary developing agents (e.g., 1-phenyl-3-pyrazolidone); viscosity agents; and chelating agent such as aminopolycarboxylic acids, aminopolyphosphonic acid and phosphorylcarboxylic acids (e.g, ethylenediaminetetraacetic acid, nitrilotriacetic acid, diethylenetriaminepentaacetic acid, cyclohexanediaminetetraacetic acid, hydroxyethylimidinoacetic acid, 1-hydroxyethylidene-1,1-diphosphonic acid, nitrilo-N,N,N-trimethylenephosphonic acid, ethylenediamine-di(o-hydroxyphenyl)acetic acid and the salts thereof).

In a reversal development, a black and white development is usually followed by a color development. The developing solution for the black and white development contains the known black and white developing agents, such as dihydroxybenzenes (e.g., hydroquinone), 3-pyrazolidones (e.g., 1-phenyl-3-pyrazolidone) and aminophenols (e.g., N-methyl-p-aminophenol). These agents can be used in combination.

The pH value of the color developing solution or the black and white developing solution is generally in the range of 9 to 12. The replenishing amount of the developing solution is usually not more than 3 l per 1 $m^2$ of the color photosensitive material. The replenishing amount can be reduced to not more than 500 ml by reducing the concentration of bromide ion in the replenishing solution. When the replenishing amount is reduced, it is preferred to prevent the solution from the evaporation or the air oxidation by minimize the contact surface of the solution to the air. Further, a means of restraining accumulation of bromide ion in the developing solution can be employed to reduce the replenishing amount.

After the color development, the photographic emulsion layer is usually bleached. The bleach can be conducted together with the fix (bleach-fix process). The bleach and the fix can be separately conducted. Further, the bleach process can be followed by the bleach-fix process for rapid development. Furthermore, a continuous processing using two bleaching baths, a fix process followed by a bleach-fix process and a bleach-fix process followed by a bleach process can be employed. As the bleaching agent, compounds of polyvalent metals such as iron (III), cobalt (III), chromium (VI), copper (II), peracids, quinones and nitro compounds are available. Examples of the bleaching agent include ferricyanides; bichromates: organic complexes of iron (III) or cobalt (III), such as complexes of aminopoly carboxylic acids (e.g., ethylenediaminetetraacetic acid, diethylenetriaminepentaacetic acid, cyclohexanediamine tetraacetic acid, methyliminodiacetic acid, diaminopropanetetraacetic acid, glycoletherdiaminetetraacetic acid), citric acid, tartaric acid and malic acid; persulfates; bromates; permanganates; and nitrobenzenes. Iron (III) complexes of aminopolycarboxylic acids (e.g., iron (III) complex of ethylenediaminetetraacetic acid) and persulfates are preferred, since these compounds are advantageous to the rapid processing and the prevention of pollution. Iron (III) complexes of aminopolycarboxylic acids are available in both of bleaching bath and bleach-fix bath. The pH value in the bleaching or bleach-fix bath using the iron (III) complexes of aminopolycarboxylic acids is usually in the range of 5.5 to 8. The pH value can be further lowered for the rapid processing.

A bleaching accelerator can be used in the bleaching bath, the bleach-fix bath or the prebath thereof. Examples of the bleaching accelerator include compounds having a mercapto group or a disulfide group (cf., U.S. Pat. No. 3,893,858, German Patents No. 1,290,812 and No. 2,059,988, Japanese Patent Provisional Publications No. 53(1978)-32736, No. 53(1978)-57831, No. 53(1978)-37418, No. (1978)-72623, No. 53(1978)-95630, No. 53(1978)-95631, No. (1978)-104232, No. 53(1978)-124424 and No. 53(1978)-141623, No. 53(1978)-28426, and Research Disclosure No. 17,129 (July, 1978)); thiazolidine derivatives (cf., Japanese Patent Provisional Publication No. 50(1975)-140129); thiourea derivatives (cf., Japanese Patent Publication No. 45(1970)-8506, Japanese Patent Provisional Publications No. 52(1977)-20832 and No. 53(1978)-32735, and U.S. Pat. No. 3,706,561); iodides (cf., German Patent No. 1,127,715, and Japanese Patent Provisional Publication No. 58(1983)-16235); polyoxyethylene compounds (cf., German Patents No. 996,410 and No. 2,748,430); polyamines (cf., Japanese Patent Publication No. 45(1970)-8836); the other compounds described in Japanese Patent Provisional Publications No. 49(1974)-42434, No. 49(1974)-59644, No. 53(1978)-94927, No. 54(1979)-35727, No. 55(1980)-26506 and No. 58(1983)-163940; and bromide ion. The compounds having a mercapto group or a disulfide group are preferred, since they have a strong effect. The compounds described in U.S. Pat. No. 3,893,858, German Patent No. 1,290,812 and Japanese Patent Provisional Publication No. 53(1978)-95630 are particularly preferred. The compounds described in U.S. Pat. No. 4,552,834 are also preferred. The above-mentioned bleaching accelerator can be added to the photosensitive material. The bleaching accelerator is particularly effective in the bleach-fix process of a color photosensitive material.

Examples of the fixing agent include thiosulfates, thiocyanates, thioethers, thioureas and iodide salts which are used in a relatively large amount. Thiosulfates are usually used. Sodium thiosulfate is particularly available in various fields. Examples of the preservatives for the bleach-fix solution include sulfite salts, bisulfite salts and carbonyl adducts of bisulfite.

In the process of the silver halide color photosensitive material of the present invention, a washing process and/or stabilization process is conducted after a desilvering process. The amount of water in the washing process is determined according to the nature of the photosensitive material (e.g., the nature of the components such as coupler), use of the material, temperature of washing water, the number of washing tanks (washing stages), the replenishing method (countercurrent or not), and the other conditions. The relation between the number of washing tanks and the amount of water in a multistage countercurrent method is described in Journal of the Society of Motion Picture and Television Engineers, vol. 64, p. 248-253 (May, 1955).

According to the multistage countercurrent method described in the above-mentioned document, the amount of washing water can be greatly reduced. However, this method has a disadvantage of increasing the stagnant time of water in a tank. This disadvantage further causes a problem that the propagation of bacteria causes a suspended matter, which is attached to the photosensitive material. In order to solve the problem, the method of reducing the amount of calcium ion and magnesium ion described in Japanese Patent Application No. 61(1986)-131632 is effective. Further, isothiazolone compounds and cyabendazoles described in Japanese Patent Provisional Publication No. 57(1982)-8542, chlorine germicides such as chlorinated sodium isocyanurate, and benzotriazole are available as germicide.

The pH value of washing water in the process of the photosensitive material of the invention preferably is in the range of 4 to 9, and more preferably in the range of 5 to 9. The temperature of washing water and the washing time are determined according to the nature and use of the photosensitive material. The washing process is usually conducted at 15° to 45 ° C. for 20 seconds to 10 minutes, and more preferably at 25° to 40° C. for 30 seconds to 5 minutes. The photosensitive material of the invention can be directly processed by a stabilizer in place of the above-mentioned washing process. The stabilization process can be conducted by the known methods which are described in Japanese Patent Provisional Publications No. 57(1982)-8543, No. 58(1983)-14834 and No. 60(1985)-220345.

The stabilization process can follow the washing process. A example of such process is the last bath of a color photosensitive material, which is a stabilization bath containing formaldehyde and a surface active agent. The stabilization bath can further contain various chelating agents and germicides.

The overflow solution caused by replenishing the washing and/or stabilization solution can be recycled in the other process such as a desilvering process.

The silver halide color photosensitive material of the present invention can contain a color developing agent for simple and rapid processing. The color developing agent is preferably in the form of a precursor to be contained in the photosensitive material. Examples of the precursor of the agent include indoaniline compounds (cf., U.S. Pat. No. 3,342,597), Schiff base compounds (cf., U.S. Pat. No. 3,342,599, and Research Disclosures No. 14,850 and No. 15,159), aldole compounds (cf., Research Disclosure No. 13,924), metal salt complexes (cf., U.S. Pat. No. 3,719,492) and urethane compounds (cf., Japanese Patent Provisional Publication No. 53(1978)-135628).

The silver halide color photosensitive material of the invention can contain various 1-phenyl-3-pyrazolidones to accelerate the color development. Examples of the compounds are described in Japanese Patent Provisional Publications No. 56(1981)-64339, No. 57(1982)-144547 and No. 58(1983)-115438.

In the present invention, the various processing solutions are used at 10° to 50° C., and usually at 33° to 38° C. A higher temperature can be employed to accelerate the process or to shortening the processing time. A lower temperature can also be employed to improve the quality of the image or the stability of the processing solution. To save the amount of silver contained in the photosensitive material, an intensification process using cobalt or hydrogen peroxide is available. The intensification process is described in German Patent No. 2,226,770 and U.S. Pat. No. 3,674,499.

In order to exhibit the excellent character of the silver halide photosensitive material, the material is preferably processed for not more than 2 minutes and 30 seconds using a color developing solution which substantially does not contain benzyl alcohol and contains bromide ion in an amount of not more than 0.002 mole/l.

The term "not contain benzyl alcohol" means the amount of not more than 2 ml per 1 l of the color developing solution. The amount is preferably not more than 0.5 ml. It is most preferred that the developing solution completely does not contain benzyl alcohol.

The present invention is further described by the following examples without limiting the invention.

EXAMPLE 1

A paper was laminated with polyethylene on the both side to prepare a paper support. On the paper support, the following coating solution were coated to prepare a multilayered color photosensitive material.

Preparation of coating solution for the first layer

In 27.2 ml of ethyl acetate, 4.1 g of a solvent (Solv-3) and 4.1 g of a solvent (Solv-2) was dissolved 19.1 g of a yellow coupler (ExY). The solution was emulsified in 185 ml of 10% aqueous gelatin solution containing 8 ml of 10% solution of sodium dodecylbenzenesulfonate. The mean droplet size in the emulsion was adjusted in the range of 0.07 μm to 3.0 μm.

Separately, a silver chlorobromide emulsion (1) which has 80.0 mole % silver bromide content, cubic grain shape, average grain size of 0.85 μm and coefficient of variation of 0.08 was mixed with another silver chlorobromide emulsion (2) which has 80.0 mole % silver bromide content, cubic grain shape, average grain size of 0.62 μm and coefficient of variation of 0.07. The mixing ratio ((1):(2)) was 1:3 as mole of silver. The mixture was sulfur sensitized. To the mixture of the silver halide emulsions was added the following blue sensitive spectral sensitizing dye in the amount of $5.0\times10^{-4}$ mole per 1 mole of silver. The previously prepared emulsion is mixed with the mixture of the silver halide emulsions to prepare a coating solution for the first layer.

The coating solutions for the second to seventh layers were prepared in a similar manner.

As a hardening agent for gelatin in each of the layers, sodium salt of 1-oxy-3,5-dichloro-s-triazine (hardening agent for gelatin) was used.

The following spectral sensitizing dyes were used for the layers.

(Dye for blue sensitive emulsion layer)

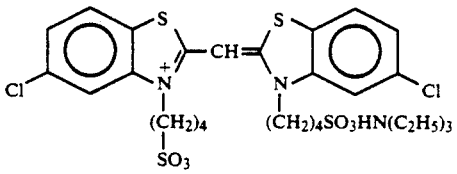

($5.0\times10^{-4}$ mole per 1 mole of silver halide)

(Dye for green sensitive emulsion layer)

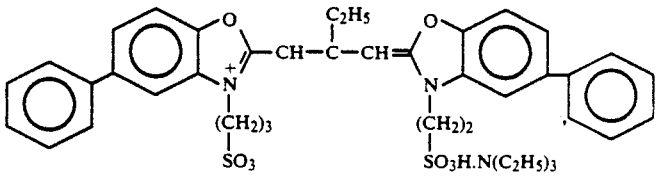

($4.0\times10^{-4}$ mole per 1 mole of silver halide)

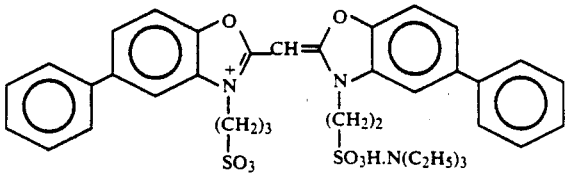

($7.0\times10^{-5}$ mole per 1 mole of silver halide)

(Dye for red sensitive emulsion layer)

-continued

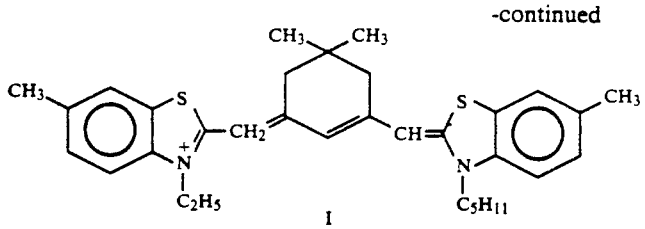

I

To the red sensitive emulsion layer was added $2.6\times10^{-3}$ mole (per 1 mole of silver halide) of the following compound.

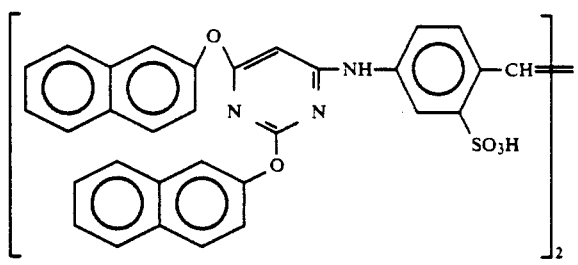

To the blue sensitive emulsion layer was added $4.0\times10^{-6}$ mole (per 1 mole of silver halide) of 1-(5-methylureidophenyl)-5-mercaptotetrazooe. To the green sensitive emulsion layer was added $3.0\times10^{-5}$ mole of 1-(5-methylureidophenyl)-5-mercaptotetrazole. To the red sensitive emulsion layer was added $1.0\times10^{-5}$ mole of 1-(5-methylureidophenyl)-5-mercaptotetrazole.

To the blue sensitive emulsion layer was added $8\times10^{-3}$ mole (per 1 mole of silver halide) of 2-methyl-5-t-octylhydroquinone. To the green sensitive emulsion layer was added $2\times10^{-2}$ mole of 2-methyl-5-t-octylhydroquinone. To the red sensitive emulsion layer was added $2\times10^{-2}$ mole of 2-methyl-5-t-octylhydroquinone.

To the blue sensitive emulsion layer was added $1.2\times10^{-2}$ mole (per 1 mole of silver halide) of 4-hydroxy-6-methyl-1,3,3a,7-tetraazaindene. Further, to the green sensitive emulsion layer was added $1.1\times10^{-2}$ mole of 4-hydroxy-6-methoxy-1,3,3a,7-tetraazaindene.

As antiirradiation dyes, the following compounds were used.

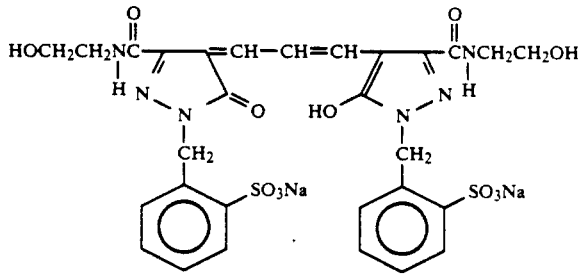

and

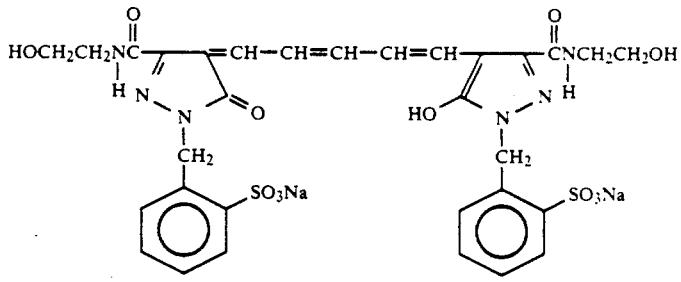

The composition of each of the layers is set forth below. Each of the values means the coating amount ($g/m^2$), except that the values for the silver halide emulsions mean the coating amount of silver.

Support

Paper support (laminated with polyethylene on the both sides of paper)

[the polyethylene lamination on the side of the first layer contains white pigment ($TiO_2$) and blue dye (ultramarine)]

| | |
|---|---|
| The first layer (Blue sensitive layer) | |
| Silver chlorobromide emulsion described above | 0.26 |
| Gelatin | 1.83 |
| Yellow coupler (ExY) | 0.83 |
| Solvent (Solv-3) | 0.18 |
| Solvent (Solv-6) | 0.18 |
| The second layer (Color stain inhibiting layer) | |
| Gelatin | 0.99 |
| Color stain inhibitor (Cpd-6) | 0.08 |
| Solvent (Solv-1) | 0.16 |
| Solvent (Solv-4) | 0.08 |
| The third layer (Green sensitive layer) | |
| Silver chlorobromide emulsion (mixture of a silver chlorobromide emulsion (3) which has 90 mole % silver bromide content, cubic grain shape, average grain size of 0.47 μm and coefficient of variation of 0.12 and another silver chlorobromide emulsion (4) which has 90 mole % silver bromide content, cubic grain shape, average grain size of 0.36 μm and coefficient of variation of 0.09. | 0.16 |

-continued

| | |
|---|---|
| The mixing ratio ((3):(4)) was 1:1 as mole of silver) | |
| Gelatin | 1.79 |
| Magenta coupler (ExM) | 0.32 |
| Color stabilizer (Cpd-3) | 0.20 |
| Color stabilizer (Cpd-4) | 0.01 |
| Color stabilizer (Cpd-8) | 0.03 |
| Color stabilizer (Cpd-9) | 0.04 |
| Solvent (Solv-2) | 0.65 |
| The fourth layer (Ultraviolet absorbing layer) | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| The fifth layer (Red sensitive layer) | |
| Silver chlorobromide emulsion (mixture of a silver chlorobromide emulsion (5) which has 70 mole % silver bromide content, cubic grain shape, average grain size of 0.49 μm and coefficient of variation of 0.08 and another silver chlorobromide emulsion (6) which has 70 mole % | 0.23 |

-continued

| | |
|---|---|
| silver bromide content, cubic grain shape, average grain size of 0.34 μm and coefficient of variation of 0.10. The mixing ratio ((3):(4)) was 1:2 as mole of silver) | |
| Gelatin | 1.34 |
| Cyan coupler (ExC) | 0.30 |
| Color stabilizer (Cpd-6) | 0.17 |
| Color stabilizer (Cpd-7) | 0.40 |
| Solvent (Solv-6) | 0.20 |
| The sixth layer (Ultraviolet absorbing layer) | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| The seventh layer (Protective layer) | |
| Gelatin | 1.33 |
| Acrylated copolymer of polyvinyl alcohol (the acrylated ratio is 17%) | 0.17 |
| Liquid paraffin | 0.03 |

(Cpd-3; Color stabilizer)

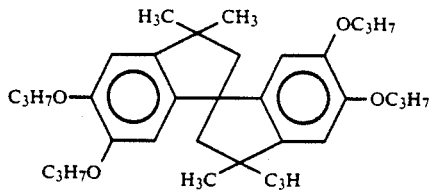

(Cpd-4; Color stabilizer)

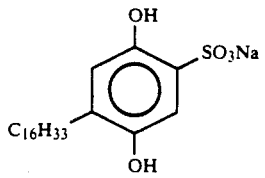

(Cpd-5; Color stain inhibitor)

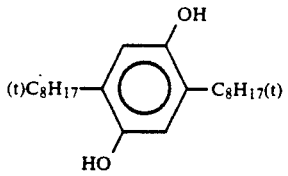

(Cpd-6; Color stabilizer)

Mixture of the following compounds (2:4:4 as weight ratio)

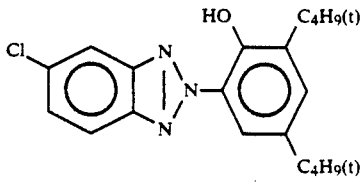

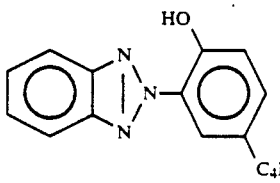

-continued
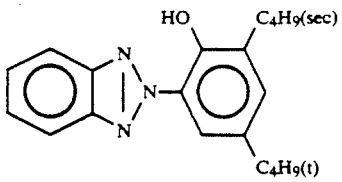
(Cpd-7; Color stabilizer)
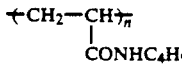
(Average molecular weight is 80,000)
(Cpd-8; Color stabilizer)
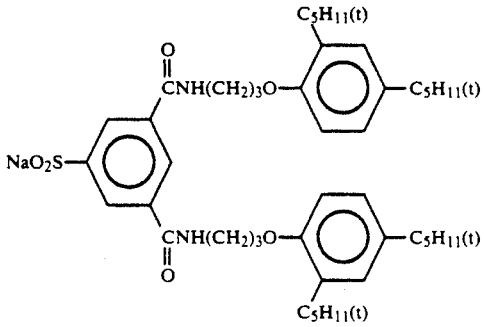
(Cpd-9; Color stabilizer)
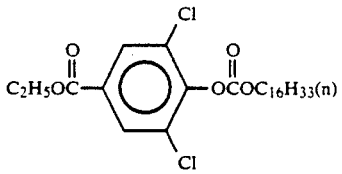
(UV-1; Ultraviolet absorbent)
Mixture of the following compounds (4:2:4 as weight ratio)
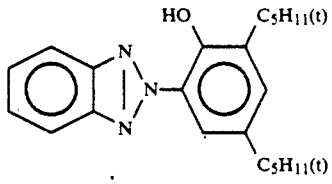
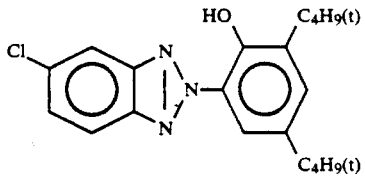
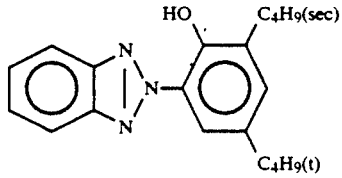
(Solv-1; Solvent)
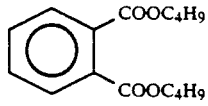

-continued
(Solv-2; Solvent)
Mixture of the following compounds
(2:1 as volume ratio)
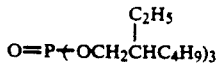
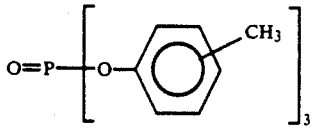
(Solv-3; Solvent)
$O{=}P{\leftarrow}O{-}C_9H_{19}\text{-iso})_3$
(Solv-4; Solvent)
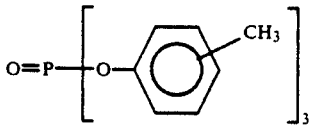
(Solv-5; Solvent)
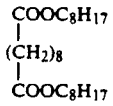
(Solv-6; Solvent)
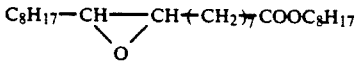
(ExM; Yellow coupler)
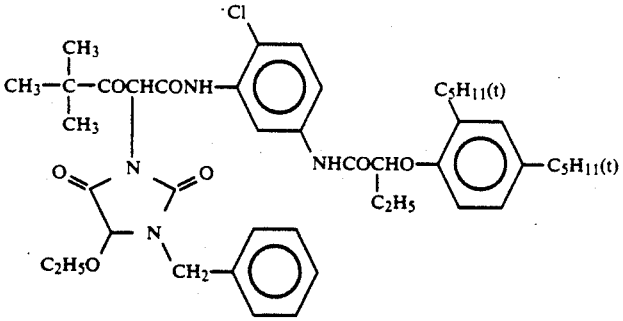
(ExM; Magenta coupler)
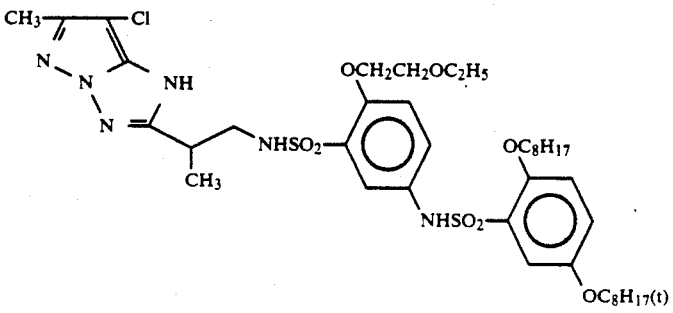
(ExC; Cyan coupler)
Mixture of the following compounds (1:1 as mole ratio)

-continued

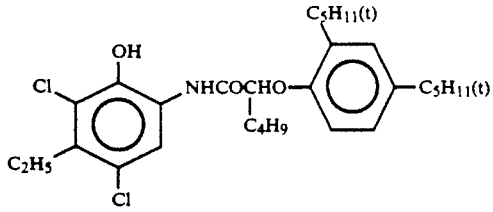

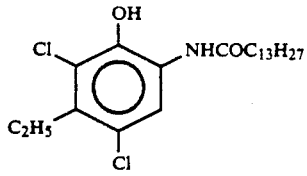

The above-prepared photosensitive material was exposed to light through an optical wedge, and subjected to the following processes.

| Process | Temperature | Time |
|---|---|---|
| Color Development | 37° C. | 3 minutes & 30 seconds |
| Bleach-fix | 33° C. | 1 minute & 30 seconds |
| Washing | 24 to 34° C. | 3 minutes |
| Drying | 70 to 80° C. | 1 minute |

The compositions of each of the processing solution is set forth below.

| | |
|---|---|
| Color developing solution | |
| Water | 800 ml |
| Diethylenetriaminepentaacetic acid | 1.0 g |
| Nitrilotriacetic acid | 2.0 g |
| 1-Hydroxyethylidene-1,1-diphosphonic acid (60% solution) | 1.0 ml |
| Benzyl alcohol | 15 ml |
| Diethylene glycol | 10 ml |
| Sodium sulfite | 2.0 g |
| Potassium bromide | 1.0 g |
| Potassium carbonate | 30 g |
| Sulfonate salt of N-ethyl-N-(β-methane sulfonamidoethyl)-3-methyl-4-aminoaniline | 4.5 g |
| Sulfonate salt of hydroxyamine | 3.0 g |
| Brightening agent (WHITEX4B, produced by Sumitomo Chemical Co., Ltd.) | 1.0 g |
| Water to make up to | 1000 ml |
| pH (25° C.) | 10.25 |
| Bleach-fix solution | |
| Water | 400 ml |
| Ammonium thiosulfate (70% solution) | 150 ml |
| Sodium sulfite | 18 g |
| Ethylenediaminetetraacetic acid iron (III) ammonium salt | 55 g |
| Ethylenediaminetetraacetic acid disodium salt | 5 g |
| Water to make up to | 1000 ml |
| pH (25° C.) | 6.70 |

Thus, a sample A was obtained. The other samples were prepared in the same manner except that the yellow coupler and an additive (color stabilizer) [70 mole % based on the amount of the coupler] contained in the first layer were changed according to the following Table 1. With respect to the sample B(6), the comparative compound (j) was slightly soluble to the solvent (Solv-3 and Solv-6), thus it was difficult to evaluate the sample B(6).

With respect to each of the samples, on which an image had been formed, the photographic quality was measured. Each of the samples was then irradiated with light for 8 days in a xenon tester at 200,000 lux. The yellow density of the image was measured, and the remaining ratio to the density of the image (1.0) before the irradiation was obtained.

The stability to heat was measured by placing the samples at 100° C. for 400 hours. The remaining ratio to the density of the image (1.0) before heating was obtained.

The results are set forth in Table 1. The density was measured using Macbeth's densitometer RD-514 (Status; AA filter).

The "sensitivity" in Table 1 means a relative value of the exposure (for each of the couplers) which is required to give a density of +0.5 as fogging value (log E). The standard value of the exposure (100) was determined when no color image stabilizer was used. The "Dmax" in Table 1 means a relative value of the maximum density (for each of the couplers). The standard value of the density (100) was also determined when no color image stabilizer was used.

In Table 1, the "Remaining Ratio to Light" shows the results of the remaining ratio after irradiation, and the "Remaining Ratio to Light" shows the results of the remaining ratio after heating. Further, the "Remark" indicates whether the experiment is a comparison example (Comp.) or an example of the present invention (Ex.).

TABLE 1

| | | | Quality | | Remaining Ratio | | |
|---|---|---|---|---|---|---|---|
| Sample | Coupler | Stabilizer | Sensitivity | Dmax | Light (%) | Heat (%) | Remark |
| A | ExY | — | 100 | 100 | 68 | 81 | Comp. |
| A(1) | ExY | (a) | 105 | 94 | 70 | 85 | Comp. |
| A(2) | ExY | (b) | 106 | 93 | 71 | 84 | Comp. |
| A(3) | ExY | (c) | 110 | 89 | 69 | 83 | Comp. |
| A(4) | ExY | (d) | 109 | 91 | 70 | 82 | Comp. |
| A(5) | ExY | (e) | 104 | 95 | 72 | 84 | Comp. |
| A(6) | ExY | (f) | 106 | 93 | 76 | 82 | Comp. |
| A(7) | ExY | A-2 | 101 | 100 | 90 | 91 | Ex. |
| A(8) | ExY | A-5 | 100 | 99 | 92 | 91 | Ex. |
| A(9) | ExY | A-16 | 99 | 101 | 87 | 93 | Ex. |
| A(10) | ExY | A-28 | 100 | 100 | 89 | 92 | Ex. |
| A(11) | ExY | A-31 | 101 | 99 | 91 | 90 | Ex. |
| A(12) | ExY | A-35 | 100 | 101 | 90 | 92 | Ex. |
| A(13) | ExY | A-107 | 100 | 100 | 95 | 94 | Ex. |
| A(14) | ExY | A-113 | 101 | 101 | 95 | 94 | Ex. |
| A(15) | ExY | A-118 | 101 | 100 | 96 | 95 | Ex. |
| A(16) | ExY | A-120 | 100 | 99 | 95 | 96 | Ex. |
| A(17) | ExY | A-135 | 100 | 100 | 96 | 94 | Ex. |
| A(18) | ExY | A-136 | 101 | 101 | 94 | 94 | Ex. |
| A(19) | ExY | A-143 | 100 | 100 | 92 | 92 | Ex. |
| A(20) | ExY | A-150 | 101 | 101 | 92 | 91 | Ex. |
| B | Y-5 | — | 100 | 100 | 65 | 79 | Comp. |

TABLE 1-continued

| Sample | Coupler | Stabilizer | Quality: Sensitivity | Quality: Dmax | Remaining Ratio: Light (%) | Remaining Ratio: Heat (%) | Remark |
|---|---|---|---|---|---|---|---|
| B(1) | Y-5 | (a) | 106 | 93 | 68 | 80 | Comp. |
| B(2) | Y-5 | (c) | 109 | 90 | 68 | 81 | Comp. |
| B(3) | Y-5 | (g) | 110 | 89 | 74 | 86 | Comp. |
| B(4) | Y-5 | (h) | 105 | 96 | 76 | 87 | Comp. |
| B(5) | Y-5 | (i) | 107 | 96 | 69 | 81 | Comp. |
| B(6) | Y-5 | (j) | — | — | — | — | Comp. |
| B(7) | Y-5 | A-27 | 100 | 99 | 92 | 93 | Ex. |
| B(8) | Y-5 | A-54 | 101 | 100 | 93 | 94 | Ex. |
| B(9) | Y-5 | A-61 | 100 | 101 | 93 | 94 | Ex. |
| B(10) | Y-5 | A-73 | 100 | 100 | 92 | 93 | Ex. |
| B(11) | Y-5 | A-79 | 99 | 100 | 93 | 95 | Ex. |
| B(12) | Y-5 | A-108 | 100 | 100 | 96 | 95 | Ex. |
| B(13) | Y-5 | A-115 | 101 | 100 | 96 | 96 | Ex. |
| B(14) | Y-5 | A-121 | 101 | 101 | 97 | 95 | Ex. |
| B(15) | Y-5 | A-134 | 99 | 100 | 97 | 96 | Ex. |
| B(16) | Y-5 | A-139 | 100 | 101 | 95 | 97 | Ex. |
| B(17) | Y-5 | A-140 | 100 | 99 | 96 | 95 | Ex. |
| B(18) | Y-5 | A-142 | 101 | 101 | 97 | 96 | Ex. |
| B(19) | Y-5 | A-145 | 100 | 100 | 94 | 95 | Ex. |
| B(20) | Y-5 | A-149 | 101 | 100 | 93 | 94 | Ex. |
| C | Y-12 | — | 100 | 100 | 71 | 78 | Comp. |
| C(1) | Y-12 | (b) | 105 | 95 | 75 | 79 | Comp. |
| C(2) | Y-12 | (c) | 109 | 94 | 71 | 78 | Comp. |
| C(3) | Y-12 | (d) | 107 | 94 | 72 | 79 | Comp. |
| C(4) | Y-12 | A-4 | 100 | 99 | 91 | 92 | Ex. |
| C(5) | Y-12 | A-21 | 101 | 100 | 94 | 90 | Ex. |
| C(6) | Y-12 | A-28 | 100 | 101 | 95 | 93 | Ex. |
| C(7) | Y-12 | A-32 | 100 | 101 | 92 | 91 | Ex. |
| C(8) | Y-12 | A-93 | 100 | 100 | 93 | 91 | Ex. |
| C(9) | Y-12 | A-109 | 100 | 101 | 97 | 95 | Ex. |
| C(10) | Y-12 | A-115 | 100 | 101 | 97 | 96 | Ex. |
| C(11) | Y-12 | A-119 | 101 | 100 | 98 | 96 | Ex. |
| C(12) | Y-12 | A-124 | 101 | 100 | 97 | 95 | Ex. |
| C(13) | Y-12 | A-128 | 100 | 100 | 97 | 96 | Ex. |
| C(14) | Y-12 | A-131 | 100 | 101 | 98 | 96 | Ex. |
| C(15) | Y-12 | A-139 | 101 | 100 | 97 | 95 | Ex. |
| C(16) | Y-12 | A-145 | 100 | 100 | 95 | 93 | Ex. |
| C(17) | Y-12 | A-147 | 101 | 100 | 94 | 93 | Ex. |

(Comparative compound (a))

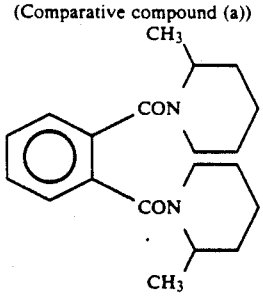

(Described in British Patent No. 1348909)

(Comparative compound (b))

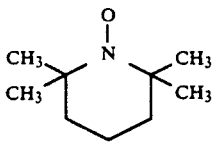

(Described in British Patent No. 1326889)

(Comparative compound (c))

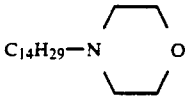

(Described in Japanese Patent Provisional Publications No. 61(1986)-189539 and No. 63(1988)-85547)

(Comparative compound (d))

-continued

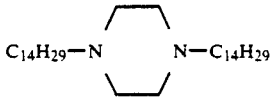

(Described in Japanese Patent Provisional Publications No. 61(1986)-72246 and No. 63(1988)-85547)

(Comparative compound (e))

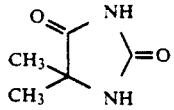

(Described in British Patent No. 1354313)

(Comparative compound (f))

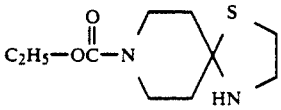

(Described in Japanese Patent Provisional Publication No. 63(1988)-208844)

(Comparative compound (g))

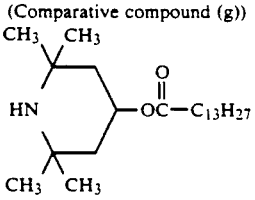

(Described in Japanese Patent Provisional Publication No. 61(1986)-6652)

(Comparative compound (h))

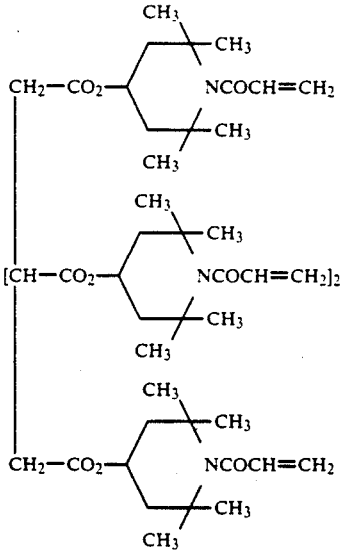

(Described in Japanese Patent Provisional Publication No. 61(1986)-4045)

(Comparative compound (i))

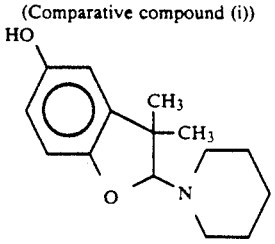

(Described in U.S. Pat. No. 3,184,457)

(Comparative compound (j))

-continued

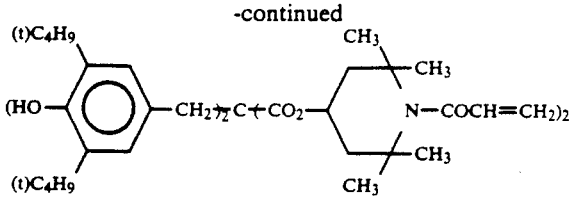

(Described in Japanese Patent Provisional Publications No. 60(1985)-222853 and No. 60(1985)-222854)

(Described in Japanese Patent Provisional Publications No. 60(1985)-222853 and No. 60(1985)-222854)

EXAMPLE 2

Samples D to D(17) were prepared in the same manner as in the preparation of the samples C to C(17) in Example 1, except that the mean droplet size in the emulsion was adjusted in the range of 3.1 μm to 4.0 μm. Samples E to E(17) were also prepared in the same manner, except that the mean droplet size in the emulsion was adjusted in the range of 0.06 μm to 0.04 μm. The obtained samples were evaluated in the same manner as in Example 1. The results are set forth in Table 2.

TABLE 2

| Sample | Coupler | Stabilizer | Remaining Ratio Light (%) | Remaining Ratio Heat (%) | Remark |
|---|---|---|---|---|---|
| D | Y-12 | — | 70 | 77 | Comp. |
| D(1) | Y-12 | (b) | 74 | 78 | Comp. |
| D(2) | Y-12 | (c) | 71 | 77 | Comp. |
| D(3) | Y-12 | (d) | 71 | 78 | Comp. |
| D(4) | Y-12 | A-4 | 83 | 85 | Example |
| D(5) | Y-12 | A-21 | 84 | 84 | Example |
| D(6) | Y-12 | A-28 | 84 | 85 | Example |
| D(7) | Y-12 | A-32 | 83 | 83 | Example |
| D(8) | Y-12 | A-93 | 83 | 84 | Example |
| D(9) | Y-12 | A-109 | 89 | 88 | Example |
| D(10) | Y-12 | A-115 | 89 | 89 | Example |
| D(11) | Y-12 | A-119 | 88 | 89 | Example |
| D(12) | Y-12 | A-124 | 90 | 90 | Example |
| D(13) | Y-12 | A-128 | 89 | 89 | Example |
| D(14) | Y-12 | A-131 | 90 | 88 | Example |
| D(15) | Y-12 | A-139 | 88 | 89 | Example |
| D(16) | Y-12 | A-145 | 85 | 86 | Example |
| D(17) | Y-12 | A-147 | 85 | 86 | Example |
| E(1) | Y-12 | (b) | 74 | 78 | Comp. |
| E(2) | Y-12 | (c) | 71 | 77 | Comp. |
| E(3) | Y-12 | (d) | 71 | 78 | Comp. |
| E(4) | Y-12 | A-4 | 83 | 84 | Example |
| E(5) | Y-12 | A-21 | 83 | 85 | Example |
| E(6) | Y-12 | A-28 | 84 | 84 | Example |
| E(7) | Y-12 | A-32 | 83 | 83 | Example |
| E(8) | Y-12 | A-93 | 84 | 83 | Example |
| E(9) | Y-12 | A-109 | 88 | 87 | Example |
| E(10) | Y-12 | A-115 | 89 | 87 | Example |
| E(11) | Y-12 | A-119 | 88 | 87 | Example |

TABLE 2-continued

| Sample | Coupler | Stabilizer | Remaining Ratio Light (%) | Remaining Ratio Heat (%) | Remark |
|---|---|---|---|---|---|
| E(12) | Y-12 | A-124 | 89 | 90 | Example |
| E(13) | Y-12 | A-128 | 88 | 88 | Example |
| E(14) | Y-12 | A-131 | 89 | 87 | Example |
| E(15) | Y-12 | A-139 | 88 | 87 | Example |
| E(16) | Y-12 | A-145 | 85 | 86 | Example |
| E(17) | Y-12 | A-147 | 85 | 87 | Example |

It is apparent from the results in Examples 1 and 2 that the heterocyclic compounds of the present invention is effective in preventing the color image from light or heat fading, compared with the similar comparison compounds, it is also apparent that the effect of the present invention is increased when the mean particle size of the droplets of the lipophilic medium containing the heterocyclic compound of the invention adjusted in the range of 0.07 μm to 3.0 μm.

EXAMPLE 3

A paper was laminated with polyethylene on the both side to prepare a paper support. On the paper support, the following coating solution were coated to prepare a multilayered color photosensitive material.

Preparation of coating solution for the first layer

In 27.2 ml of methyl acetate and 8.2 g of a solvent (Solv-3) were dissolved 19.1 g of a yellow coupler (ExY), 4.4 g of a color stabilizer (Cpd-1) and 0.7 g of a color stabilizer (Cpd-7). The solution was emulsified in 185 ml of 10% aqueous gelatin solution containing 8 ml of 10% solution of sodium dodecylbenzenesulfonate.

Separately, to a silver chlorobromide emulsion which has 1 mole % silver bromide content on the surface of the grain, cubic grain shape, average grain size of 0.88 μm and coefficient of variation of 0.08 were added the following blue sensitive spectral sensitizing dyes (1) and (2) in the amount of $2.0\times10^{-4}$ mole per the 1 mole of silver respectively. The silver halide emulsion was then sulfur sensitized. The previously prepared emulsion is mixed with the silver halide emulsion to prepare a coating solution for the first layer.

The coating solutions for the second to seventh layers were prepared in a similar manner. The mean droplet size in the emulsion of the fifth layer was adjusted in the range of 0.07 μm to 3.0 μm.

As the hardening agent for the layers, sodium salt of 1-oxy-3,5-dichloro-s-triazine (hardening agent for gelatin) was used.

As the spectral sensitizing dye for each of the layers, the following compounds were used.

[Blue sensitive emulsion layer]

(1)

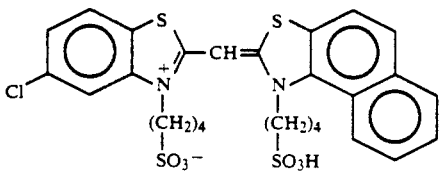

($2.0\times10^{-4}$ mole per 1 mole of silver halide)

-continued (2)

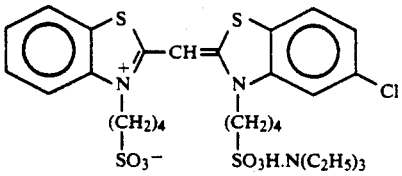

($2.0 \times 10^{-4}$ mole per 1 mole of silver halide)

[Green sensitive emulsion layer]

(1)

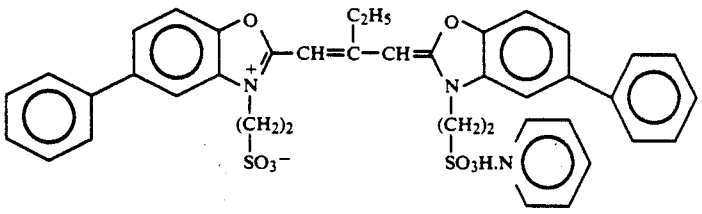

($4.0 \times 10^{-4}$ mole per 1 mole of silver halide)

(2)

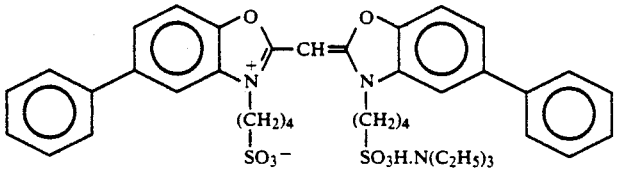

($7.0 \times 10^{-5}$ mole per 1 mole of silver halide)

[Red sensitive emulsion layer]

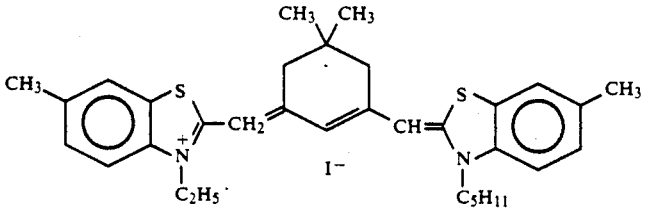

($0.9 \times 10^{-4}$ mole per 1 mole of silver halide)

To the red sensitive emulsion layer was added $2.6 \times 10^{-3}$ mole (per 1 mole of silver halide) of the following compound.

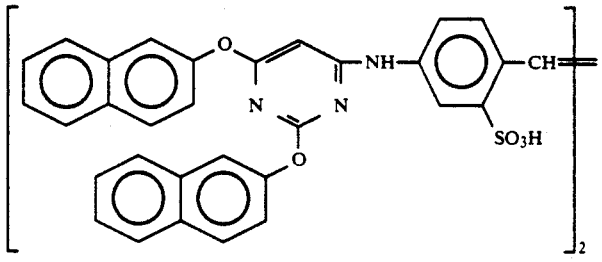

To the blue sensitive emulsion layer was added $8.5 \times 10^{-5}$ mole (per 1 mole of silver halide) of 1-(5-methylureidophenyl)-5-mercaptotetrazole. To the green sensitive emulsion layer was added $7.7 \times 10^{-4}$ mole of 1-(5-methylureidophenyl)-5-mercaptotetrazole. To the red sensitive emulsion layer was added $2.5 \times 10^{-4}$ mole of 1-(5-methylureidophenyl)-5-mercaptotetrazole.

As antiirradiation dyes, dyes, the following compounds were used.

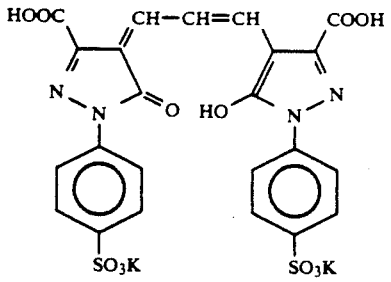

and

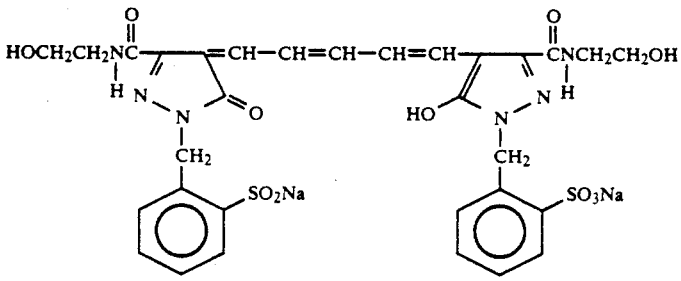

The composition of each of the layers set forth below. Each of the values means the coating amount (g/m$^2$), except that the values for the silver halide emulsions mean the coating amount of silver.

Support

Paper support (laminated with polyethylene on the both sides of paper)

[The polyethylene lamination on the side of the first layer contains white pigment ($TiO_2$) and blue dye (ultramarine)]

| | |
|---|---|
| The first layer (Blue sensitive layer) | |
| Silver chlorobromide emulsion described above | 0.30 |
| Gelatin | 1.86 |
| Yellow coupler (ExY) | 0.82 |
| Color stabilizer (Cpd-1) | 0.19 |
| Color stabilizer (Cpd-7) | 0.03 |
| Solvent (Solv-3) | 0.35 |
| The second layer (Color stain inhibiting layer) | |
| Gelatin | 0.99 |
| Color stain inhibitor (Cpd-5) | 0.08 |
| Solvent (Solv-1) | 0.16 |
| Solvent (Solv-4) | 0.08 |
| The third layer (Green sensitive layer) | |
| Silver chlorobromide emulsion (mixture of a silver chlorobromide emulsion which has 0.8 mole % silver bromide content on the surface of the grain, cubic grain shape, average grain size of 0.55 μm and coefficient of variation of 0.10 and another silver chlorobromide emulsion which has 0.8 mole % silver bromide content on the surface of the grain, cubic grain shape, average grain size of 0.39 μm and coefficient of variation of 0.08. The mixing ratio was 1:3 as mole of silver) | 0.12 |
| Gelatin | 1.24 |

-continued

| | |
|---|---|
| Magenta coupler (ExM) | 0.27 |
| Color stabilizer (Cpd-3) | 0.15 |
| Color stabilizer (Cpd-8) | 0.02 |
| Color stabilizer (Cpd-9) | 0.03 |
| Solvent (Solv-2) | 0.54 |
| The fourth layer (Ultraviolet absorbing layer) | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| The fifth layer (Red sensitive layer) | |
| Silver chlorobromide emulsion (mixture of a silver chlorobromide emulsion which has 0.6 mole % silver bromide content on the surface of the grain, cubic grain shape, average grain size of 0.58 μm and coefficient of variation of 0.09 and another silver chlorobromide emulsion which has 0.6 mole % silver bromide content on the surface of the grain, cubic grain shape, average grain size of 0.45 μm and coefficient of variation of 0.11. The mixing ratio was 1:4 as mole of silver) | 0.23 |
| Gelatin | 1.34 |
| Cyan coupler (ExC) | 0.32 |
| Additive (Cpd-10) | 0.04 |
| Solvent (Solv-6) | 0.15 |
| The sixth layer (Ultraviolet absorbing layer) | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| The seventh layer (Protective layer) | |
| Gelatin | 1.33 |
| Acrylated copolymer of polyvinyl alcohol (the acrylated ratio is 17%) | 0.17 |
| Liquid paraffin | 0.03 |

(ExY; Yellow coupler)

-continued
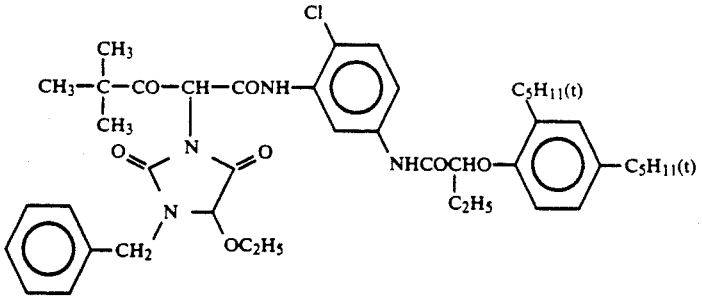
(ExM; Magenta coupler)
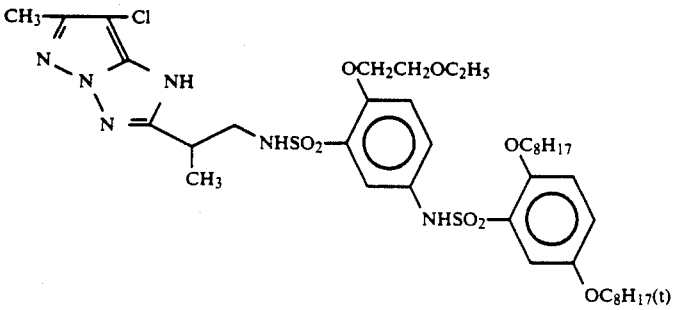
(ExC; Cyan coupler)
Mixture of the following compounds (2:4:4 as weight ratio)
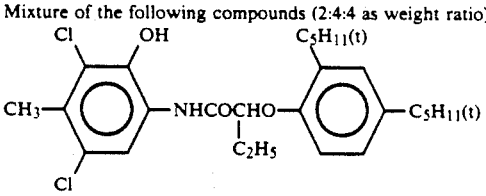
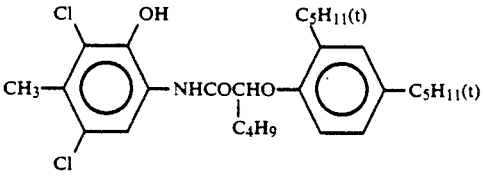
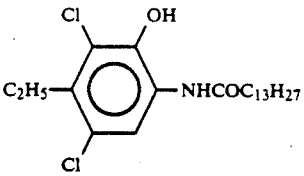
(ExC-1; Cyan coupler)
Mixture of the following compounds (1:1:1 as weight ratio)
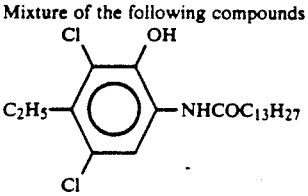
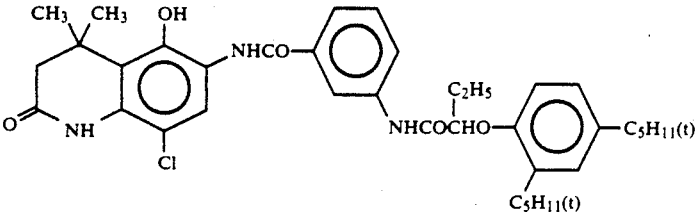

-continued
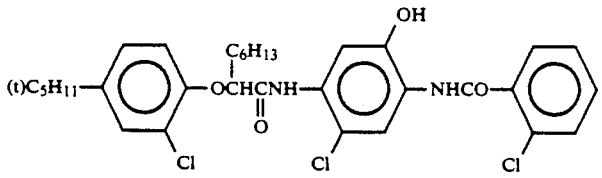
(ExC-2; Cyan coupler)
Mixture of the following compounds (1:1:0.2 as weight ratio)
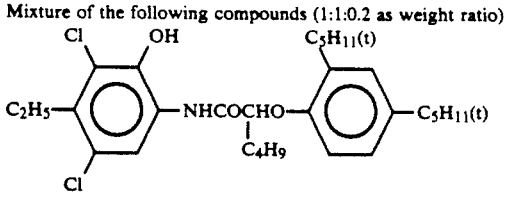
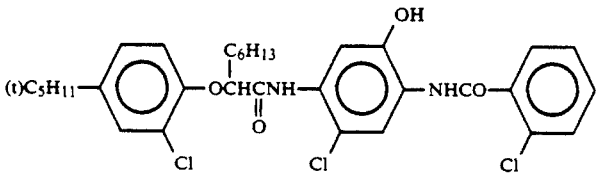
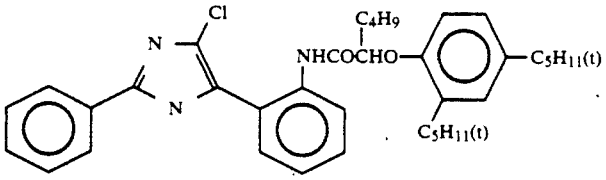
(Cpd-1; Color stabilizer)
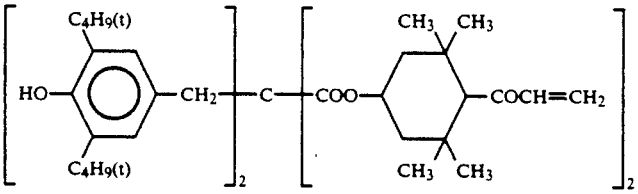
(Cpd-3; Color stabilizer)
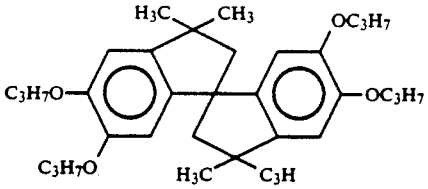
(Cpd-4; Color stabilizer)
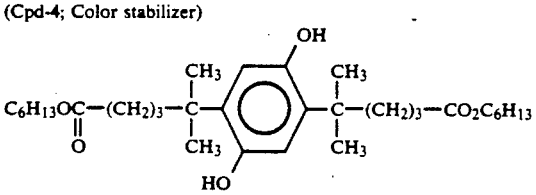
(Cpd-5; Color stain inhibitor)
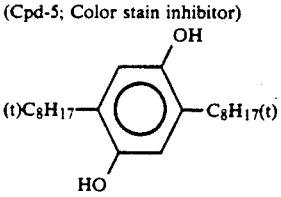
(Cpd-6; Color stabilizer)

-continued
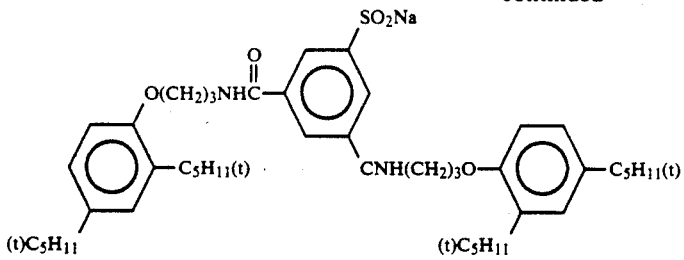
(Cpd-9; Color stabilizer)
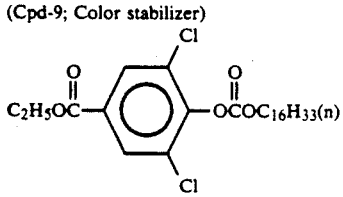
(Cpd-10; Additive)
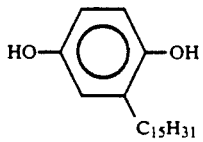
(UV-1; Ultraviolet absorbent)
Mixture of the following compounds (4:2:4 as weight ratio)
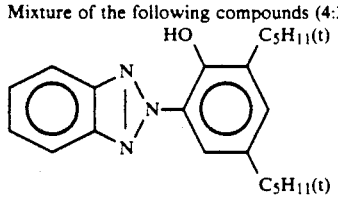
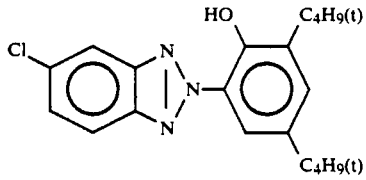
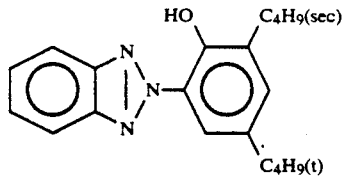
(Solv-1; Solvent)
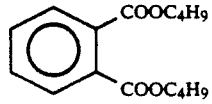
(Solv-2; Solvent)
Mixture of the following compounds (2:1 as volume ratio)
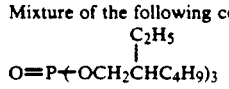
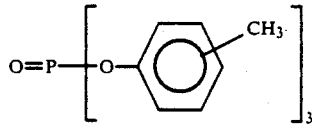
(Solv-3; Solvent)

-continued $O{=}P{+}O{-}C_9H_{19}iso)_3$ (Solv-4; Solvent)

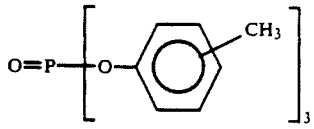

(Solv-5; Solvent)

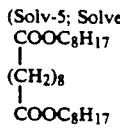

(Solv-6; Solvent)

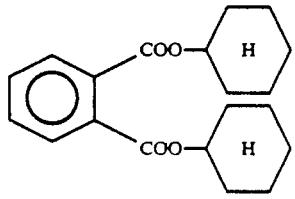

The above-prepared photosensitive material was exposed to light through an optical wedge, and subjected to the following processes.

| Process | Temperature | Time |
|---|---|---|
| Color Development | 35° C. | 45 seconds |
| Bleach-fix | 35° C. | 45 seconds |
| Washing (1) | 35° C. | 30 seconds |
| Washing (2) | 35° C. | 30 seconds |
| Washing (3) | 35° C. | 30 seconds |
| Drying | 75° C. | 60 seconds |

| | |
|---|---|
| Color developing solution | |
| Water | 800 ml |
| Ethylenediamine-N,N,N',N'-tetramethylene-phosphonic acid | 3.0 g |
| Triethanolamine | 8.0 g |
| Sodium chloride | 1.4 g |
| Potassium carbonate | 25 g |
| Sulfonate salt of N-ethyl-N-(β-methane-sulfonamidoethyl) 3-methyl-4-aminoaniline | 5.0 g |
| N,N-bis(carboxymethyl)hydrazine | 5.0 g |
| Brightening agent (WHITEX4B, produced by Sumitomo Chemical Co., Ltd.) | 1.0 g |
| Water to make up to | 1000 ml |
| pH (25° C.) | 10.05 |
| Bleach-fix solution | |
| Water | 700 ml |
| Ammonium thiosulfate solution (700 g/l) | 100 ml |
| Ammonium sulfite | 18 g |
| Ethylenediaminetetraacetic acid iron (III) ammonium salt | 55 g |
| Ethylenediaminetetraacetic acid disodium salt | 3 g |
| Ammonium bromide | 40 g |
| Glacial acetic acid | 8 g |
| Water to make up to | 1000 ml |
| pH (25° C.) | 5.5 |

Deionized water was used for washing process. Water was deionized to contain calcium and magnesium ions in an amount of not more than 3 ppm (conductivity at 25° C. was 5 μs/cm).

Thus, a sample F was obtained. The other samples were prepared in the same manner except that the cyan coupler and a color stabilizer [50 mole % based on the amount of the coupler] contained in the fifth layer were changed according to the following Table 3.

With respect to each of the samples, on which an image had been formed, the photographic quality was measured. Each of the samples was then irradiated with light for 12 days in a xenon tester at 200,000 lux. The cyan density of the image was measured, and the remaining ratio to the density of the image (1.0) before the irradiation was obtained. With respect to a yellow stain on the white ground, the increased value of the yellow density was measured.

The results are set forth in Table 3. The "sensitivity" in Table 3 means a relative value of the exposure (for each of the couplers) which is required to give a density of +0.5 as fogging value (log E). The standard value of the exposure (100) was determined when no color image stabilizer was used. The "Dmax" in Table 3 means a relative value of the maximum density (for each of the couplers). The standard value of the density (100) was also determined when no color image stabilizer was used.

In the Table 3, the "Ratio" of the "Stability to Light" shows the results of the remaining ratio after irradiation. Further, the "Remark" indicates whether the experiment is a comparison example (Comp.) or an example of the present invention (Ex.).

TABLE 3

| | | | Quality | | Stability to Light | | |
|---|---|---|---|---|---|---|---|
| Sample | Coupler | Stabilizer | Sensitivity | Dmax | Ratio | Yellow Stain | Remark |
| F | ExC | — | 100 | 100 | 64 | +0.17 | Comp. |
| F(1) | ExC | (a) | 104 | 96 | 65 | +0.16 | Comp. |
| F(2) | ExC | (b) | 105 | 95 | 66 | +0.17 | Comp. |
| F(3) | ExC | (c) | 107 | 95 | 66 | +0.18 | Comp. |
| F(4) | ExC | (d) | 107 | 96 | 65 | +0.18 | Comp. |
| F(5) | ExC | (e) | 106 | 96 | 67 | +0.17 | Comp. |
| F(6) | ExC | (f) | 106 | 95 | 70 | +0.16 | Comp. |
| F(7) | ExC | A-3 | 100 | 99 | 83 | +0.10 | Ex. |
| F(8) | ExC | A-16 | 101 | 100 | 84 | +0.09 | Ex. |
| F(9) | ExC | A-27 | 101 | 101 | 86 | +0.11 | Ex. |
| F(10) | ExC | A-35 | 100 | 100 | 87 | +0.10 | Ex. |
| F(11) | ExC | A-36 | 100 | 100 | 85 | +0.09 | Ex. |
| F(12) | ExC | A-107 | 100 | 100 | 91 | +0.07 | Ex. |

TABLE 3-continued

| Sample | Coupler | Stabilizer | Quality: Sensitivity | Quality: Dmax | Stability to Light: Ratio | Stability to Light: Yellow Stain | Remark |
|---|---|---|---|---|---|---|---|
| F(13) | ExC | A-108 | 101 | 100 | 90 | +0.07 | Ex. |
| F(14) | ExC | A-110 | 101 | 101 | 92 | +0.08 | Ex. |
| F(15) | ExC | A-126 | 100 | 100 | 92 | +0.07 | Ex. |
| F(16) | ExC | A-129 | 101 | 100 | 91 | +0.07 | Ex. |
| F(17) | ExC | A-133 | 100 | 100 | 92 | +0.08 | Ex. |
| F(18) | ExC | A-137 | 101 | 100 | 93 | +0.07 | Ex. |
| F(19) | ExC | A-143 | 100 | 101 | 89 | +0.07 | Ex. |
| F(20) | ExC | A-145 | 100 | 101 | 88 | +0.06 | Ex. |
| F(21) | ExC | A-150 | 100 | 100 | 89 | +0.07 | Ex. |
| G | ExC-1 | — | 100 | 100 | 62 | +0.16 | Comp. |
| G(1) | ExC-1 | (c) | 106 | 96 | 65 | +0.17 | Comp. |
| G(2) | ExC-1 | (g) | 107 | 94 | 70 | +0.15 | Comp. |
| G(3) | ExC-1 | (h) | 105 | 96 | 71 | +0.15 | Comp. |
| G(4) | ExC-1 | (i) | 106 | 95 | 64 | +0.16 | Comp. |
| G(5) | ExC-1 | (j) | 105 | 96 | 72 | +0.15 | Comp. |
| G(6) | ExC-1 | A-8 | 99 | 100 | 87 | +0.09 | Ex. |
| G(7) | ExC-1 | A-18 | 100 | 101 | 85 | +0.11 | Ex. |
| G(8) | ExC-1 | A-54 | 100 | 99 | 86 | +0.10 | Ex. |
| G(9) | ExC-1 | A-57 | 99 | 100 | 84 | +0.09 | Ex. |
| G(10) | ExC-1 | A-62 | 100 | 101 | 86 | +0.10 | Ex. |
| G(11) | ExC-1 | A-109 | 100 | 100 | 90 | +0.06 | Ex. |
| G(12) | ExC-1 | A-121 | 101 | 100 | 91 | +0.07 | Ex. |
| G(13) | ExC-1 | A-126 | 101 | 100 | 90 | +0.07 | Ex. |
| G(14) | ExC-1 | A-131 | 100 | 101 | 92 | +0.06 | Ex. |
| G(15) | ExC-1 | A-134 | 100 | 101 | 91 | +0.07 | Ex. |
| G(16) | ExC-1 | A-142 | 100 | 100 | 92 | +0.06 | Ex. |
| G(17) | ExC-1 | A-144 | 100 | 101 | 89 | +0.08 | Ex. |
| G(18) | ExC-1 | A-148 | 101 | 100 | 89 | +0.07 | Ex. |
| H | ExC-2 | — | 100 | 100 | 50 | +0.23 | Comp. |
| H(1) | ExC-2 | (a) | 105 | 95 | 52 | +0.20 | Comp. |
| H(2) | ExC-2 | (e) | 106 | 95 | 54 | +0.22 | Comp. |
| H(3) | ExC-2 | (f) | 106 | 94 | 57 | +0.19 | Comp. |
| H(4) | ExC-2 | A-10 | 100 | 99 | 87 | +0.10 | Ex. |
| H(5) | ExC-2 | A-22 | 99 | 100 | 88 | +0.09 | Ex. |
| H(6) | ExC-2 | A-56 | 100 | 101 | 89 | +0.10 | Ex. |
| H(7) | ExC-2 | A-79 | 100 | 100 | 88 | +0.11 | Ex. |
| H(8) | ExC-2 | A-83 | 99 | 100 | 87 | +0.10 | Ex. |
| H(9) | ExC-2 | A-21 | 101 | 101 | 92 | +0.06 | Ex. |
| H(10) | ExC-2 | A-68 | 100 | 99 | 92 | +0.06 | Ex. |
| H(11) | ExC-2 | A-108 | 101 | 100 | 93 | +0.05 | Ex. |
| H(12) | ExC-2 | A-111 | 100 | 100 | 94 | +0.06 | Ex. |
| H(13) | ExC-2 | A-120 | 101 | 101 | 93 | +0.06 | Ex. |
| H(14) | ExC-2 | A-123 | 100 | 100 | 92 | +0.05 | Ex. |
| H(15) | ExC-2 | A-28 | 101 | 100 | 90 | +0.07 | Ex. |
| H(16) | ExC-2 | A-52 | 100 | 101 | 90 | +0.07 | Ex. |
| H(17) | ExC-2 | A-66 | 100 | 101 | 89 | +0.06 | Ex. |

EXAMPLE 4

Samples J to J(17) were prepared in the same manner as in the preparation of the samples H to H(17) in Example 3, except that the mean droplet size in the emulsion was adjusted in the range of 3.1 μm to 4.0 μm. Samples K(1) to K(17) were also prepared in the same manner, except that the mean droplet size in the emulsion was adjusted in the range of 0.06 μm to 0.04 μm. The obtained samples were evaluated in the same manner as in Example 3. The results are set forth in Table 4.

TABLE 4

| Sample | Coupler | Stabilizer | Stability to light: Ratio | Stability to light: Yellow Stain | Remark |
|---|---|---|---|---|---|
| J | ExC-2 | — | 49 | +0.23 | Comp. |
| J(1) | ExC-2 | (a) | 51 | +0.20 | Comp. |
| J(2) | ExC-2 | (e) | 53 | +0.22 | Comp. |
| J(3) | ExC-2 | (f) | 56 | +0.20 | Comp. |
| J(4) | ExC-2 | A-10 | 79 | +0.15 | Example |
| J(5) | ExC-2 | A-22 | 80 | +0.14 | Example |
| J(6) | ExC-2 | A-56 | 80 | +0.16 | Example |
| J(7) | ExC-2 | A-79 | 79 | +0.14 | Example |
| J(8) | ExC-2 | A-83 | 79 | +0.15 | Example |
| J(9) | ExC-2 | A-21 | 85 | +0.09 | Example |

TABLE 4-continued

| Sample | Coupler | Stabilizer | Stability to light: Ratio | Stability to light: Yellow Stain | Remark |
|---|---|---|---|---|---|
| J(10) | ExC-2 | A-68 | 86 | +0.09 | Example |
| J(11) | ExC-2 | A-108 | 84 | +0.10 | Example |
| J(12) | ExC-2 | A-111 | 85 | +0.10 | Example |
| J(13) | ExC-2 | A-120 | 84 | +0.11 | Example |
| J(14) | ExC-2 | A-123 | 84 | +0.10 | Example |
| J(15) | ExC-2 | A-28 | 82 | +0.12 | Example |
| J(16) | ExC-2 | A-52 | 83 | +0.12 | Example |
| J(17) | ExC-2 | A-66 | 82 | +0.11 | Example |
| K(1) | ExC-2 | (a) | 50 | +0.21 | Comp. |
| K(2) | ExC-2 | (e) | 54 | +0.22 | Comp. |
| K(3) | ExC-2 | (f) | 55 | +0.19 | Comp. |
| K(4) | ExC-2 | A-10 | 80 | +0.14 | Example |
| K(5) | ExC-2 | A-22 | 79 | +0.15 | Example |
| K(6) | ExC-2 | A-56 | 80 | +0.16 | Example |
| K(7) | ExC-2 | A-79 | 80 | +0.14 | Example |
| K(8) | ExC-2 | A-83 | 79 | +0.14 | Example |
| K(9) | ExC-2 | A-21 | 84 | +0.10 | Example |
| K(10) | ExC-2 | A-68 | 85 | +0.10 | Example |
| K(11) | ExC-2 | A-108 | 84 | +0.09 | Example |
| K(12) | ExC-2 | A-111 | 84 | +0.09 | Example |
| K(13) | ExC-2 | A-120 | 84 | +0.10 | Example |
| K(14) | ExC-2 | A-123 | 84 | +0.09 | Example |
| K(15) | ExC-2 | A-28 | 82 | +0.12 | Example |
| K(16) | ExC-2 | A-52 | 82 | +0.11 | Example |
| K(17) | ExC-2 | A66 | 83 | +0.11 | Example |

It is apparent from the results in Examples 3 and 4 that the heterocyclic compounds of the present invention is effective in preventing the color image from light or heat fading, compared with the similar comparison compounds. It is also apparent that the effect of the present invention is increased when the mean particle size of the droplets of the lipophilic medium containing the heterocyclic compound of the invention adjusted in the range of 0.07 μm to 3.0 μm.

EXAMPLE 5

A paper was laminated with polyethylene on the both side to prepare a paper support. On the paper support, the following coating solution were coated to prepare a multilayered color paper.

Preparation of coating solution for the first layer

In 150 ml of methyl acetate, 1.0 ml of a solvent (Solv-3) and 3.0 ml of a solvent (Solv-4) were dissolved 60.0 g of a yellow coupler (ExY) and 28.0 g of a color stabilizer (Cpd-1). The solution was emulsified in 450 ml of 10% aqueous gelatin solution containing solution of sodium dodecylbenzenesulfonate. The emulsion was stirred in an ultrasonic homogenizer.

Separately, to a silver chlorobromide emulsion which has 0.7 mole % silver bromide content was added the following blue sensitive spectral sensitizing dye. The previously prepared emulsion is mixed with 420 g of the silver chlorobromide emulsion to prepare a coating solution for the first layer.

The coating solutions for the second to seventh layers were prepared in a similar manner.

As the hardening agent for gelatin in each of the layers, sodium salt of 1,2-bis(vinylsulfonyl)ethane was used.

As the spectral sensitizing dyes for each of the layers, the following compounds were used:

Blue sensitive emulsion layer: anhydro-5,5,-dichloro-3,3'-disulfoethylthiacyaninehydroxide;

Green sensitive emulsion layer: anhydro-9-ethyl-5,5'-diphenyl-3,3'-disulfoethyloxacarbocyanineoxide; and Red sensitive emulsion layer: 3,3'-diethyl-5-methoxy-9,9'-(2,2'-dimethyl-1,3-propano)thiacarbocyanineiodide.

As the stabilizer for each of the emulsion layers, the mixture of the following compounds (1), (2) and (3) was used ((1):(2):(3)=7:2:1 as mole ratio: (1) 1-(2-acetoaminophenyl)-5-mercaptotetrazole; (2) 1-phenyl-5-mercaptotetrazole; and (3) 1-(p-methoxyphenyl)-5-mercaptoterazole.

As the antiirradiation dye, the following compounds were used:

(i) disodium [3-carboxy-5-hydroxy-4-(3-(3-carboxy-5-oxo-1-(2,5-disulfonatephenyl)-2-pyrazolidone-1-indene)-1-propenyl)-1-pyrazoryl]benzene-2,5-disulfonate;

(ii) tetrasodium N,N,-(4,8-dihydroxy-9,10-dioxo-3,7-disulfonateanthracene-1,5-diyl)bis(aminomethanesulfonate); and (iii)sodium [3-cyano-5-hydroxy-4-(3-(3-cyano-5-oxo-1-(4-sulfonatephenyl)-2-pyrazoline-4-indene)-1-pentanyl)-1-pyrazolyl]benzene-4-sulfonate.

The composition of each of the layers set forth below. Each of the values means the coating amount ($g/m^2$), except that the values for the silver halide emulsions mean the coating amount of silver.

Support

Paper support (laminated with polyethylene on the both sides of paper)

| | |
|---|---|
| **The first layer (Blue sensitive layer)** | |
| Silver chlorobromide emulsion described above, which has has 0.7 mole % silver bromide content, cubic grain shape and average grain size of 0.9 μm | 0.29 |
| Gelatin | 1.80 |
| Yellow coupler (ExY) | 0.60 |
| Color stain inhibitor (Cpd-1) | 0.28 |
| Solvent (Solv-3) | 0.01 |
| Solvent (Solv-4) | 0.03 |
| **The second layer (Color stain inhibiting layer)** | |
| Gelatin | 0.80 |
| Color stain inhibitor (Cpd-2) | 0.055 |
| Solvent (Solv-1) | 0.03 |
| Solvent (Solv-2) | 0.015 |
| **The third layer (Green sensitive layer)** | |
| Silver chlorobromide emulsion which has has 0.7 mole % silver bromide content, cubic grain shape and average grain size of 0.45 μm | 0.305 |
| Gelatin | 1.40 |
| Magenta coupler (ExM) | 0.67 |
| Compound (A-10) of the present invention | 0.23 |
| Solvent (Solv-1) | 0.20 |
| Solvent (Solv-2) | 0.02 |
| **The fourth layer (Color stain inhibiting layer)** | |
| Gelatin | 1.70 |
| Color stain inhibitor (Cpd-2) | 0.065 |
| Ultraviolet absorbent (UV-1) | 0.45 |
| Ultraviolet absorbent (UV-2) | 0.23 |
| Solvent (Solv-1) | 0.05 |
| Solvent (Solv-2) | 0.05 |
| **The fifth layer (Red sensitive layer)** | |
| Silver chlorobromide emulsion which has has 4 mole % silver bromide content, cubic grain shape and average grain size of 0.5 μm | 0.21 |
| Gelatin | 1.80 |
| Cyan coupler (ExC-1) | 0.26 |
| Cyan coupler (ExC-2) | 0.12 |
| Color stabilizer (Cpd-1) | 0.20 |
| Solvent (Solv-1) | 0.16 |
| Solvent (Solv-1) | 0.09 |
| **The sixth layer (Ultraviolet absorbing layer)** | |
| Gelatin | 0.70 |
| Ultraviolet absorbent (UV-1) | 0.26 |
| Ultraviolet absorbent (UV-1) | 0.07 |
| Solvent (Solv-1) | 0.30 |
| Solvent (Solv-2) | 0.09 |

-continued

| | |
|---|---|
| **The seventh layer (Protective layer)** | |
| Gelatin | 1.07 |

(ExY; Yellow Coupler)

α-Pivalyl-α-(3-benzyl-1-hydantoinyl)-2-chloro-5-[β-(docecylsulfonyl)butylamido]acetoanilide (ExM; Magenta Coupler)

1-(2,4,6-Trichlorophenyl)-3-[2-chloro-5-(3-octenylsuccinimido)anilino]-5-pyrazolone (ExC-1; Cyan Coupler)

2-Pentafluorobenzamido-4-chloro-5-[2-(2,4-di-tertamylphenozy)-3-methylbutylamido]phenol (ExC-2; Cyan Coupler)

2,4-Dichloro-3-methyl-6-[a-(2,4-di-tert-amylphenoxy)butylamido]phenol (Cpd-1; Color stain inhibitor)

2,5-Di-tert-amylphenyl-3,5-di-tert-butylhydroxybenzoate (Cpd-2; Color stain inhibitor)

2,5-Di-tert-octylhydroquinone (Cpd-5; Color stain inhibitor)

p-(p-Toluenesulfonamido)-phenyl-dodeon (Solv-1; Solvent)

Di(2-ethylhexyl)phthalate (Solv-2; Solvent)

Dibutylphthalate (Solv-3; Solvent)

Di-(i-nonyl)phthalate (Solv-4; Solvent)

N,N-Diethylcarbonamido-methoxy-2,4-di-t-aminobenzene (UV-1; Ultraviolet absorbent)

2-(2-Hydroxy-3,5-di-tert-amylphenyl)benzotriazole (UV-1; Ultraviolet absorbent)

2-(2-Hydroxy-3,5-di-tert-butylphenyl)benzotriazole

The above-prepared photosensitive material was exposed to light through an optical wedge, and subjected to the following processes.

| Process | Temperature | Time |
|---|---|---|
| Color Development | 35° C. | 45 seconds |
| Bleach-fix | 30 to 36° C. | 45 seconds |
| Stabilization (1) | 30 to 37° C. | 20 seconds |
| Stabilization (2) | 30 to 37° C. | 20 seconds |
| Stabilization (3) | 30 to 37° C. | 20 seconds |
| Stabilization (4) | 30 to 37° C. | 30 seconds |
| Drying | 70 to 85° C. | 60 seconds |

The stabilization processes were conducted according to a countercurrent method using four tanks in the order of (4) to (1).

The composition of each of the processing solution is set forth below.

| | |
|---|---|
| **Color developing solution** | |
| Water | 800 ml |
| Ethylenediaminetetraacetic acid | 2.0 g |
| Triethanolamine | 8.0 g |
| Sodium chloride | 1.4 g |
| Potassium carbonate | 25.0 g |
| Sulfonate salt of N-ethyl-N-(β-methanesulfonamidoethyl)-3-methyl-4-aminoaniline | 5.0 g |
| N,N-Diethylhydroxylamine | 4.2 g |
| 5,6-Dihydroxybenzene-1,2,4-trisulfonic acid | 0.3 g |
| Brightening agent (4,4'-diaminostylene compound | 2.0 g |

-continued

| | |
|---|---|
| Water to make up to | 1000 ml |
| pH (25° C.) | 10.10 |
| Bleach-fix solution | |
| Water | 400 ml |
| Ammonium thiosulfate solution (70%) | 100 ml |
| Ammonium sulfite | 18.0 g |
| Ethylenediaminetetraacetic acid iron (III) ammonium salt | 55.0 g |
| Ethylenediaminetetraacetic acid disodium salt | 3.0 g |
| Glacial acetic acid | 8.0 g |
| Water to make up to | 1000 ml |
| pH (25° C.) | 5.5 |
| Stabilization solution | |
| Formaldehyde (37% solution) | 0.1 g |
| Thiosulfate adducts of formaldehyde | 0.7 g |
| 5-Chloro-2-methyl-4-isothiazoline-3-on | 0.02 g |
| 2-Methyl-4-isothiazoline-3-on | 0.01 g |
| Copper sulfate | 0.005 g |
| Water to make up to | 1000 ml |
| pH (25° C.) | 4.0 |

Thus, a sample L was obtained. The other samples were prepared in the same manner except that the compounds of the present invention (A-55), (A-61), (A-70), (A-76), (A-93), (A-107), (A-108), (A-111), (A-130), (A-149) and (a-150) were respectively used in an amount of 50mole % based on the amount of the coupler in the first layer. The mean droplet size in the emulsion was adjusted in the range of 0.07 μm to 3.0 μm.

The obtained samples were examined with respect to the stability to light and heat as in Example 1. As the results, the photosensitive materials of the present invention show an excellent stability to light and heat.

EXAMPLE 6

A paper was laminated with polyethylene on the both side to prepare a paper support. On the paper support, the following first to twelfth layers were provided to prepare a color photosensitive material. The polyethylene lamination on the side of the first layer contains white pigment ($TiO_2$) and blue dye (ultramarine).

The composition of each of the layers is set forth below. Each of the values means the coating amount ($g/m^2$), except that the values for the silver halide emulsions mean the coating amount of silver.

| | |
|---|---|
| The first layer (Gelatin layer) | |
| Gelatin | 1.30 |
| The second layer (Antihalation layer) | |
| Black colloidal silver | 0.10 |
| Gelatin | 0.70 |
| The third layer (Red low sensitive layer) | |
| Silver chloroiodobromide emulsion EM1 (which has 1 mole % silver chloride content, 4 mole % silver bromide content, average grain size of 0.3 μm and coefficient of variation of 10%, cubic grain shape and a core/shell structure wherein the iodide content in the core is high) sensitized with red spectral sensitizing dyes (ExS-1,2 and 3) | 0.06 |
| Silver iodobromide emulsion EM2 (which has 5 mole % silver iodide content, average grain size of 0.45 μm and coefficient of variation of 20% and tabular grain shape (aspect ratio is 5)) sensitized with red spectral sensitizing dyes (ExS-1,2 and 3) | 0.10 |
| Gelatin | 1.00 |
| Cyan coupler (ExC-1) | 0.14 |
| Cyan coupler (ExC-2) | 0.07 |
| Color stabilizer (Cpd-2,3,4 and 9, same amount) | 0.12 |
| Medium for dispersing coupler (Cpd-5) | 0.03 |
| Solvent for coupler (Solv-1, 2 and 3) | 0.06 |
| The fourth layer (Red high sensitive layer) | |
| Silver iodobromide emulsion EM3 (which has 6 mole % silver iodide content, average grain size of 0.75 μm and coefficient of variation of 25%, tabular grain shape (aspect ratio is 8) and the iodide content in the core) sensitized with red spectral sensitizing dyes (ExS-1,2 and 3) | 0.15 |
| Gelatin | 1.00 |
| Cyan coupler (ExC-1) | 0.20 |
| Cyan coupler (ExC-2) | 0.10 |
| Color stabilizer (Cpd-2,3,4 and 9, same amount) | 0.15 |
| Medium for dispersing coupler (Cpd-5) | 0.03 |
| Solvent for coupler (Solv-1,2 and 3) | 0.10 |
| The fifth layer (Intermediate layer) | |
| Magenta colloidal silver | 0.02 |
| Gelatin | 1.00 |
| Color stain inhibitor (Cpd-6 and 7) | 0.08 |
| Solvent for color stain inhibitor (Solv-4 and 5) | 0.16 |
| Polymer latex (Cpd-8) | 0.10 |
| The sixth layer (Green low sensitive layer) | |
| Silver chloroiodobromide emulsion EM4 (which has 1 mole % silver chloride content, 2.5 mole % silver bromide content, average grain size of 0.28 μm and coefficient of variation of 12%, cubic grain shape and a core/shell structure wherein the iodide content in the core is high) sensitized with a green spectral sensitizing dye (ExS-3) | 0.04 |
| Silver iodobromide emulsion EM5 (which has 2.8 mole % silver iodide content, average grain size of 0.45 μm and coefficient of variation of 12% and tabular grain shape (aspect ratio is 5)) sensitized with a green spectral sensitizing dye (ExS-3) | 0.06 |
| Gelatin | 0.80 |
| Magenta coupler (ExM-1) | 0.10 |
| Color stabilizer (Cpd-9) | 0.10 |
| Stain inhibitor (Cpd-10) | 0.01 |
| Stain inhibitor (Cpd-11) | 0.001 |
| Stain inhibitor (Cpd-12) | 0.01 |
| Medium for dispersing coupler (Cpd-5) | 0.05 |
| Solvent for coupler (Solv-4 and 6) | 0.15 |
| The seventh layer (Green high sensitive layer) | |
| Silver iodobromide emulsion EM5 (which has 3.5 mole % silver iodide content, average grain size of 0.9 μm and coefficient of variation of 23%, tabular grain shape (aspect ratio is 9) and uniform iodide distribution) sensitized with a green spectral sensitizing dye (ExS-3) | 0.10 |
| Gelatin | 0.80 |
| Magenta coupler (ExM-1) | 0.10 |
| Color stabilizer (Cpd-9) | 0.10 |
| Stain inhibitor (Cpd-10) | 0.01 |
| Stain inhibitor (Cpd-11) | 0.001 |
| Stain inhibitor (Cpd-12) | 0.01 |
| Medium for dispersing coupler (Cpd-5) | 0.05 |
| Solvent for coupler (Solv-4 and 6) | 0.15 |
| The eighth layer (Yellow filter layer) | |
| Yellow colloidal silver | 0.20 |
| Gelatin | 1.00 |
| Stain inhibitor (Cpd-7) | 0.06 |
| Solvent for stain inhibitor (Solv-4 and 5) | 0.15 |
| Polymer latex (Cpd-8) | 0.10 |
| The ninth layer (Blue low sensitive layer) | |
| Silver chloroiodobromide emulsion EM7 (which has 2 mole % silver chloride content, 2.5 mole % silver bromide content, average grain size of 0.35 μm and coefficient of variation of 8%, cubic grain shape and a core/shell structure wherein the iodide content in the core is high) sensitized with blue spectral sensitizing dyes (ExS-5 and 6) | 0.07 |
| Silver iodobromide emulsion EM8 (which has 2.5 mole % silver iodide content, average grain size of 0.45 μm and coefficient of variation of 16% and tabular grain shape (aspect ratio is 6)) sensitized with blue spectral sensitizing dyes (ExS-5 and 6) | 0.10 |
| Gelatin | 0.50 |
| Yellow coupler (ExY-1) | 0.20 |
| Stain inhibitor (Cpd-11) | 0.001 |
| Color stabilizer (Cpd-6) | 0.10 |
| Medium for dispersing coupler (Cpd-5) | 0.05 |
| Solvent for coupler (Solv-2) | 0.05 |
| The tenth layer (Blue high sensitive layer) | |
| Silver iodobromide emulsion EM9 (which has 2.5 mole % silver iodide content, average grain size of 1.2 μm and coefficient of variation of 21% and tabular grain shape (aspect ratio is 14)) sensitized with blue spectral sensitizing dyes (ExS-5 and 6) | 0.25 |
| Gelatin | 1.00 |

-continued

| | |
|---|---|
| Yellow coupler (ExY-1) | 0.40 |
| Stain inhibitor (Cpd-11) | 0.002 |
| Color stabilizer (Cpd-6) | 0.10 |
| Medium for dispersing coupler (Cpd-5) | 0.15 |
| Solvent for coupler (Solv-2) | 0.10 |
| The eleventh layer (Ultraviolet absorbing layer) | |
| Gelatin | 1.50 |
| Ultraviolet absorbent (Cpd-1, 3 and 13) | 1.00 |
| Color stain inhibitor (Cpd-6 and 14) | 0.06 |
| Dispersing Medium (Cpd-5) | 0.03 |
| Solvent for ultraviolet absorbent (Solv-1 and 2) | 0.15 |
| Antiirradiation dye (Cpd-15 and 16) | 0.02 |
| Antiirradiation dye (Cpd-17 and 18) | 0.02 |
| The twelfth layer (Protective layer) | |
| Fine silver chlorobromide grains (which has 97 mole % silver chloride content and average grain size of 0.2 μm) | 0.07 |
| Denatured polyvinyl alcohol (Poval) | 0.02 |
| Gelatin | 1.50 |
| Hardening agent for gelatin (H-1) | 0.17 |

Further, a dispersing aid (alkanol XC produced by Dupont and sodium alkylbenzenesulfonate) and a coating aid (succinate esters and Mageface F-120 produced by Dai Nippon Printing Co., Ltd.) were used for each of the layers. Stabilizers (Cpd-19, 20 and 20) were also used for the layers containing silver halide or colloidal silver.

Each of the compounds used in the Examples 6 are described below.

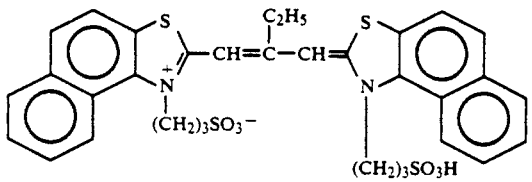
(Exs-1)

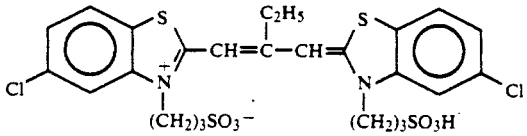
(Exs-2)

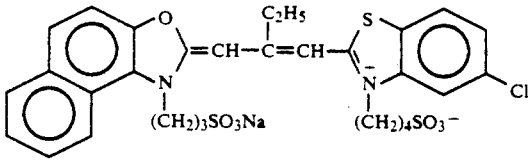
(Exs-3)

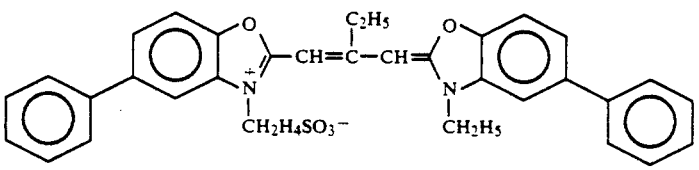
(Exs-4)

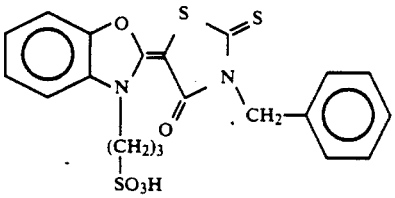
(Exs-5)

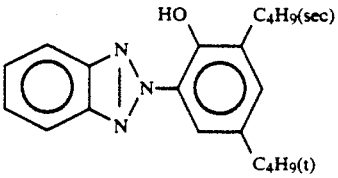
(Cpd-1)

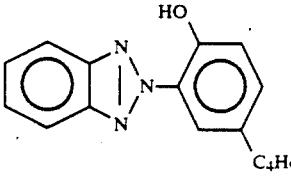
(Cpd-2)

-continued
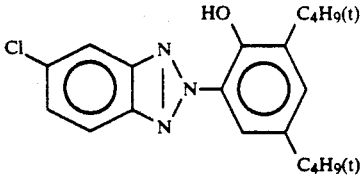
(Cpd-3)
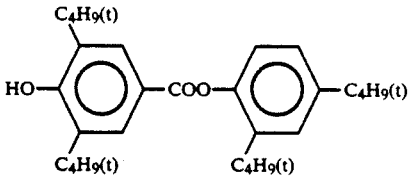
(Cpd-4)
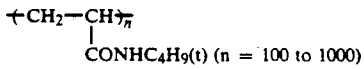
(Cpd-5)
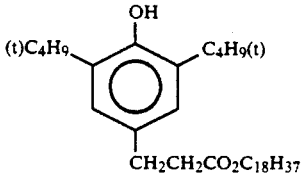
(Cpd-6)
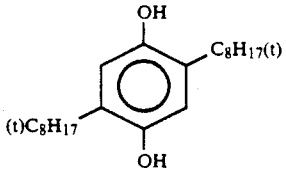
(Cpd-7)
Polyethylacrylate (Cpd-8)
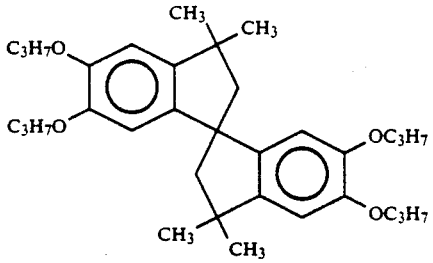
(Cpd-9)
Mixture of the following compounds (1:1 as weight ratio) (Cpd-10)
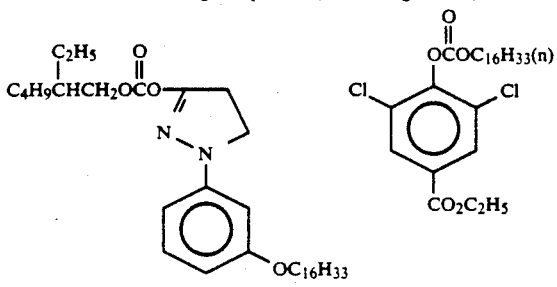
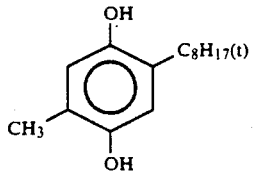
(Cpd-11)

-continued
(Cpd-12)
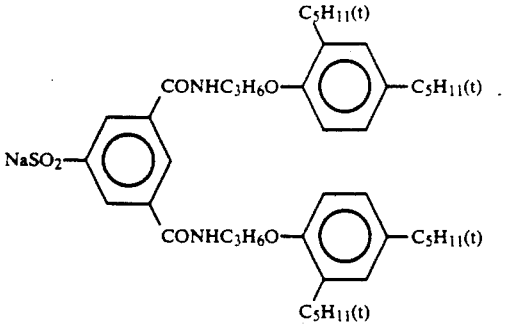
(Cpd-13)
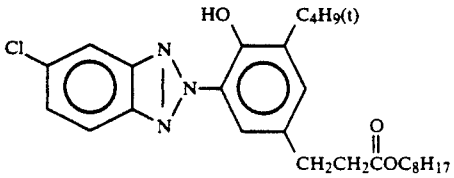
(Cpd-14)
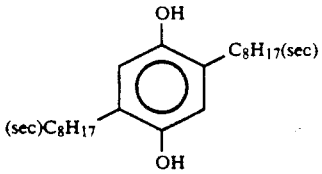
(Cpd-15)
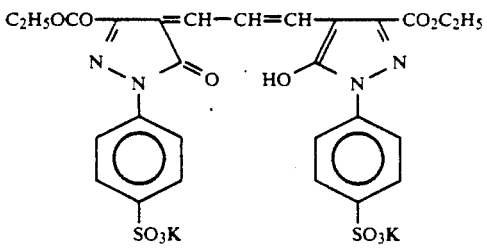
(Cpd-16)
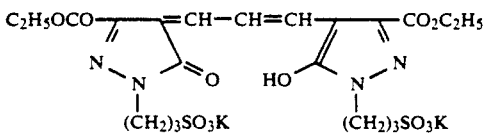
(Cpd-17)
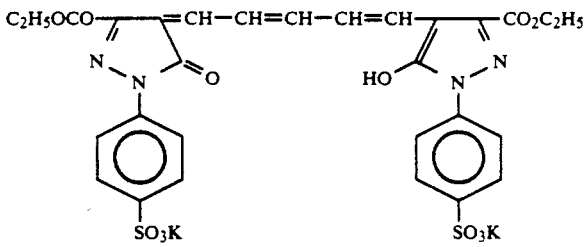
(Cpd-18)
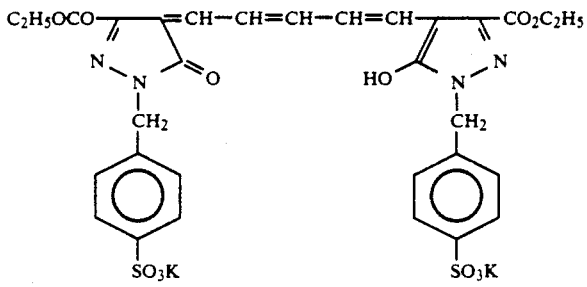

-continued
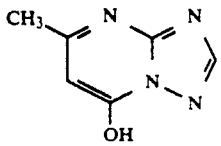
(Cpd-19)
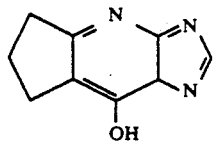
Cpd-20
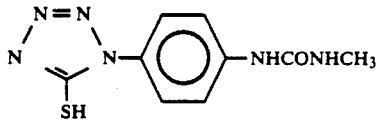
(Cpd-21)
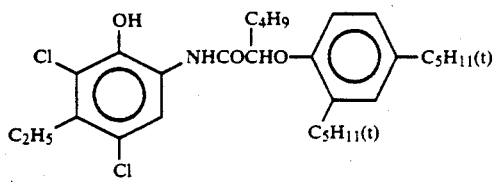
(ExC-1)
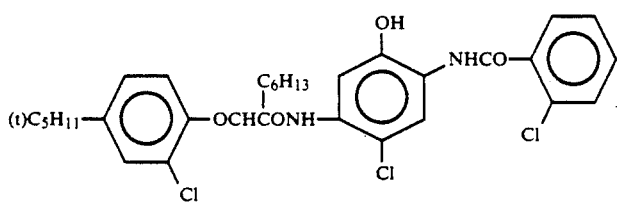
(ExC-2)
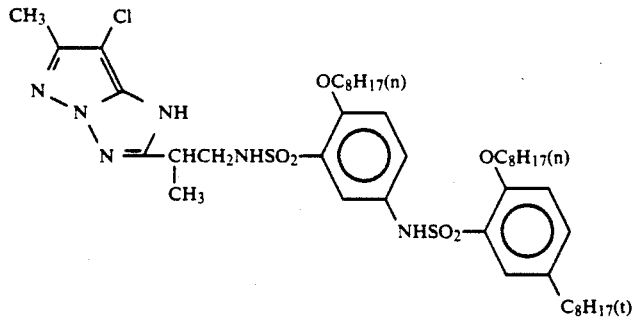
(ExM-1)
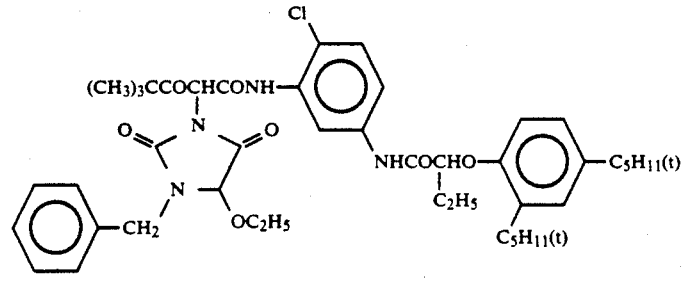
(ExY-1)
(Solv-1)
Di(2-ethylhexyl) phthalate
(Solv-2)
Trinonyl phosphate
(Solv-3)
Di(3-methylhexyl) phthalate
(Solv-4)
Tricredyl phosphate
(Solv-5)
Dibutyl phthalate
(Solv-6)
Trioctyl phosphate
(Solv-7)
1,2-Bis(vinylsulfonylacetamido)ethane
(Emulsion A)

Preparation of silver halide emulsion containing silver halide grains having a hundred sides on the surface and an almost uniform grain size distribution An aqueous solution of silver nitrate and an aqueous solution containing potassium bromide and potassium iodide were added to an aqueous gelatin solution at 70° C. keeping pBr of 4.5 as a double jet process to prepare a silver halide emulsion containing silver halide grains having a hundred sides on the surface and an almost uniform grain size distribution (edge length is 0.68 μm). The obtained core emulsion was divided into three sections. With respect to each of the sections, the shell was then formed. The obtained silver halide emulsion has average grain size of 0.7 μm and 3 mole % silver iodide content.

The core emulsion was chemically sensitized with sodium thiosulfate and potassium chloroaurate. The shell was then precipitated in the same manner as the core.

The above-prepared photosensitive material was exposed to light through an optical wedge, and subjected to the following processes.

| Process | | |
|---|---|---|
| First development (Black and white Development) | 38° C. | 75 seconds |
| Washing | 38° C. | 90 seconds |
| Reversal exposure not less than 100 lux and not less than 60 seconds | | |
| Color development | 38° C. | 135 seconds |
| Washing | 38° C. | 45 seconds |
| Bleach-fix | 38° C. | 120 seconds |
| Washing | 38° C. | 135 seconds |
| Drying | 80° C. | 120 seconds |

The composition of each of the processing solution is set forth below.

| First developing solution | |
|---|---|
| Pentasodium nitrilo-N,N,N-trimethylene-phosphonate | 0.6 g |
| Pentasodium diethylenetriaminetetraacetate | 4.0 g |
| Potassium sulfite | 30.0 g |
| Potassium thiocyanate | 1.2 g |
| Potassium carbonate | 35.0 g |
| Potassium hydroquinonemonosulfonate | 25.0 g |
| Diethylene glycol | 15.0 ml |
| 1-Phenyl-4-hydroxymethyl-4-methyl-3-pyrazolidone | 2.0 g |
| Potassium bromide | 0.5 g |
| Potassium iodide | 5.0 mg |
| Water to make up to | 1 l |
| | (pH 9.70) |
| **Color developing solution** | |
| Benzyl alcohol | 15.0 ml |
| Diethylene glycol | 12.0 ml |
| 3,6-Dithia-1,8-octanediol | 0.2 g |
| Pentasodium nitrilo-N,N,N-trimethylene-phosphonate | 0.5 g |
| Pentasodium diethylenetriaminetetraacetate | 2.0 g |
| Sodium sulfite | 2.0 g |
| Potassium carbonate | 25.0 g |
| Sulfonate salt of hydroxyamine | 3.0 g |
| Sulfonate salt of N-ethyl-N-(β-methane-sulfonamidoethyl)-3-methyl-4-aminoaniline | 5.0 g |
| Potassium bromide | 0.5 g |
| Potassium iodide | 1.0 mg |
| Water to make up to | 1 l |
| | (pH 10.40) |
| **Bleach-fix solution** | |
| 2-Mercapto-1,3,4-triazole | 1.0 g |
| Ethylenediaminetetraacetic acid | 5.0 g |

-continued

| | |
|---|---|
| disodium salt dihydrate | |
| Ethylenediaminetetraacetic acid iron (III) ammonium salt monohydrate | 80.0 g |
| Sodium sulfite | 15.0 g |
| Sodium thiosulfate (700 g/l solution) | 160.0 ml |
| Glacial acetic acid | 5.0 ml |
| Water to make up to | 1 l |
| | (pH 6.50) |

Thus, a sample M was obtained. The other samples were prepared in the same manner except that the compound (Cpd-6) in the ninth and tenth layers and the ultraviolet absorbent in the eleventh layer were changed according to the following Table 5 (the amount of the changed compound was the equivalent mole).

Each of the samples was then irradiated with light for 8 days in a xenon tester at 200,000 lux. The yellow density of the image was measured, and the remaining ratio to the density of the image (1.0) before the irradiation was obtained.

The results are set forth in Table 5. In Table 5, the "Remark" indicates whether the experiment is a comparison example (Comp.) or an example of the present invention (Example). Further, UV-6,4,8 means Cpd-1,3 and 13 respectively.

(UV-a; Comparative ultraviolet absorbent)

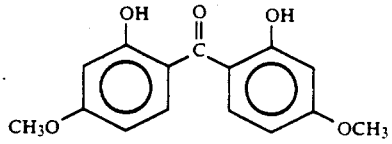

(Described in U.S. Pat. No. 2,983,604)

(UV-b; Comparative ultraviolet absorbent)

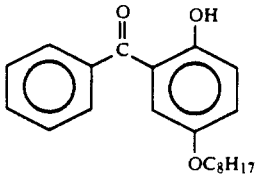

(Described in U.S. Pat. No. 3,785,827)

(UV-c; Comparative ultraviolet absorbent)

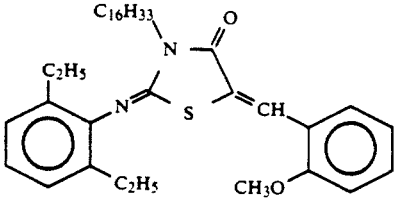

(Described in U.S. Pat. No. 3,314,794)

(UV-d; Comparative ultraviolet absorbent)

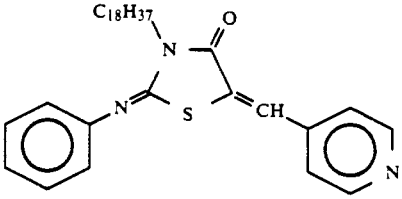

(Described in U.S. Pat. No. 3,352,681)

(UV-e; Comparative ultraviolet absorbent)

-continued

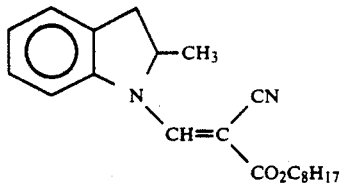

(Described in U.S. Pat. No. 3,687,671)

TABLE 5

| Sample | Coupler | Stabilizer | UV absorbent | Remaining (%) | Remark |
|---|---|---|---|---|---|
| M | ExY-1 | (Cpd-6) | UV-6,4,8 | 70 | Comp. |
| M(1) | ExY-1 | (a) | UV-6,4,8 | 72 | Comp. |
| M(2) | ExY-1 | (e) | UV-6,4,8 | 73 | Comp. |
| M(3) | ExY-1 | (f) | UV-6,4,8 | 73 | Comp. |
| M(4) | ExY-1 | A-27 | UV-6,4,8 | 90 | Example |
| M(5) | ExY-1 | A-53 | UV-6,4,8 | 89 | Example |
| M(6) | ExY-1 | A-61 | UV-6,4,8 | 88 | Example |
| M(7) | ExY-1 | A-73 | UV-6,4,8 | 87 | Example |
| M(8) | ExY-1 | A-79 | UV-6,4,8 | 88 | Example |
| M(9) | ExY-1 | A-108 | UV-6,4,8 | 95 | Example |
| M(10) | ExY-1 | A-121 | UV-6,4,8 | 95 | Example |
| M(11) | ExY-1 | A-149 | UV-6,4,8 | 94 | Example |
| M(12) | ExY-1 | (Cpd-6) | UV-a,c,e | 69 | Comp. |
| M(13) | ExY-1 | (a) | UV-a,c,e | 70 | Comp. |
| M(14) | ExY-1 | (e) | UV-b,d,e | 70 | Comp. |
| M(15) | ExY-1 | (f) | UV-a,b,c | 71 | Comp. |
| M(16) | ExY-1 | A-27 | UV-a,c,e | 79 | Example |
| M(17) | ExY-1 | A-53 | UV-a,c,e | 78 | Example |
| M(18) | ExY-1 | A-61 | UV-a,c,e | 78 | Example |
| M(19) | ExY-1 | A-73 | UV-b,d,e | 78 | Example |
| M(20) | ExY-1 | A-79 | UV-b,d,e | 80 | Example |
| M(21) | ExY-1 | A-108 | UV-b,d,e | 82 | Example |
| M(22) | ExY-1 | A-121 | UV-a,b,c | 81 | Example |
| M(23) | ExY-1 | A-149 | UV-a,b,c | 82 | Example |

It is apparent from the results that the compounds of the present invention having the formula [I] to [VI] is much effective in preventing the color image from light fading, compared with the known compounds. It is also apparent that the effect of the present invention is remarkably increased when the compounds having the formula [I] to [VI] are used with the ultraviolet absorbent having the formula [UV].

EXAMPLE 7

On a cellulose triacetate support, the following emulsion layers were coated to prepare a sample N.

| | |
|---|---|
| The first layer (Antihalation layer) | |
| Black colloidal silver | 0.25 g/m$^2$ |
| Ultraviolet absorbent (U-1) | 0.1 g/m$^2$ |
| Ultraviolet absorbent (U-2) | 0.1 g/m$^2$ |
| High boiling organic solvent (Oil-1) | 0.1 cc/m$^2$ |
| Gelatin | 1.9 g/m$^2$ |
| The second layer (First intermediate layer) | |
| Cpd-D | 10 mg/m$^2$ |
| High boiling organic solvent (Oil-3) | 40 mg/m$^2$ |
| Gelatin | 0.4 g/m$^2$ |
| The third layer (Second intermediate layer) | |
| Silver chloroiodide emulsion containing fogged fine grains (which has average grain grain size of 0.06 μm and 1 mole % silver iodide content) | 0.05 g/m$^2$ (amount of silver) |
| Gelatin | 0.4 g/m$^2$ |
| The fourth layer (First red sensitive layer) | |
| Silver iodobromide emulsion EM-1 sensitized with spectral sensitizing dyes (S-1) and (S-2) | 0.4 g/m$^2$ (amount of silver) |
| Coupler (C-1) | 0.2 g/m$^2$ |
| Coupler (C-2) | 0.05 g/m$^2$ |
| High boiling organic solvent (Oil-1) | 0.1 cc/m$^2$ |
| Gelatin | 0.8 g/m$^2$ |
| The fifth layer (Second red sensitive layer) | |
| Silver iodobromide emulsion EM-4 sensitized with spectral sensitizing dyes (S-1) and (S-2) | 0.4 g/m$^2$ (amount of silver) |
| Coupler (C-1) | 0.2 g/m$^2$ |
| Coupler (C-3) | 0.2 g/m$^2$ |
| Coupler (C-2) | 0.05 g/m$^2$ |
| High boiling organic solvent (Oil-1) | 0.1 cc/m$^2$ |
| Gelatin | 0.8 g/m$^2$ |
| The sixth layer (Third red sensitive layer) | |
| Silver iodobromide emulsion EM-7 sensitized with spectral sensitizing dyes (S-1) and (S-2) | 0.4 g/m$^2$ (amount of silver) |
| Coupler (C-3) | 0.7 g/m$^2$ |
| Coupler (B-1) | 0.3 g/m$^2$ |
| Gelatin | 1.1 g/m$^2$ |
| The seventh layer (Third intermediate layer) | |
| Dye (D-1) | 0.02 g/m$^2$ |
| Gelatin | 0.6 g/m$^2$ |
| The eighth layer (Fourth intermediate layer) | |
| Silver chloroiodide emulsion containing fogged fine grains (which has average grain size of 0.06 μm and 0.3 mole % silver iodide content) | 0.02 g/m$^2$ (amount of silver) |
| Compound (Cpd-A) | 0.2 g/m$^2$ |
| Gelatin | 1.0 g/m$^2$ |
| The ninth layer (First green sensitive layer) | |
| Silver iodobromide emulsion EM-1 sensitized with spectral sensitizing dyes (S-3) and (S-4) | 0.5 g/m$^2$ (amount of silver) |
| Coupler (C-4) | 0.15 g/m$^2$ |
| Coupler (C-7) | 0.15 g/m$^2$ |
| Compound (Cpd-B) | 0.03 g/m$^2$ |
| Compound (Cpd-E) | 0.1 g/m$^2$ |
| Compound (Cpd-F) | 0.1 g/m$^2$ |
| Compound (Cpd-G) | 0.05 g/m$^2$ |
| Compound (Cpd-H) | 0.05 g/m$^2$ |
| Gelatin | 0.5 g/m$^2$ |
| The tenth layer (Second green sensitive layer) | |
| Silver iodobromide emulsion EM-4 sensitized with spectral sensitizing dyes (S-3) and (S-4) | 0.4 g/m$^2$ (amount of silver) |
| Coupler (C-4) | 0.15 g/m$^2$ |
| Coupler (C-7) | 0.15 g/m$^2$ |
| Compound (Cpd-B) | 0.03 g/m$^2$ |
| Compound (Cpd-E) | 0.1 g/m$^2$ |
| Compound (Cpd-F) | 0.1 g/m$^2$ |
| Compound (Cpd-G) | 0.05 g/m$^2$ |
| Compound (Cpd-H) | 0.05 g/m$^2$ |
| Gelatin | 0.6 g/m$^2$ |
| The eleventh layer (Third green sensitive layer) | |
| Silver iodobromide emulsion EM-7 sensitized with spectral sensitizing dyes (S-3) and (S-4) | 0.5 g/m$^2$ (amount of silver) |
| Coupler (C-4) | 0.4 g/m$^2$ |
| Coupler (C-7) | 0.4 g/m$^2$ |
| Compound (Cpd-B) | 0.08 g/m$^2$ |
| Compound (Cpd-E) | 0.1 g/m$^2$ |
| Compound (Cpd-F) | 0.1 g/m$^2$ |
| Compound (Cpd-G) | 0.1 g/m$^2$ |
| Compound (Cpd-H) | 0.1 g/m$^2$ |
| Gelatin | 1.0 g/m$^2$ |
| The twelfth layer (Fifth intermediate layer) | |
| Dye (D-2) | 0.05 g/m$^2$ |
| Gelatin | 0.6 g/m$^2$ |
| The thirteenth layer (Yellow filter layer) | |
| Yellow colloidal silver | 0.1 g/m$^2$ |
| Compound (Cpd-A) | 0.01 g/m$^2$ |
| Gelatin | 1.1 g/m$^2$ |
| The fourteenth layer (First blue sensitive layer) | |
| Silver iodobromide emulsion EM-1 sensitized with spectral sensitizing dyes (S-5) and (S-6) | 0.6 g/m$^2$ (amount of silver) |
| Coupler (C-5) | 0.6 g/m$^2$ |
| Gelatin | 0.8 g/m$^2$ |
| The fifteenth layer (Second blue sensitive layer) | |
| Silver iodobromide emulsion EM-4 sensitized with spectral sensitizing dyes (S-5) and (S-6) | 0.4 g/m$^2$ (amount of silver) |
| Coupler (C-5) | 0.3 g/m$^2$ |
| Coupler (C-6) | 0.3 g/m$^2$ |
| Gelatin | 0.9 g/m$^2$ |
| The sixteenth layer | |

-continued

| | |
|---|---|
| (Third blue sensitive layer) | |
| Silver iodobromide emulsion EM-7 sensitized with spectral sensitizing dyes (S-) and (S-6) | 0.4 g/m$^2$ (amount of silver) |
| Coupler (C-6) | 0.7 g/m$^2$ |
| Gelatin | 1.2 g/m$^2$ |
| The seventeenth layer (First protective layer) | |
| Ultraviolet absorbent (U-1) | 0.04 g/m$^2$ |
| Ultraviolet absorbent (U-3) | 0.03 g/m$^2$ |
| Ultraviolet absorbent (U-4) | 0.03 g/m$^2$ |
| Ultraviolet absorbent (U-5) | 0.05 g/m$^2$ |
| Ultraviolet absorbent (U-6) | 0.05 g/m$^2$ |
| Compound (Cpd-C) | 0.8 g/m$^2$ |
| Dye (D-3) | 0.05 g/m$^2$ |
| Gelatin | 0.7 g/m$^2$ |
| The eighteenth layer (Second protective layer) | |
| Silver chloroiodide emulsion containing fogged fine grains (which has average grain size of 0.06 μm and 1 mole silver iodide content) | 0.1 g/m$^2$ (amount of silver) |
| Gelatin | 0.4 g/m$^2$ |
| The nineteenth layer (Third protective layer) | |
| Polymethyl methacrylate particles (having average particle size of 1.5 μm) | 0.1 g/m$^2$ |
| Methyl methacrylate/acrylic acid copolymer (4:6) particles (having average particle size of 1.5 μm) | 0.1 g/m$^2$ |
| Silicone oil | 0.03 g/m$^2$ |
| Fluorinated surface active agent (W-1) | 3 g/m$^2$ |
| Gelatin | 0.4 g/m$^2$ |

Further, a hardening agent for gelatin (H-1) and a surface active agent were added to each of the layers.

(C-1)

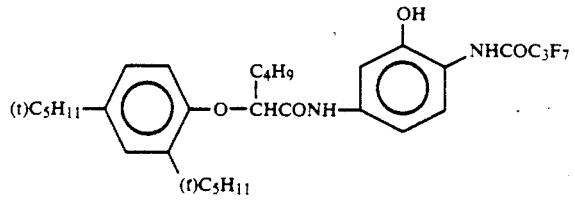

(C-2)

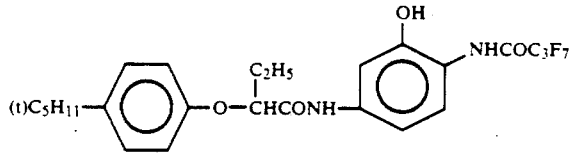

(C-3)

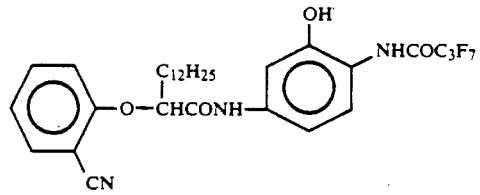

(C-4)

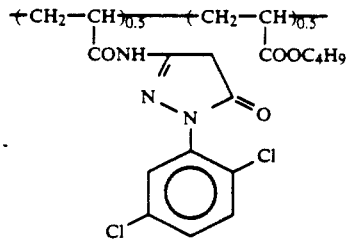

(C-5)

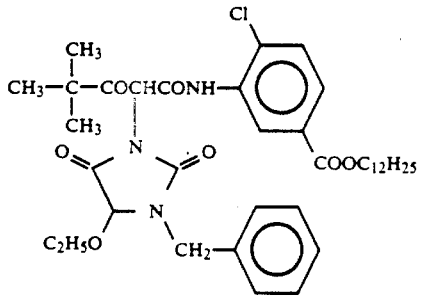

-continued
(C-6)
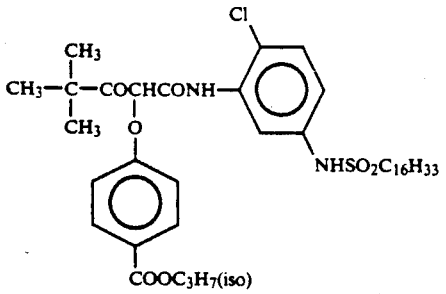
(C-7)
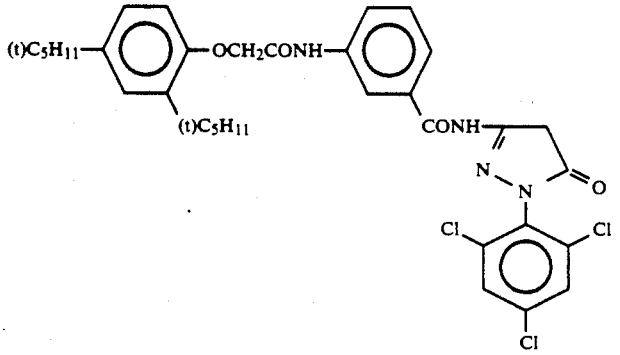
Dibutyl phthalate (Oil-1)
Tricresidyl phosphate (Oil-2)
(Oil-3)
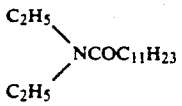
(Cpd-A)
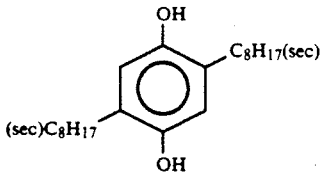
(Cpd-B)
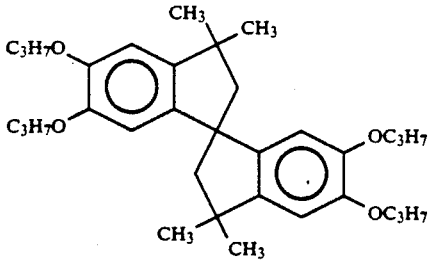
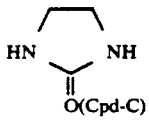
(Cpd-E)
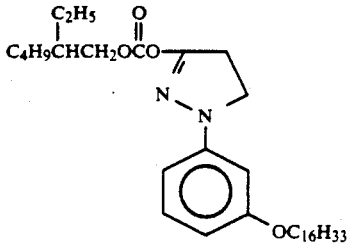

-continued
(Cpd-F)
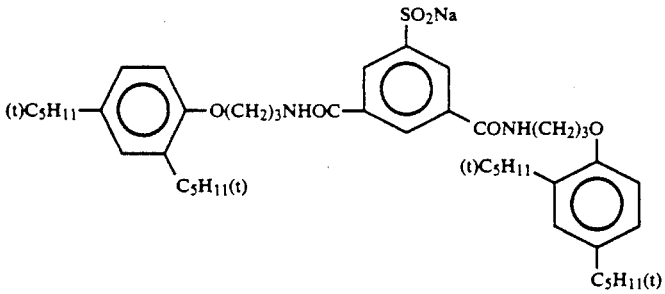
(Cpd-G)
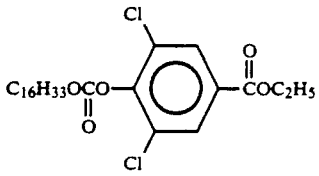
(Cpd-H)
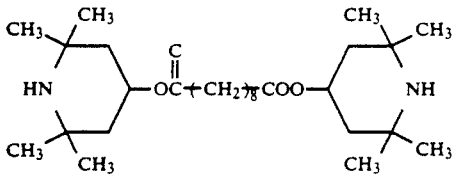
(Cpd-D)
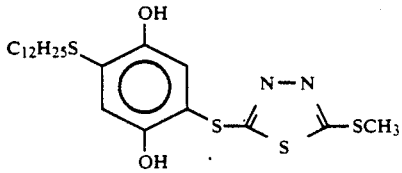
(U-1)
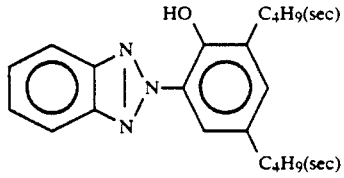
(U-2)
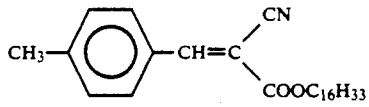
(U-3)
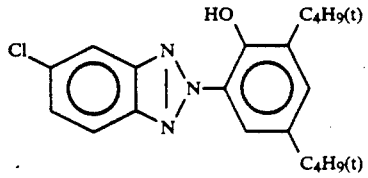
(U-4)
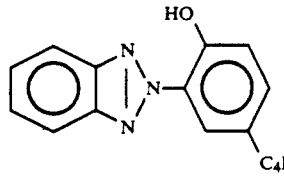
(U-5)
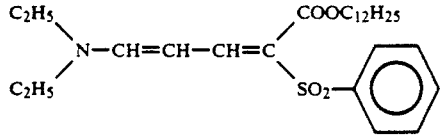

-continued
(U-6)
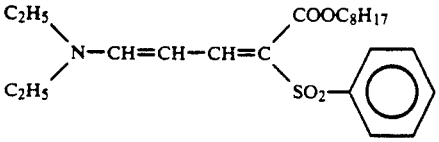
(S-1)
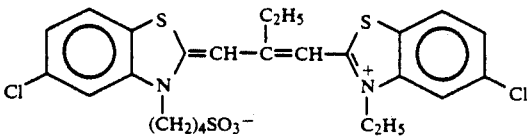
(S-2)
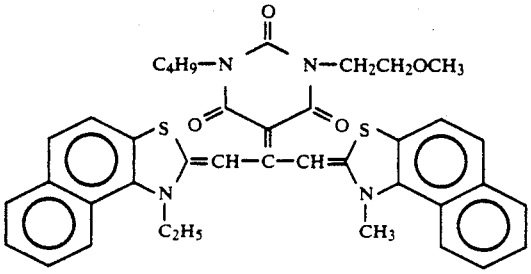
(S-3)
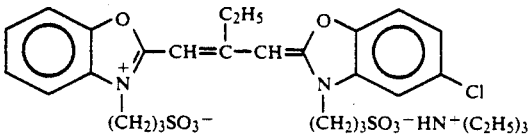
(S-4)
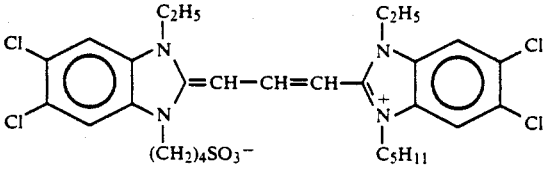
(S-5)
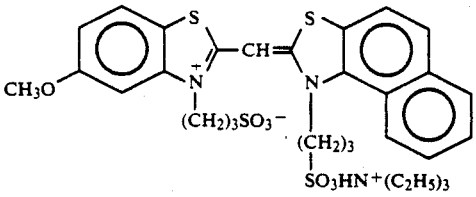
(S-6)
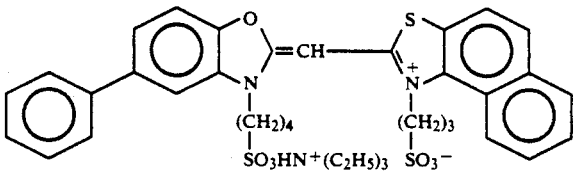
(D-7)
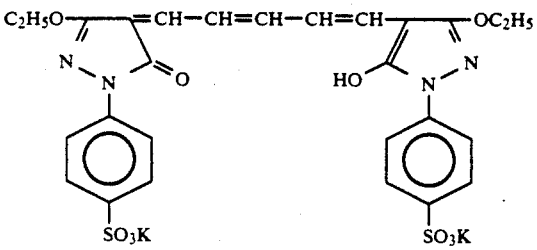

-continued

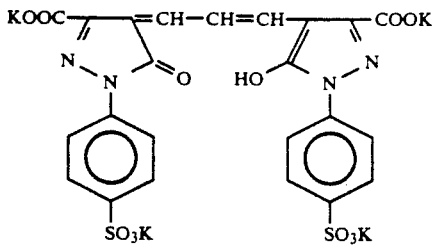

(D-2)

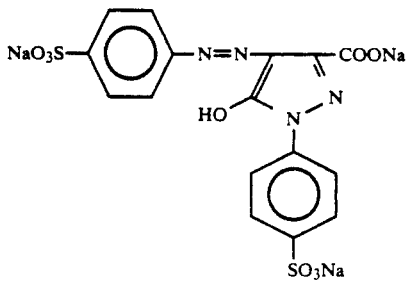

(D-3)

$CH_2{=}CHSO_2CH_2CONHCH_2$
$CH_2{=}CHSO_2CH_2CONHCH_2$ (H-1)

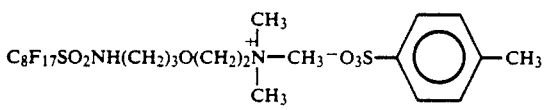

(W-1)

The above-prepared photosensitive material was exposed to light through an optical wedge, and subjected to the following processes.

| Process | Temperature | Time |
|---|---|---|
| First development | 38° C. | 6 minutes |
| Washing | 38° C. | 2 minutes |
| Reversing | 38° C. | 2 minutes |
| Color development | 38° C. | 6 minutes |
| Adjustment | 38° C. | 2 minutes |
| Bleach | 38° C. | 6 minutes |
| Fixing | 38° C. | 4 minutes |
| Washing | 38° C. | 4 minutes |
| Stabilization | Room temperature | 1 minute |
| Drying | 50° C. | 30 minutes |

The composition of each of the processing solution is set forth below.

| | |
|---|---|
| First developing solution | |
| Water | 700 ml |
| Pentasodium nitrilo-N,N,N-trimethylenephosphonate | 2 g |
| Sodium sulfite | 20 g |
| Hydroquinone monosulfonate | 30 g |
| Sodium carbonate (monohydrate salt) | 30 g |
| 1-Phenyl-4-hydroxethyl-4-methyl-3-pyrazolidone | 2 g |
| Potassium bromide | 2.5 g |
| Potassium thiocyanate | 1.2 g |
| Potassium iodide (0.1% solution) | 2 ml |
| Water to make up to | 1,000 ml |
| Reversing solution | |
| Water | 700 ml |
| Pentasodium nitrilo-N,N,N-trimethylenephosphonate | 3 g |
| Stannous chloride (dihydrate salt) | 1 g |
| p-Aminophenol | 0.1 g |
| Sodium hydroxide | 8 g |
| Glacial acetic acid | 15 ml |
| Water to make up to | 1,000 ml |
| Color developing solution | |

-continued

| | |
|---|---|
| Water | 700 ml |
| Pentasodium nitrilo-N,N,N-trimethylenephosphonate | 3 g |
| Sodium sulfite | 7 g |
| Sodium tertiary phosphate (dodecahydrate salt) | 36 g |
| Potassium chloride | 1 g |
| Potassium iodide (0.1% solution) | 90 ml |
| Sodium hydroxide | 3 g |
| Citrazinic acid | 1.5 g |
| Sulfonate salt of N-ethyl-N-(β-methane-sulfonamidoethyl) 3-methyl-4-aminoaniline | 11 g |
| 3,6-Dithiaoctane-1,8-diol | 1 g |
| Water to make up to | 1,000 ml |
| Adusting solution | |
| Water | 700 ml |
| Sodium sulfite | 12 g |
| Sodium ethylenediaminetetraacetate (dihydrate salt) | 8 g |
| Thioglycerin | 0.4 ml |
| Glacial acetic acid | 3 ml |
| Water to make up to | 1,000 ml |
| Bleaching solution | |
| Water | 800 ml |
| Sodium ethylenediaminetetraacetate (dihydrate salt) | 2 g |
| Iron (III) ammonium ethylenediaminetetraacetate (dihydrate salt) | 120 g |
| Potassium bromide | 100 g |
| Water to make up to | 1,000 ml |
| Fixing solution | |
| Water | 800 ml |
| Sodium thiosulfate | 80.0 g |
| Sodium sulfite | 5.0 g |
| Sodium bisulfite | 5.0 g |
| Water to make up to | 1,000 ml |
| Stabilizing solution | |
| Water | 800 ml |
| Formaldehyde (37 weight % solution) | 5.0 ml |
| Surface active agent (Fuji Drywel produced by Fuji Photo Film Co., Ltd.) | 5.0 ml |
| Water to make up to | 1,000 ml |

Thus, a sample N was obtained. The other samples were prepared in the same manner except that the magenta coupler in the ninth, tenth and eleventh layers were changed and a color stabilizer (the amount is 50 mole % based on the amount of the yellow coupler) is added to the fourteenth, fifteenth and sixteenth layers according to the following Table 6.

Each of the samples was then irradiated with light for 8 days in a xenon tester at 200,000 lux. The yellow density of the image was measured, and the remaining ratio to the density of the image (1.0) before the irradiation was obtained. Further, with respect to a yellow stain within the unexposed area, the increased value of the yellow density was measured.

The results are set forth in Table 6. In Table 6, the "Remark" indicates whether the experiment is a comparison example (Comp.) or an example of the present invention (Example).

TABLE 6

| Sample | Coupler | Stabilizer | Remaining (%) | Yellow Stain | Remark |
|---|---|---|---|---|---|
| N | C-4,7 | — | 69 | +0.06 | Comp. |
| N(1) | C-4,7 | (a) | 71 | +0.06 | Comp. |
| N(2) | C-4,7 | (b) | 72 | +0.06 | Comp. |
| N(3) | C-4,7 | (c) | 70 | +0.07 | Comp. |
| N(4) | C-4,7 | (d) | 70 | +0.07 | Comp. |
| N(5) | C-4,7 | (e) | 71 | +0.06 | Comp. |
| N(6) | C-4,7 | (f) | 74 | +0.06 | Comp. |
| N(7) | C-4,7 | A-2 | 89 | +0.05 | Example |
| N(8) | C-4,7 | A-5 | 91 | +0.05 | Example |
| N(9) | C-4,7 | A-16 | 88 | +0.05 | Example |
| N(10) | C-4,7 | A-28 | 89 | +0.04 | Example |
| N(11) | C-4,7 | A-31 | 90 | +0.04 | Example |
| N(12) | C-4,7 | A-35 | 90 | +0.05 | Example |
| N(13) | C-4,7 | A-107 | 95 | +0.04 | Example |
| N(14) | C-4,7 | A-108 | 94 | +0.05 | Example |
| N(15) | C-4,7 | A-121 | 94 | +0.05 | Example |
| N(16) | M-1 | — | 69 | +0.04 | Comp. |
| N(17) | M-1 | (a) | 71 | +0.04 | Comp. |
| N(18) | M-1 | (b) | 72 | +0.04 | Comp. |
| N(19) | M-1 | (c) | 70 | +0.05 | Comp. |
| N(20) | M-1 | (d) | 70 | +0.05 | Comp. |
| N(21) | M-1 | (e) | 71 | +0.04 | Comp. |
| N(22) | M-1 | (f) | 74 | +0.04 | Comp. |
| N(23) | M-1 | A-2 | 91 | +0.01 | Example |
| N(24) | M-1 | A-5 | 92 | +0.01 | Example |
| N(25) | M-1 | A-16 | 90 | +0.01 | Example |
| N(26) | M-1 | A-28 | 90 | +0.01 | Example |
| N(27) | M-1 | A-31 | 91 | +0.01 | Example |
| N(28) | M-1 | A-35 | 92 | +0.01 | Example |
| N(29) | M-1 | A-107 | 96 | +0.01 | Example |
| N(30) | M-1 | A-108 | 95 | +0.01 | Example |
| N(31) | M-1 | A-121 | 95 | +0.01 | Example |
| N(32) | M-3 | — | 70 | +0.04 | Comp. |
| N(33) | M-3 | (a) | 72 | +0.04 | Comp. |
| N(34) | M-3 | (b) | 73 | +0.04 | Comp. |
| N(35) | M-3 | (c) | 71 | +0.05 | Comp. |
| N(36) | M-3 | A-10 | 88 | +0.01 | Example |
| N(37) | M-3 | A-22 | 89 | +0.01 | Example |
| N(38) | M-3 | A-56 | 88 | +0.02 | Example |
| N(39) | M-3 | A-79 | 89 | +0.02 | Example |
| N(40) | M-3 | A-83 | 90 | +0.01 | Example |
| N(41) | M-3 | A-107 | 95 | +0.01 | Example |
| N(42) | M-3 | A-114 | 95 | +0.01 | Example |
| N(43) | M-3 | A-132 | 94 | +0.01 | Example |
| N(44) | M-3 | A-143 | 92 | +0.01 | Example |
| N(45) | M-3 | A-146 | 92 | +0.01 | Example |
| N(46) | M-15 | — | 69 | +0.05 | Comp. |
| N(47) | M-15 | (d) | 70 | +0.06 | Comp. |
| N(48) | M-15 | (e) | 71 | +0.05 | Comp. |
| N(49) | M-15 | (f) | 74 | +0.05 | Comp. |
| N(50) | M-15 | A-8 | 89 | +0.02 | Example |
| N(51) | M-15 | A-18 | 89 | +0.01 | Example |
| N(52) | M-15 | A-54 | 90 | +0.02 | Example |
| N(53) | M-15 | A-57 | 90 | +0.01 | Example |
| N(54) | M-15 | A-62 | 89 | +0.01 | Example |
| N(55) | M-15 | A-108 | 96 | +0.01 | Example |
| N(56) | M-15 | A-121 | 95 | +0.01 | Example |

TABLE 6-continued

| Sample | Coupler | Stabilizer | Remaining (%) | Yellow Stain | Remark |
|---|---|---|---|---|---|
| N(57) | M-15 | A-139 | 95 | +0.01 | Example |
| N(58) | M-15 | A-145 | 93 | +0.01 | Example |
| N(59) | M-15 | A-150 | 93 | +0.01 | Example |

It is apparent from the results that the compounds of the present invention is much effective in preventing the color image from light fading, compared with the known compounds. It is also apparent that the occurrence of the yellow stain is remarkably reduced when the compounds of the present invention are used in the magenta coupler having the formula [M-3].

We claim:

1. A silver halide color photosensitive material comprising a support and at least one photographic layer which includes a cyan or yellow dye image forming layer containing a cyan or yellow coupler, wherein the cyan or yellow dye forming layer contains a heterocyclic compound represented by the following formula [I], [II], [III], [IV], [V] or [VI], said heterocyclic compound and said cyan or yellow coupler together being contained in droplets of lipophilic medium which are dispersed in the cyan or yellow dye forming layer:

[I]

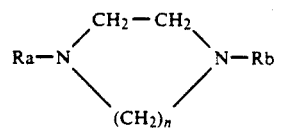

[II]

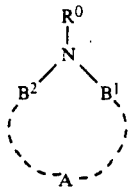

[III]

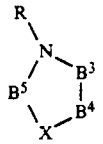

[IV]

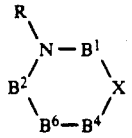

[V]

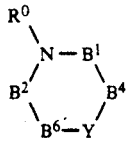

[VI]

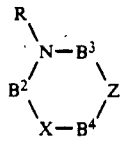

in which n is 1, 2 or 3; each of Ra and Rb independently is an acyl group, a sulfonyl group, a sulfinyl group, an alkoxycarbonyl group, an aryloxycarbonyl group, a phosphoryl group, a sulfamoyl group or a carbamoyl group; $B^1$ is $$\overset{R^1}{\overset{|}{C}}-R^2 \text{ or } C{=}O;\ B^2 \text{ is } \overset{R^3}{\overset{|}{C}}-R^4 \text{ or } C{=}O;\ B^3 \text{ is } \overset{R^5}{\overset{|}{C}}-R^6 \text{ or } C{=}O;$$

$$B^4 \text{ is } \overset{R^7}{\overset{|}{C}}-R^8 \text{ or } C{=}O;\ B^5 \text{ is } \overset{R^9}{\overset{|}{C}}-R^{10};\ B^6 \text{ is } \overset{R^{11}}{\overset{|}{C}}-R^{12} \text{ or } C{=}O;$$

R is hydrogen, an alkyl group, an alkenyl group, an acyl group, a sulfonyl group, a sulfinyl group, an alkoxycarbonyl group, an aryloxycarbonyl group, a phosphoryl group, a sulfamoyl group, a carbamoyl group or a heterocyclic group; $R^0$ is hydrogen, an alkenyl group, an acyl group, a sulfonyl group, a sulfinyl group, an alkoxycarbonyl group, a aryloxycarbonyl group, a phosphoryl group, a sulfamoyl group or a carbamoyl group, each of $R^1$, $R^2$, $R^3$, $R^4$, $R^5$, $R^6$, $R^7$, $R^8$, $R^9$, $R^{10}$, $R^{11}$ and $R^{12}$ independently is hydrogen, an alkyl group, an alkenyl group, an aryl group, a heterocyclic group, a halogen atom, an alkoxy group, an aryloxy group, a monovalent group composed of a heterocyclic group united with oxygen, an alkylthio group, an arylthio group, a monovalent group composed of a heterocyclic group united with sulfur, an amino group which may have one or more substituent groups; hydroxyl, an acyl group, cyano, nitro, sulfo, a sulfonyl group, a sulfinyl group, an alkoxycarbonyl group, an aryloxycarbonyl group, a carbamoyl group, a sulfamoyl group, formyl or carboxyl; A is an atomic group which forms, together with $-B^2-N-B^1-$, a 5- to 8-membered nitrogen-containing heterocyclic ring; each of X, Y and Z independently is —O—, —S—, $-SO_2$, —SO— and $$-\overset{R}{\overset{|}{N}}-;$$

any two of $R^1$, $R^2$, $R^3$, $R^4$, $R^5$, $R^6$, $R^7$, $R^8$, $R^9$, $R^{10}$, $R^{11}$ and $R^{12}$ may form a 5- or 8-membered ring other than benzene ring; $R^0$ in the formula [II] is neither phthaloyl, terephthaloyl not isophthaloyl; each of $R^1$, $R^2$, $R^3$ or $R^4$ in the formula [II] does not represent an alkyl group at the same time; when A in the formula [II] forms piperidine ring, the piperidine ring does not include $$-\overset{O}{\overset{\|}{C}}-$$

as the constituent atom of the ring, no bridge is formed between the 3-position and the 5-position of the piperdine ring, and no spiro ring is formed at the 4-position of the piperdine ring provided that each of $R^1$ and $R^3$ is hydrogen; when each of $B^3$, $R^4$ and $B^5$ in the formula [III] is $-CH_2-$ and X is $$-\overset{R}{\overset{|}{N}}-,$$

R is hydrogen, an alkyl group, an alkenyl group or a heterocyclic group; when Y in the formula [V] is $-SO_2-$, each of $R^1$, $R^2$, $R^3$ and $R^4$ does not represent an alkyl group at the same time; when Y in the formula [V] is —O—, $B^4$ has the same meaning as for $B^5$; when each of $B^1$, $B^2$, $B^4$ and $B^6$ in the formula [V] is $-CH_2-$ and Y is $$-\overset{R}{\overset{|}{N}}-,$$

R is hydrogen, an alkyl group, an alkenyl group or a heterocyclic group; when each of X and Z in the formula [VI] independently is $$-\overset{R}{\overset{|}{N}}-,$$

at least one of $B^2$, $B^3$ and $B^4$ is not C=O; and when each of $B^2$, $B^3$ and $B^4$ in the formula [VI] is $-CH_2-$ and Z is $$-\overset{R}{\overset{|}{N}}-,$$

X is —S—, $-SO_2-$, —SO— or $$-\overset{R}{\overset{|}{N}}-.$$

2. A silver halide color photosensitive material according to claim 1, wherein the droplets of lipophilic medium have a mean particle size in the range of 0.07 μm to 3.0 μm.

3. A silver halide color photosensitive material according to claim 1, wherein the lipophilic medium has a boiling point of 170° C. or more, and the weight ratio of the medium to the coupler is not more than 2.0.

4. A silver halide color photosensitive material according to claim 1, wherein n is 1, 2 or 3; each of Ra and Rb independently is an acyl group, a sulfonyl group, a sulfinyl group, an alkoxycarbonyl group, an aryloxycarbonyl group, a phosphoryl group, a sulfamoyl group or a carbamoyl group;

$$B^1 \text{ is } \overset{R^1}{\overset{|}{C}}-R^2 \text{ or } C{=}O;\ B^2 \text{ is } \overset{R^3}{\overset{|}{C}}-R^4 \text{ or } C{=}O;\ B^3 \text{ is}$$

$$\overset{R^5}{\overset{|}{C}}-R^6 \text{ or } C{=}O;\ B^4 \text{ is } \overset{R^7}{\overset{|}{C}}-R^8 \text{ or } C{=}O;\ B^5 \text{ is } \overset{R^9}{\overset{|}{C}}-R^{10};\ B^6 \text{ is}$$

$$\overset{R^{11}}{\overset{|}{C}}-R^{12} \text{ or } C{=}O;$$

R is an acyl group, a sulfonyl group, a sulfinyl group, an alkoxycarbonyl group, an aryloxycarbonyl group, a phosphoryl group, a sulfamoyl group or a carbamoyl group; $R^0$ is an acyl group, a sulfonyl group, a sulfinyl group, an alkoxycarbonyl group, an aryloxycarbonyl group, a phosphoryl group, a sulfamoyl group or a carbamoyl group; each of $R^1$, $R^2$, $R^3$, $R^4$, $R^5$, $R^6$, $R^7$, $R^8$, $R^9$, $R^{10}$, $R^{11}$ and $R^{12}$ independently is hydrogen, an alkyl group, an alkenyl group, an aryl group, a heterocyclic group, a halogen atom, an alkoxy group, an aryloxy group, a monovalent group composed of a heterocyclic group united with oxygen, an alkylthio group, an arylthio group, a monovalent group composed of a heterocyclic group united with sulfur, an amino group which may have one or more substituent groups, hydroxyl, an acyl group, cyano, nitro, sulfo, a sulfonyl group, a sulfinyl group, an alkoxycarbonyl group, an aryloxycarbonyl group, a carbamoyl group, a sulfamoyl group, formyl or carboxyl; A is an atomic group which forms, together with $-B^2-N-B^1-$, a 5- to 8-membered nitrogen-containing heterocyclic ring; each of X, Y and Z independently is —O—, —S—, $-SO_2-$, —SO— and $$-\overset{\overset{R}{|}}{N}-;$$

any two of $R^1$, $R^2$, $R^3$, $R^4$, $R^5$, $R^6$, $R^7$, $R^8$, $R^9$, $R^{10}$, $R^{11}$ and $R^{12}$ may form a 5- to 8-membered ring other than benzene ring; $R^0$ in the formula [II] is neither phthaloyl, terephthaloyl nor isophthaloyl; each of $R^1$, $R^2$, $R^3$ and $R^4$ in the formula [II] does not represent an alkyl group at the same time; when A in the formula [II] forms piperidine ring, the piperidine ring does not include $$-\overset{\overset{O}{\|}}{C}-$$

as the constituent atom of the ring, no bridge is formed between the 3-position and the 5-position of the piperidine ring, and no spiro ring is formed at the 4-position of the piperidine ring provided that each of $R^1$ and $R^3$ is hydrogen; when Y in the formula [V] is $-SO_2-$, each of $R^1$, $R^2$, $R^3$ and $R^4$ does not represent an alkyl group at the same time; when Y in the formula [V] is —O—, $B^4$ has the same meaning as for $B^5$; when each of X and Z in the formula [VI] independently is $$-\overset{\overset{R}{|}}{N}-,$$

at least one of $B^2$, $B^3$ and $B^4$ is not C=O; and when each of $B^2$, $B^3$ and $B^4$ in the formula [VI] is $-CH_2-$ and Z is $$-\overset{\overset{R}{|}}{N}-,$$

X is —S—, $-SO_2$, —SO— or $$-\overset{\overset{R}{|}}{N}-.$$

5. The silver halide color photosensitive material as claimed in claim 1, wherein the photographic layer contains the heterocyclic compound represented by the formula [I].

6. The silver halide color photosensitive material as claimed in claim 1, wherein the photographic layer contains the heterocyclic compound represented by the formula [II], [III], [IV], [V] or [VI].

7. The silver halide color photosensitive material as claimed in claim 1, wherein the photosensitive material contains a layer containing an ultraviolet absorbent represented by the following formula [UV]:

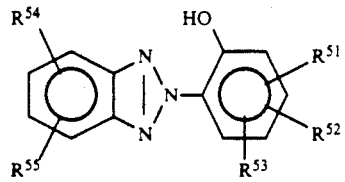

[UV]

in which each of $R^{51}$, $R^{52}$, $R^{53}$, $R^{54}$ and $R^{55}$ independently is a member group selected from the group consisting of hydrogen, an alkoxy group, an alkyl group, a halogen atom and an alkoxycarbonyl group.

8. The silver halide color photosensitive material as claimed in claim 1, wherein the photosensitive material contains a layer containing a pyrazoloazole coupler represented by the following formula [M-III]:

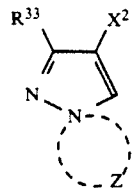

[M-III]

in which $R^{33}$ is hydrogen or another substituent group; Z is a non-metallic atomic group which form a 5-membered azole ring containing 2, 3 or 4 nitrogen atoms; the azole ring may have one or more substituent groups; another ring may be condensed with the azole ring; and $X^2$ is hydrogen or a substituent group.

9. The silver halide color photosensitive material as claimed in claim 1, wherein the photosensitive material comprises a support, a yellow dye image forming layer, a magenta dye image forming layer and a cyan dye image forming layer.

10. The silver halide color photosensitive material as claimed in claim 5, wherein the heterocyclic compound represented by the formula [I] is a heterocyclic compound represented by the following formula [I-A]:

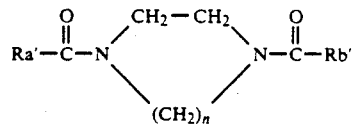

[I-A]

in which n is 1, 2 or 3: and each of Ra' and Rb' independently is an alkyl group, an alkenyl group, an aryl group, a heterocyclic group, an alkoxy group, an alkenyloxy group, an aryloxy group, a monovalent group composed of a heterocyclic group united with oxygen, or an amino group which may have one or more substituent groups.

11. The silver halide color photosensitive material as claimed in claim 10, wherein each of Ra' and Rb' in the formula [I-A] independently is an alkyl group, an alkenyl group, an aryl group, an alkoxy group, an alkenyloxy group or an aryloxy group.

12. The silver halide color photosensitive material as claimed in claim 10, wherein each of Ra' and Rb' in the formula [I-A] independently is an alkyl group, an alkenyl group or an aryl group and n is 2.

13. The silver halide color photosensitive material as claimed in claim 6, wherein at least one of $R^1$, $R^2$, $R^3$, $R^4$, $R^5$, $R^6$, $R^7$, $R^8$, $R^9$, $R^{10}$, $R^{11}$ and $R^{12}$ in the formula

[II], [III], [IV], [V] or [VI] is an amino group which may have one or more substituent groups, a carbamoyl group or a sulfamoyl group.

14. The silver halide color photosensitive material as claimed in claim 1, wherein the amount of the heterocyclic compound represented by the formula [I], [II], [III], [IV], [V] or [VI] is in the range of $1\times10^{-2}$ to 10 mole based on 1 mole of a coupler.

15. The silver halide color photosensitive material as claimed in claim 1, wherein the amount of the heterocyclic compound represented by the formula [I], [II], [III], [IV], [V] or [VI] is in the range of $1\times10^{-1}$ to 5 mole based on 1 mole of a coupler.

16. The silver halide color photosensitive material as claimed in claim 1, wherein the amount of the heterocyclic compound represented by the formula [I], [II], [III], [IV], [V] or [VI] is in the range of $1\times10^{-1}$ to 1 mole based on 1 mole of a coupler.

17. The silver halide color photosensitive material as claimed in claim 1, wherein the photosensitive material contains a silver halide emulsion layer containing a silver chloride or silver chlorobromide emulsion which substantially does not contain silver iodide and contains silver chloride in an amount of not less than 90 mole % based on the total amount of the silver halide.

18. The silver halide color photosensitive material as claimed in claim 17, wherein the silver chloride or silver chlorobromide emulsion contains silver chloride in an amount of not less than 95 mole % based on the total amount of the silver halide.

* * * * *